US009744091B2

(12) United States Patent
Branch et al.

(10) Patent No.: US 9,744,091 B2
(45) Date of Patent: Aug. 29, 2017

(54) UNSTRUCTURED AND STRUCTURED LIMB MANIPULATION APPARATUSES AND METHODS FOR USING THE SAME

(75) Inventors: Thomas Branch, Atlanta, GA (US); Thomas Joseph Cunningham, Smyrna, GA (US); Shaun Kevin Stinton, Sandy Springs, GA (US); Edward Ditmar, Marietta, GA (US); Nathaniel K. DeJarnette, Lilburn, GA (US); Eugene Sung, Powell, OH (US); Cale Jacobs, Lexington, KY (US)

(73) Assignee: ERMI, INC., Atlanta, GA (US)

( * ) Notice: Subject to any disclaimer, the term of this patent is extended or adjusted under 35 U.S.C. 154(b) by 1211 days.

(21) Appl. No.: 13/559,322

(22) Filed: Jul. 26, 2012

(65) Prior Publication Data

US 2013/0053735 A1 Feb. 28, 2013

Related U.S. Application Data

(60) Provisional application No. 61/511,804, filed on Jul. 26, 2011.

(51) Int. Cl.
*A61H 1/02* (2006.01)
*A61H 9/00* (2006.01)

(52) U.S. Cl.
CPC ..... *A61H 1/0237* (2013.01); *A61H 1/0274* (2013.01); *A61H 1/0277* (2013.01);
(Continued)

(58) Field of Classification Search
CPC ..... A61H 1/00; A61H 1/0237; A61H 1/0277; A61H 1/0274; A61H 1/0288; A61H 9/00;
(Continued)

(56) References Cited

U.S. PATENT DOCUMENTS 2,880,721 A * 4/1959 Corcoran ..... A61H 9/0078 128/DIG. 20
3,581,740 A 6/1971 Sherbourne
(Continued)

FOREIGN PATENT DOCUMENTS

DE 19500853 A1 7/1996
GB 911419 A 11/1962
(Continued)

OTHER PUBLICATIONS

International Searching Authority, Notification of Transmittal of the International Preliminary Report on Patentability (including the Report), for International Appn No. PCT/US2012/048377, mailed Jan. 31, 2014, 54 Pages, European Patent Office, D-80298 Munich.
(Continued)

*Primary Examiner* — Quang D Thanh
(74) *Attorney, Agent, or Firm* — Moore & Van Allen PLLC; Patrick B. Home

(57) ABSTRACT

Various embodiments provide assemblies for manipulating a user's limb with at least one inflatable member. The assemblies comprise a first pliable planar member and a second pliable planar member overlaid atop at least a portion of the first pliable planar member, such that a two ply configuration is provided. The two ply configuration itself comprises at least a distal and a proximal portion and at least one opening configured to accept at least a portion of the user's limb. The first and second pliable planar members combine to define at least one inflatable member, the inflatable member being at least a portion of at least one of the distal and proximal portions, the inflatable member being configured to be selectively inflatable so as to provide at least one inflation force upon the user's limb, such that the joint in the user's limb is manipulated. Associated methods are also provided.

45 Claims, 36 Drawing Sheets

(52) U.S. Cl.
CPC ..... *A61H 1/0288* (2013.01); *A61H 9/0078* (2013.01); *A61H 9/0092* (2013.01); *A61H 2201/0103* (2013.01); *A61H 2201/1238* (2013.01); *A61H 2201/1253* (2013.01); *A61H 2201/1409* (2013.01); *A61H 2205/06* (2013.01); *A61H 2205/065* (2013.01); *A61H 2205/067* (2013.01); *A61H 2205/10* (2013.01); *A61H 2205/12* (2013.01)

(58) Field of Classification Search
CPC ..... A61H 9/0078; A61H 9/0092; A61H 2201/0103; A61H 2201/1238; A61H 2201/1253; A61H 2201/1409; A61H 2205/06; A61H 2205/065; A61H 2205/067; A61H 2205/10
See application file for complete search history.

(56) References Cited

U.S. PATENT DOCUMENTS 3,584,822 A 6/1971 Oram
4,300,759 A * 11/1981 Caplan ..... B63C 9/155 128/DIG. 20
4,596,240 A * 6/1986 Takahashi ..... A61H 1/0288 482/113
4,671,258 A * 6/1987 Barthlome ..... A61H 1/0288 128/DIG. 20
6,673,028 B1 * 1/2004 Argenta ..... A61H 1/0277 482/49

FOREIGN PATENT DOCUMENTS

KR 2011/0010256 A 2/2011
SU 961692 A1 9/1982

OTHER PUBLICATIONS

International Searching Authority, Invitation to Pay Additional Fees and, Where Applicable, Protest Fee (Partial International Search Report) for International Application No. PCT/US2012/048377, mialed Nov. 15, 2012, 8 pages, European Patent Office, The Netherlands.
International Searching Authority, International Search Report and Written Opinion for International Application No. PCT/US2012/048377, mailed Jan. 4, 2013, 20 pages, European Patent Office, The Netherlands.

* cited by examiner (INFILTRATION TUBE NOT SHOWN)

(INFLATION TUBE NOT SHOWN)

Note: The boundaries of portions 80, 81, 82, 83, 84, and 86 are approximate only; in reality these portions combine to compose the entirety of the Assembly 10

LESS DEFLATED

MORE INFLATED

DEFLATED

INFLATED (INFLATION TUBE NOT SHOWN)

Note: The boundaries of portions 180, 181, 182, 183, 184, and 186 are approximate only; in reality these portions combine to compose the entirety of the Assembly (Extension Orientation)

(Flexion Orientation)

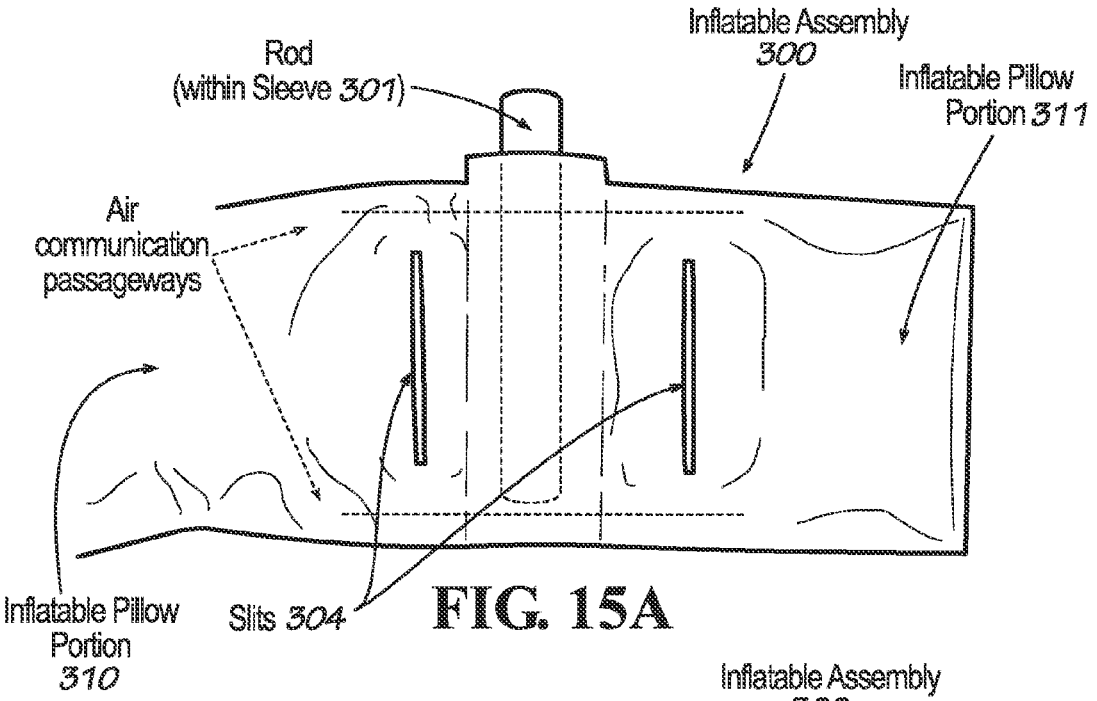
FIG. 15A
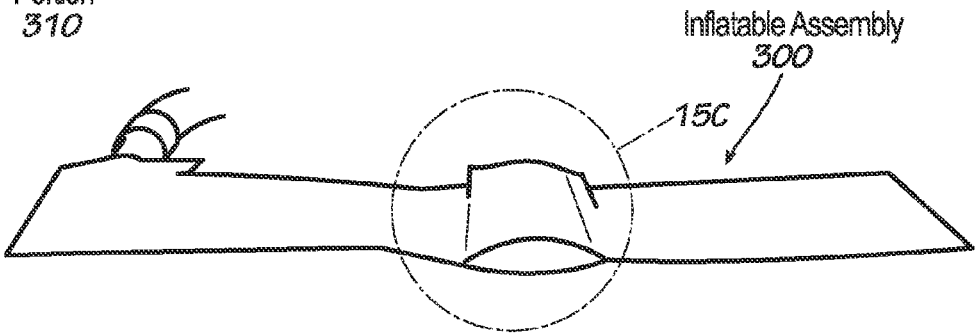
FIG. 15B
FIG. 15C
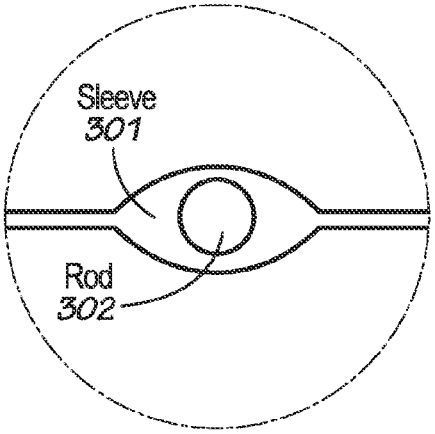

DEFLATED

INFLATED

DEFLATED

INFLATED (Flexion Orientation)

INFLATED (Flextion Orientation)

INFLATED (Flexion Orientation)

DEFLATED

DEFLATED

"Alternating Configuration"

Extension Configuration

Fig. 35

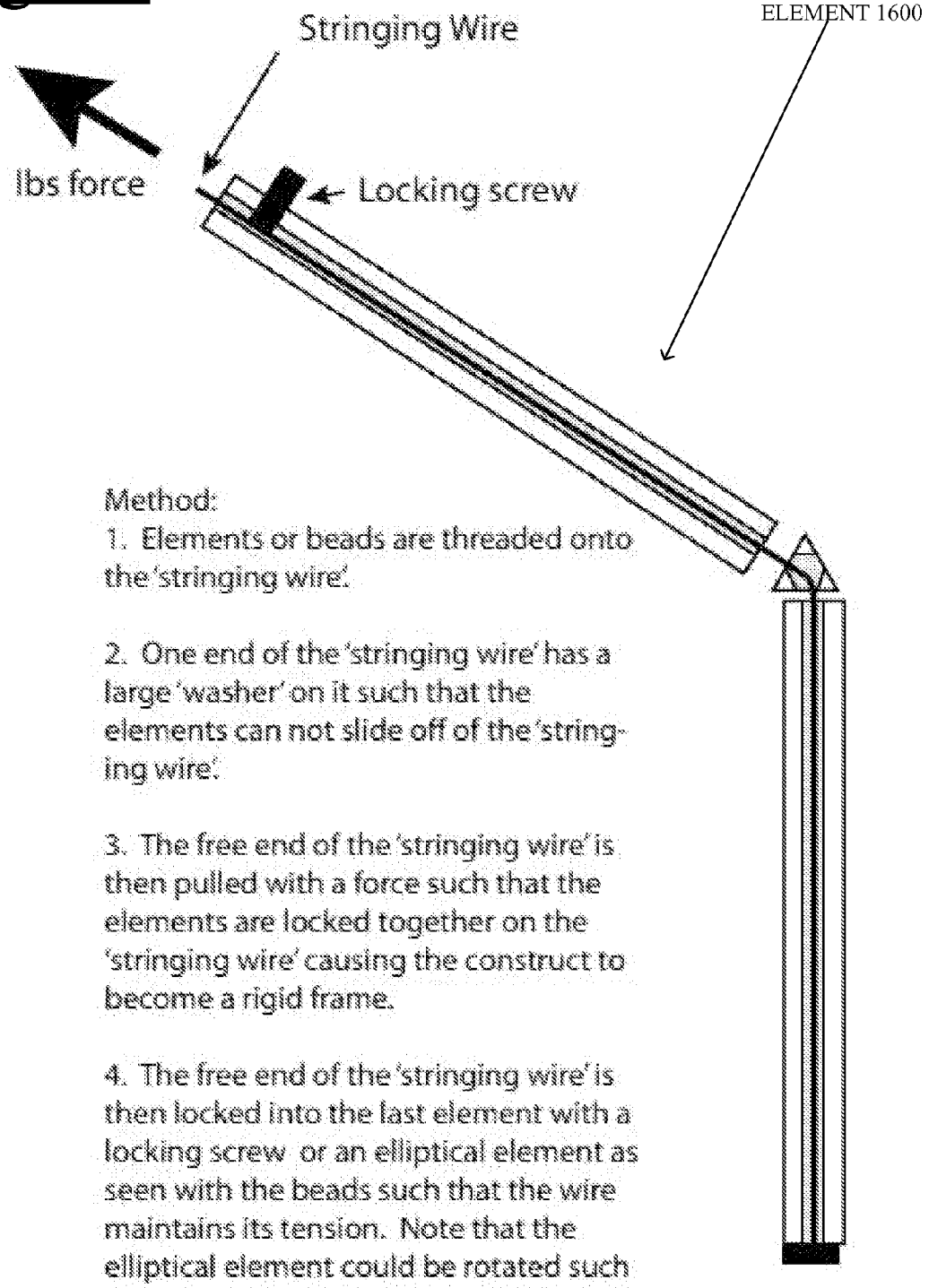

Method:

1. Elements or beads are threaded onto the 'stringing wire'.

2. One end of the 'stringing wire' has a large 'washer' on it such that the elements can not slide off of the 'stringing wire'.

3. The free end of the 'stringing wire' is then pulled with a force such that the elements are locked together on the 'stringing wire' causing the construct to become a rigid frame.

4. The free end of the 'stringing wire' is then locked into the last element with a locking screw or an elliptical element as seen with the beads such that the wire maintains its tension. Note that the elliptical element could be rotated such that slack is made in the 'stringing wire' to loosen the construct.

UNSTRUCTURED AND STRUCTURED LIMB MANIPULATION APPARATUSES AND METHODS FOR USING THE SAME

CROSS-REFERENCE TO RELATED APPLICATIONS

This application claims priority to and the benefit of U.S. Provisional Application No. 61/511,804, filed Jul. 26, 2011, which is hereby incorporated herein in its entirety.

BACKGROUND

Field of Invention

This invention relates generally to orthotic apparatuses and more particularly to unstructured and structured limb manipulation apparatuses configured to promote an increase in range of motion in a joint by the use of one or more selectively inflatable, deflatable, and un-inflatable portions.

Description of Related Art

When a joint is injured either by trauma or by surgery scar tissue can form which prevents full range of motion of that joint. Obviously, this is a disadvantageous condition and should be corrected if possible. Often, such correction involves an attempt by the injured or those assisting the injured to gradually (often over a period of months) manipulate and articulate the joint so that full range of motion is eventually achieved.

Full range of motion of a joint depends upon the anatomy of that joint and on the particular genetics of each individual. Typically, joints move in at least two directions, flexion and extension. Typically, flexion is to bend the joint and extension is to straighten the joint; however, in the orthopedic convention some joints only flex. Other joints not only flex and/or extend, they rotate. Rotation may be either external (e.g., away from the body) or internal (e.g., towards the body). Still other joints may be capable not only of flexion, extension, and rotation, but also of abduction and/or adduction. Abduction causes movement away from a midline of the joint, while adduction causes movement towards the midline. In this manner, various limbs and/or joints may be manipulated, as desired, by imposing thereupon one or more forces.

There are generally two forms of therapy to help patients gain range of motion in injured or surgically impaired joints with motion loss. The first is manual therapy, which is a stretching program requiring direct hands-on manipulation by a therapist with the express intent of increasing motion in the affected joint. The second is mechanical therapy, which is a specific medical device designed to allow the patient to stretch the joint without the help of a therapist. It has been shown that the use of mechanical devices to assist the patient in gaining range of motion are both helpful and highly desired as a technique to help avoid surgical treatment of joint motion loss.

However, oftentimes such mechanical devices incorporate complex frames and structural elements to enable not only manipulation but also support of the target joint(s). As a result, certain of such mechanical devices become cumbersome and/or difficult for patients to manipulate and transport. Therefore, there is a need for a simplistic orthopedic apparatus which promotes an increase in range of motion of the joint with minimal and/or no structural framework elements.

BRIEF SUMMARY

Generally described, the present invention to provide apparatuses and methods for providing complete and simplistic patient control of joint range of motion.

In accordance with the various embodiments of the present invention as described herein, an assembly for manipulating a user's limb with an inflatable member is provided. The limb has a distal segment, a proximal segment, and a joint located substantially between the distal and the proximal segments. The assembly thus comprises: a first pliable planar member; and a second pliable planar member overlaid atop at least a portion of the first pliable planar member, such that a two ply configuration is provided. The two ply configuration itself comprising: a distal portion; a proximal portion; a central portion located substantially intermediate the distal portion and the proximal portion; a first opening located substantially intermediate the distal portion and the central portion, the first opening configured to accept a portion of the distal portion of the user's limb; and a second opening located substantially intermediate the proximal portion and the central portion, the second opening configured to accept a portion of the proximal portion of the user's limb; wherein the first and second pliable planar members combine to define an inflatable member, the inflatable member being at least a portion of at least one of the distal, proximal, and central portions, the inflatable member being configured to be selectively inflatable so as to provide at least one inflation force upon the user's limb, such that the joint in the user's limb is manipulated.

In accordance with the various embodiments of the present invention as described herein, an assembly for manipulating a user's limb with an inflatable member is provided. The limb has a distal segment, a proximal segment, and a joint located substantially between the distal and the proximal segments. The assembly thus comprises: a first pliable planar member; and a second pliable planar member overlaid atop at least a portion of the first pliable planar member, such that a two ply configuration is provided. The two-ply configuration comprises: a distal portion; a proximal portion; and a first opening located substantially intermediate the distal portion and the proximal portion, the first opening configured to accept a portion of the distal portion of the user's limb, wherein the first and second pliable planar members combine to define an inflatable member, the inflatable member being at least a portion of at least one of the distal and proximal portions, the at least one inflatable member being configured to be selectively inflatable so as to provide at least one inflation-imposed force by the inflatable member upon the user's limb, such that the user's limb is manipulated.

In accordance with the various embodiments of the present invention as described herein, a method for manipulating a user's limb with an inflatable member, the limb having a distal segment, a proximal segment, and a joint located substantially between the distal and the proximal segments is provided. The method comprises the steps of: providing an assembly comprising: a first pliable planar member; and a second pliable planar member overlaid atop at least a portion of the first pliable planar member, such that a two ply configuration is provided. The provided two ply configuration comprises: a distal portion; a proximal portion; a central portion located substantially intermediate the distal portion and the proximal portion; a first opening located substantially intermediate the distal portion and the central portion, the first opening configured to accept a portion of the distal portion of the user's limb; and a second opening located substantially intermediate the proximal portion and the central portion, the second opening configured to accept a portion of the proximal portion of the user's limb, wherein the first and second pliable planar members combine to define an inflatable member, the inflatable member being at least a portion of at least one of the distal, proximal, and central portions. The method further comprises the steps of: inserting at least the distal segment of the user's limb through the first opening, such that the distal segment is positioned substantially adjacent the central portion of the assembly; inserting at least the distal segment of the user's limb through the second opening, such that the distal segment is positioned substantially adjacent the distal portion of the assembly, the user's joint is positioned substantially adjacent the central portion of the assembly, and the proximal segment of the user's limb is positioned substantially adjacent the proximal portion of the assembly; and actuating a pump mechanism to selectively inflate the at least one inflatable member, wherein the selective inflation provides at least one force upon the user's limb, such that at least a portion of the user's limb is manipulated.

In accordance with the various embodiments of the present invention as described herein, a method for manipulating a user's limb with an inflatable member, the limb having a distal segment, a proximal segment, and a joint located substantially between the distal and the proximal segments is provided. The method comprises the steps of: providing an assembly comprising: a first pliable planar member; and a second pliable planar member overlaid atop at least a portion of the first pliable planar member, such that a two ply configuration is provided. The provided two ply configuration comprises: a distal portion; a proximal portion; and a first opening located substantially intermediate the distal portion and the proximal portion, the first opening configured to accept a portion of the distal portion of the user's limb, wherein the first and second pliable planar members combine to define an inflatable member, the inflatable member being at least a portion of at least one of the distal and proximal portions. The method further comprises the steps of: inserting the distal segment of the user's limb through the first opening, such that the distal segment is positioned substantially adjacent the distal portion of the assembly and the proximal segment of the user's limb is positioned substantially adjacent the proximal portion; and actuating a pump mechanism to selectively inflate the at least one inflatable member, wherein the selective inflation provides at least one force upon the user's limb, such that at least a portion of the user's limb is manipulated.

In accordance with the various embodiments of the present invention as described herein, a method for manipulating a user's limb with an inflatable member, the limb having a distal segment, a proximal segment, and a joint located substantially between the distal and the proximal segments is provided. The method comprises the steps of: providing an assembly comprising: a first pliable planar member; and a second pliable planar member overlaid atop at least a portion of the first pliable planar member, such that a two ply configuration is provided. The provided two ply configuration comprises: a distal portion; a proximal portion; and a first opening located substantially intermediate the distal portion and the proximal portion, the first opening configured to accept a portion of the distal portion of the user's limb, wherein the first and second first pliable planar members combine to define an inflatable member, the inflatable member being at least a portion of at least one of the distal and the proximal portions. The method further comprises the steps of: inserting the joint and at least a portion of the distal and the proximal segments of the user's limb through the first opening, such that the distal segment of the user's limb is positioned substantially adjacent the distal portion of the assembly and the proximal segment of the user's limb is positioned substantially adjacent the proximal portion of the assembly; and actuating a pump mechanism to selectively inflate the inflatable member, wherein the selective inflation causes the first opening to contract, and wherein the proximal portion of the assembly provides a first force upon the first side of the proximal segment of the user's limb and the proximal portion provides a second force upon the first side of the distal segment of the user's limb, the first and the second forces having components acting in substantially opposite directions relative to one another, such that the joint of the user's limb is manipulated.

In accordance with the various embodiments of the present invention as described herein, an assembly for manipulating a user's limb with an inflatable member is provided. The limb has a distal segment, a proximal segment, and a joint located substantially between the distal and the proximal segments. The assembly thus comprises: at least two subassemblies, each subassembly comprising: a first pliable planar member; and a second pliable planar member overlaid atop at least a portion of the first pliable planar member, such that a two ply configuration is provided. The two ply configuration of each subassembly comprises: a distal portion; a proximal portion; and a first opening located substantially intermediate the distal portion and the proximal portion, the first opening configured to accept a portion of the distal portion of the user's limb, wherein: the first and second pliable planar members of each of the at least two subassemblies combine to define respective inflatable members, the respective inflatable members each being at least a portion of at least one of the distal and proximal portions of each of the at least two subassemblies; and each of the respective inflatable members is configured to be selectively inflatable so as to provide at least one force upon at least one portion of the user's limb, such, via the at least two subassemblies, at least two portions of the user's limb are manipulated.

In accordance with the various embodiments of the present invention as described herein, an assembly for manipulating a user's limb with an inflatable member is provided. The limb has a distal segment, a proximal segment, and a joint located substantially between the distal and the proximal segments. The assembly thus comprises: at least two subassemblies, each subassembly comprising: a first pliable planar member; and a second pliable planar member overlaid atop at least a portion of the first pliable planar member, such that a two ply configuration is provided. The two ply configuration of each subassembly comprises: a distal portion; a proximal portion; a central portion located substantially intermediate the distal portion and the proximal portion; a first opening located substantially intermediate the distal portion and the central portion, the first opening configured to accept a portion of the distal portion of the user's limb; and a second opening located substantially intermediate the proximal portion and the central portion, the second opening configured to accept a portion of the proximal portion of the user's limb, wherein: the first and second pliable planar members of each of the at least two subassemblies combine to define respective inflatable members, the respective inflatable members each being at least a portion of at least one of the distal, proximal, and central portions of each of the at least two subassemblies; and each of the respective inflatable members is configured to be selectively inflatable so as to provide at least one force upon at least one portion of the user's limb, such, via the at least two subassemblies, at least two portions of the user's limb are manipulated.

In accordance with the various embodiments of the present invention as described herein, a method for manipulating a user's limb with an inflatable member, the limb having a distal segment, a proximal segment, and a joint located substantially between the distal and the proximal segments is provided. The method comprises the steps of: providing an assembly comprising: at least two subassemblies, each subassembly comprising: a first pliable planar member; and a second pliable planar member overlaid atop at least a portion of the first pliable planar member, such that a two ply configuration is provided. The two ply configuration comprises: a distal portion; a proximal portion; a first opening located substantially intermediate the distal portion and the proximal portion, the first opening configured to accept a portion of the distal portion of the user's limb; a first elongate sleeve having a first longitudinal axis; a second elongate sleeve having a second longitudinal axis, the second longitudinal axis being substantially parallel to the first longitudinal axis; and at least one frame member, the at least one frame member being substantially flexible and configured to be selectively manipulated into at least one of a plurality of shapes, wherein the first and second pliable planar members combine to define an inflatable member, the inflatable member being at least a portion of at least one of the distal, proximal, and central portions. The method further comprises the steps of: selectively manipulating the at least one frame member into a desired one of the plurality of shapes; threading the at least one frame member through the first and the second elongate sleeves of each of the at least two subassemblies; inserting the distal segment of the user's limb through the first opening of a first one of the at least two subassemblies, such that the distal segment is positioned substantially adjacent the distal portion of the first subassembly and the proximal segment of the user's limb is positioned substantially adjacent the proximal portion of the first subassembly; inserting the distal segment of the user's limb through the first opening of a second one of the at least two subassemblies, such that the distal segment is positioned substantially adjacent the distal portion of the second subassembly and the proximal segment of the user's limb is positioned substantially adjacent the proximal portion of the second subassembly, such that further distal and proximal segments of the user's limb are positioned substantially adjacent the distal and proximal portions of the first subassembly; and actuating a pump mechanism to selectively inflate the at least one inflatable member of one of more of the at least two subassemblies, wherein the selective inflation provides at least one force upon the user's limb, such that at least a portion of the user's limb is manipulated.

In accordance with the various embodiments of the present invention as described herein, an assembly for manipulating a user's limb with an inflatable member is provided. The limb has a distal segment, a proximal segment, and a joint located substantially between the distal and the proximal segments. The assembly thus comprises: at least two separately formed portions, each portion comprising: a first elongate sleeve having a first longitudinal axis; a second elongate sleeve having a second longitudinal axis, the second longitudinal axis being substantially parallel to the first longitudinal axis; and a medial member intermediate the first and second sleeves, the medial member including an inflatable member. The assembly further comprises an elongate frame member, the elongate frame member having a portion passing substantially through the first and the second elongate sleeves of each of the at least two separately formed portions, such that the at least two separately formed portions are spaced apart relative to each other along the length of the frame; the frame member being configured for customizable shaping and itself comprising: a first frame member having a hole passing completely therethrough; a second frame member having a hole passing completely therethrough; and a connection wire for extending through the holes in the first and second frame members, the connection wire configured for releasably connecting the first frame member relative to the second frame member, the connection wire also configured to enable adjustment of the first frame member relative to the second frame member, wherein the at least one inflatable member of each of the at least separately formed portions is configured to be selectively inflatable so as to provide at least one force upon at least one portion of the user's limb, such that, via the at least two separately formed portions, at least two portions of the user's limb are manipulated.

In accordance with the various embodiments of the present invention as described herein, a method for manipulating a user's limb with an inflatable member, the limb having a distal segment, a proximal segment, and a joint located substantially between the distal and the proximal segments is provided. The method comprises the steps of: providing an assembly comprising: at least two separately formed portions, each portion comprising: a first elongate sleeve having a first longitudinal axis; a second elongate sleeve having a second longitudinal axis, the second longitudinal axis being substantially parallel to the first longitudinal axis; a medial member intermediate the first and second sleeves, the medial member including an inflatable member; at least one elongate frame member. The method further comprises the steps of: B) selectively manipulating the at least one elongate frame member into a desired one of the plurality of shapes; C) threading the at least one elongate frame member through the first and the second elongate sleeves of each of the at least two separately formed portions, such that the at least two separately formed portions are spaced apart relative to each other along the length of the frame; D) inserting the distal segment of the user's limb through the first opening of a first one of the at least two portions, such that the distal segment is positioned substantially adjacent the distal portion of the first portion and the proximal segment of the user's limb is positioned substantially adjacent the proximal portion of the first portion; E) inserting the distal segment of the user's limb through the first opening of a second one of the at least two portions, such that the distal segment is positioned substantially adjacent the distal portion of the second portion and the proximal segment of the user's limb is positioned substantially adjacent the proximal portion of the second portion, such that further distal and proximal segments of the user's limb are positioned substantially adjacent the distal and proximal portions of the first portion; and F) actuating a pump mechanism to selectively inflate the at least one inflatable member of one of more of the at least two separately formed portions, wherein the selective inflation provides at least one force upon the user's limb, such that at least two portions of the user's limb are manipulated.

Other aspects, features, and advantages of the present invention will become apparent upon reading the following detailed description of the preferred embodiment of the invention when taken in conjunction with the drawing and the appended claims.

BRIEF DESCRIPTION OF THE DRAWINGS

Figure 1:
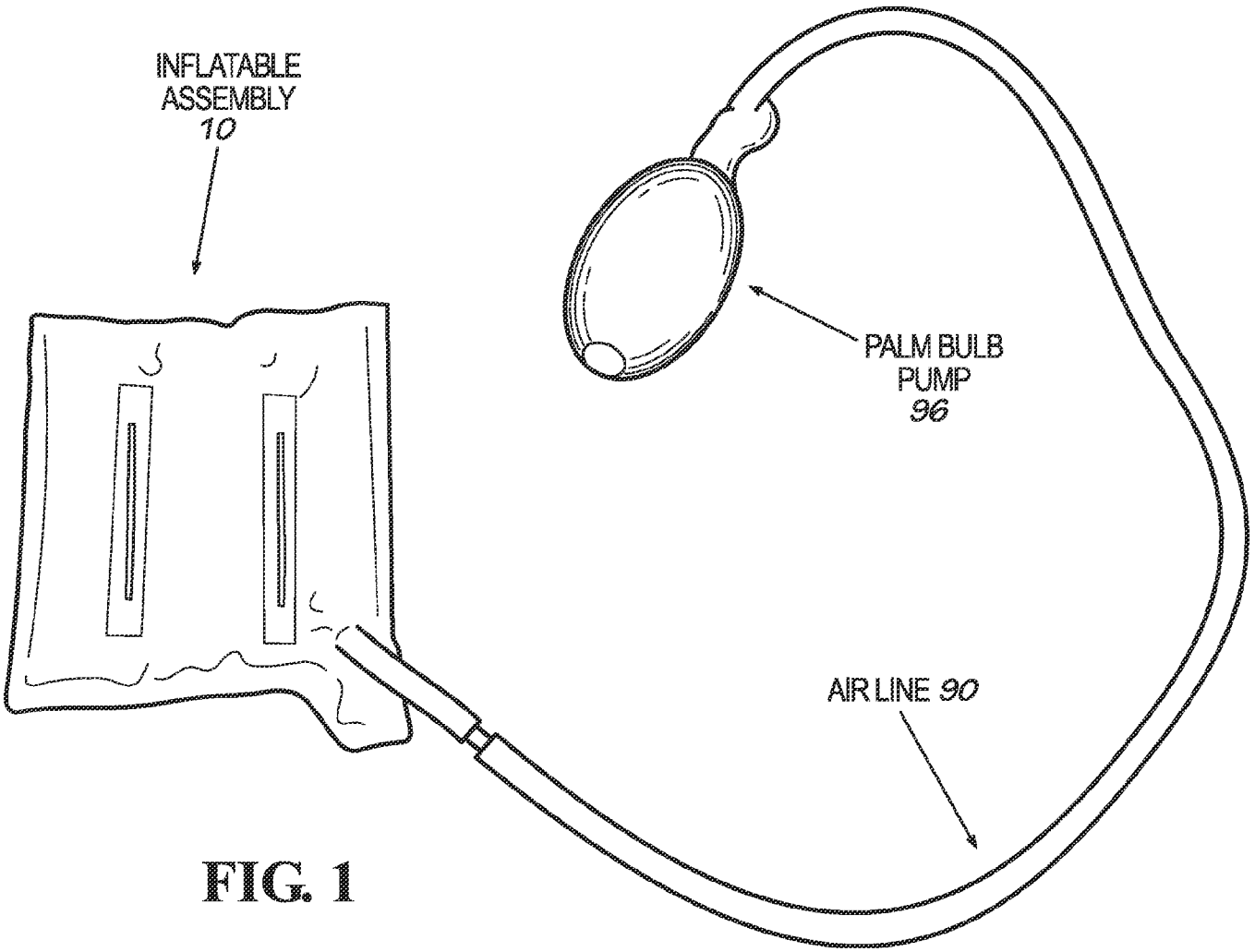
Figure 2:
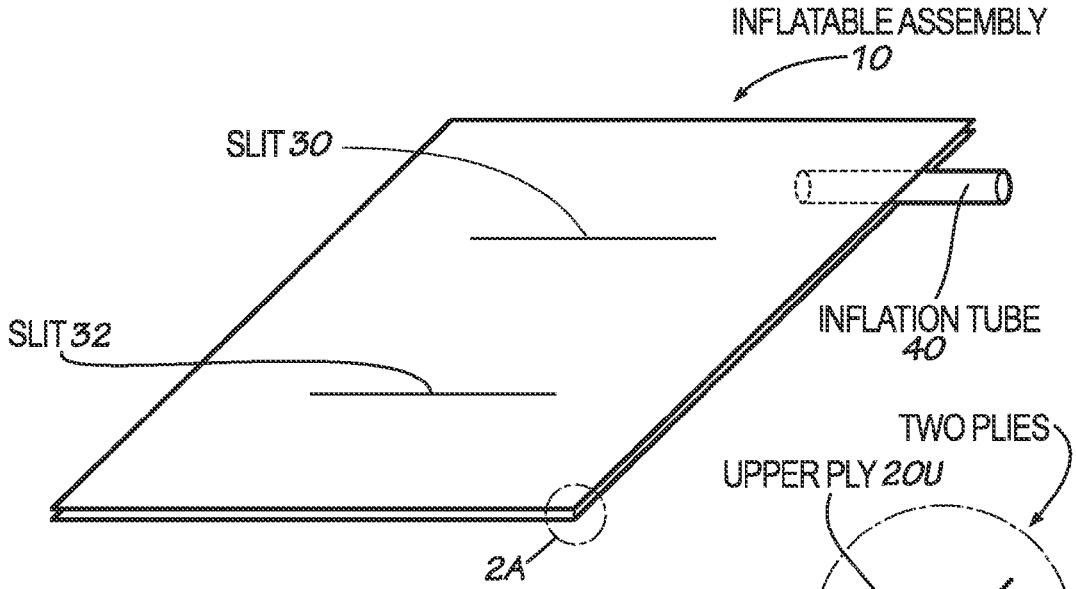
Figure 2A:
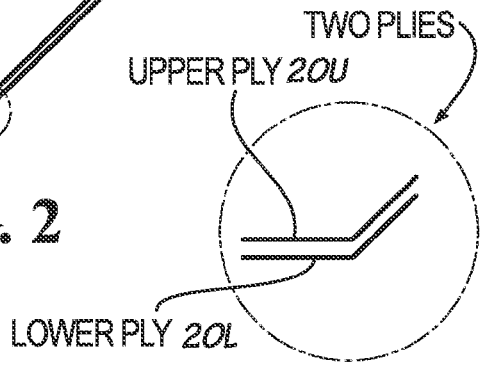
Figure 3:
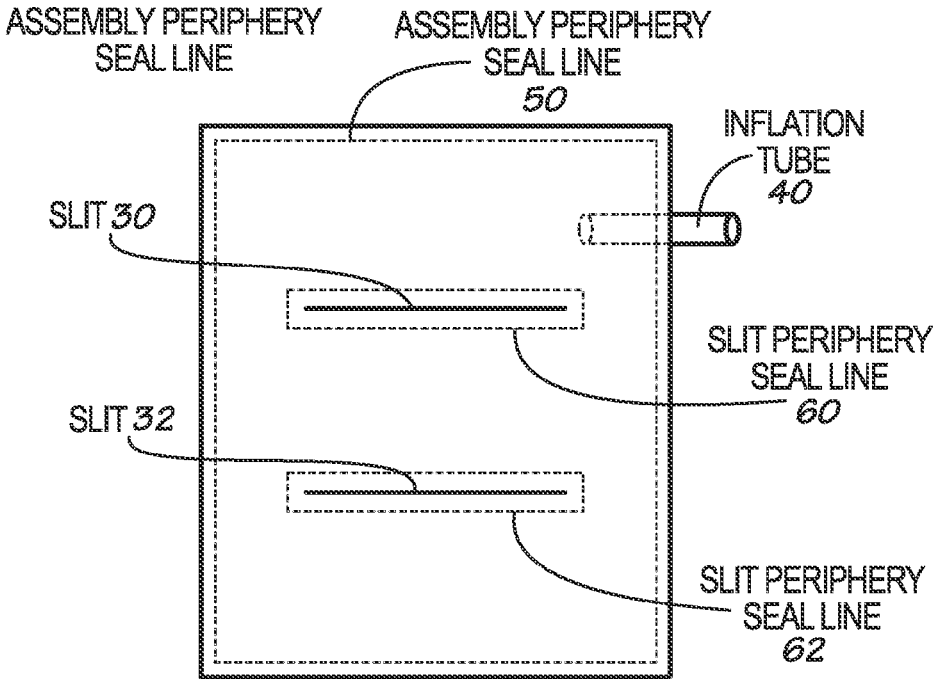
Figure 4:
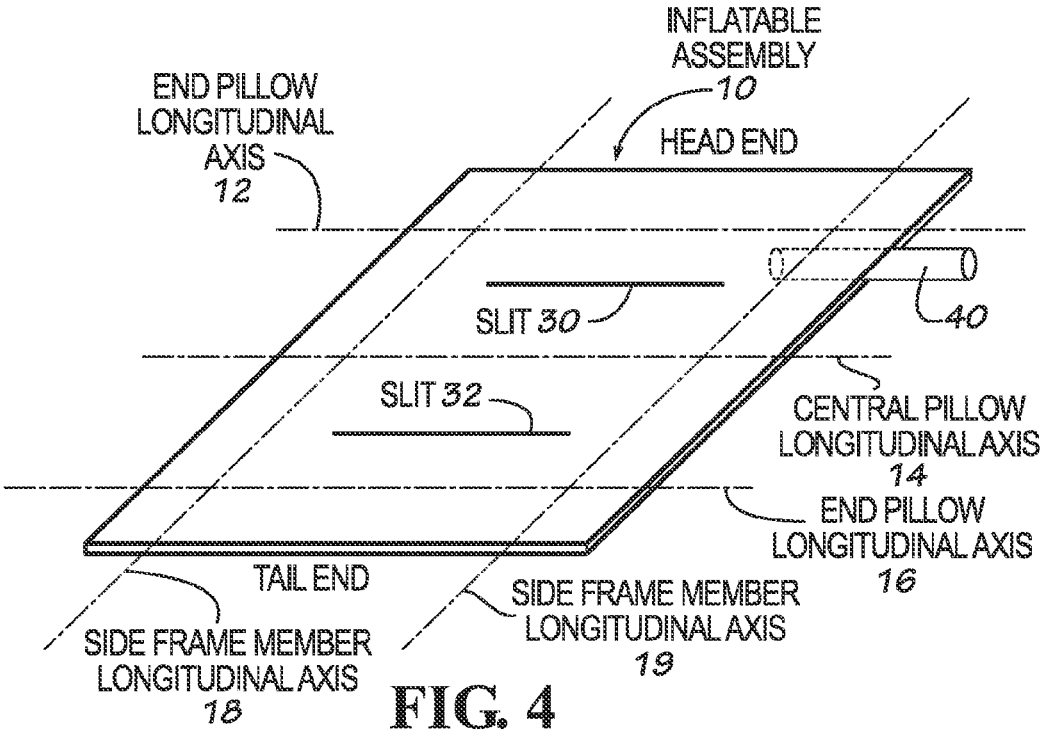
Figure 5:
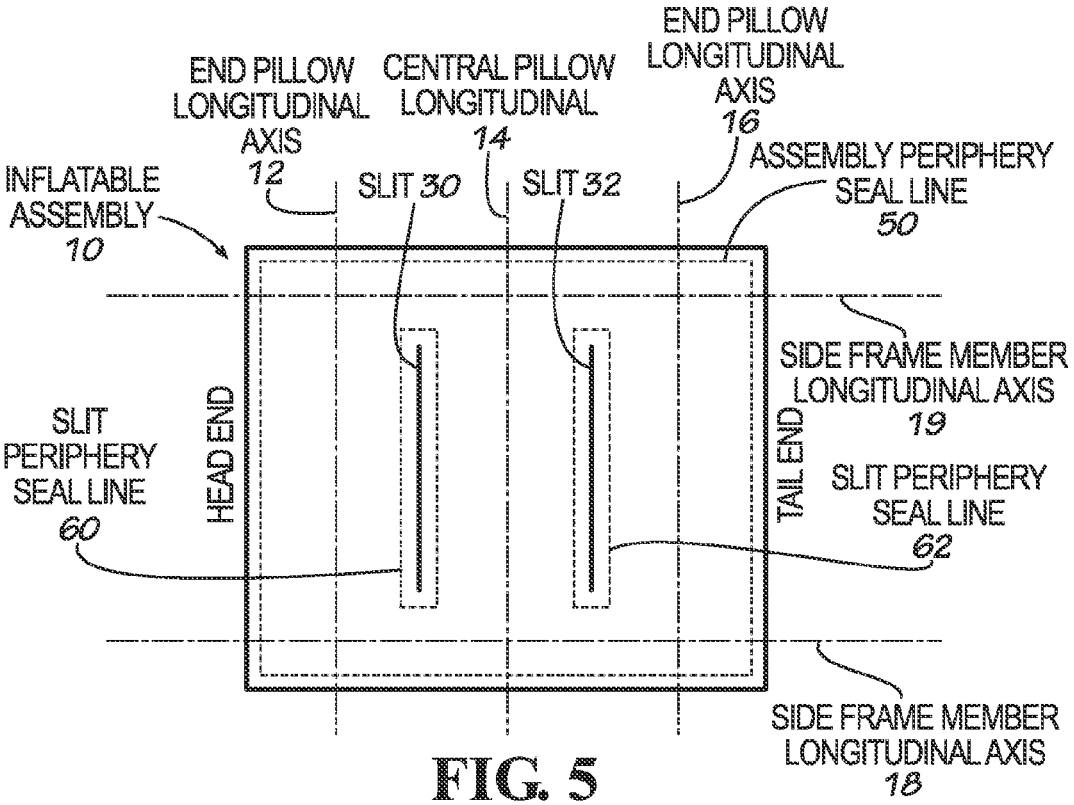
Figure 6:
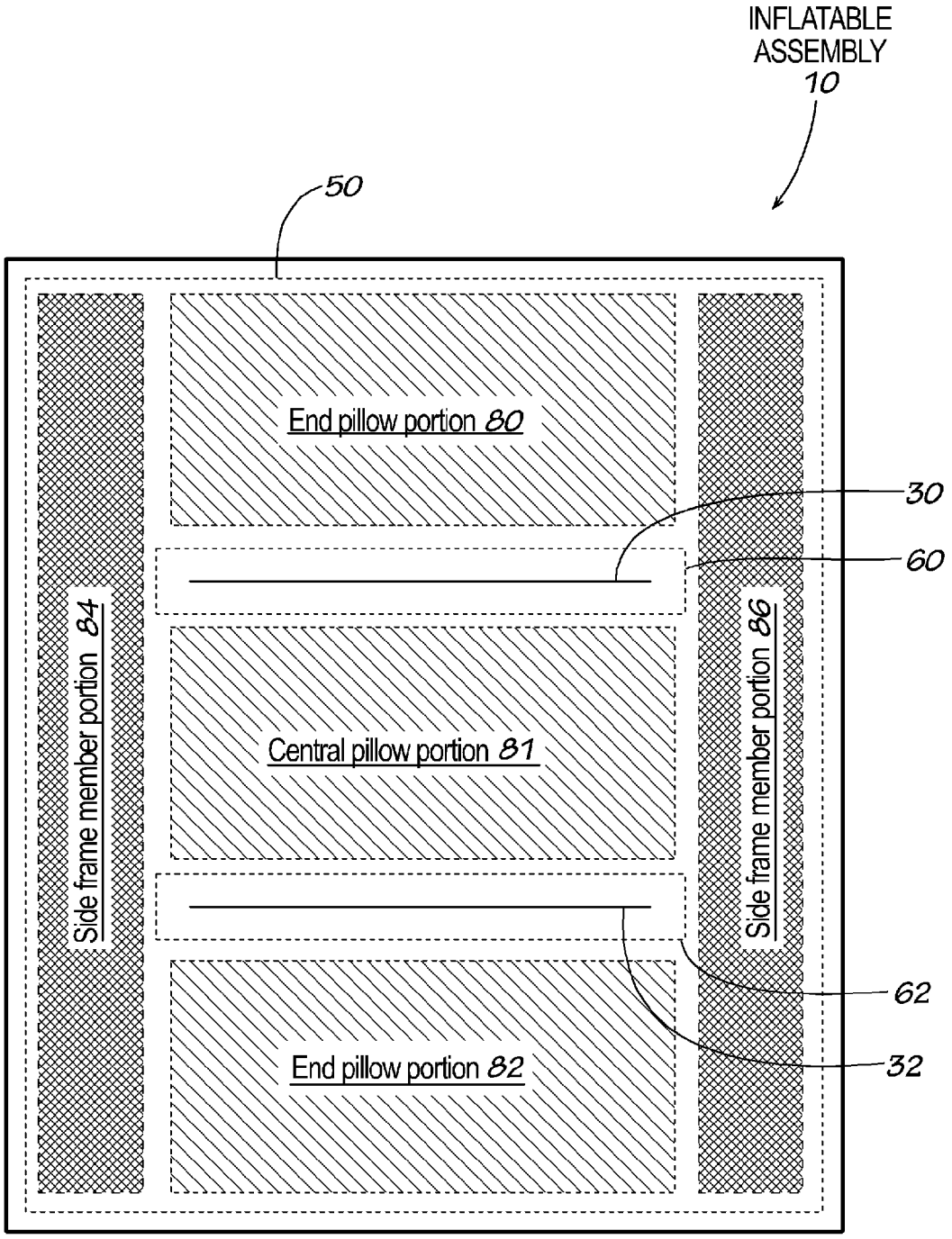

Having thus described the invention in general terms, reference will now be made to the accompanying drawings, which are not necessarily drawn to scale, and wherein:

FIG. 1 shows an exemplary inflatable assembly 10;

FIG. 2 is a pictorial view of the inflatable assembly 10 in a completely deflated state;

FIG. 2A is an enlarged view of upper and lower plies 20U, 20L of the inflatable assembly 10, as shown in FIG. 2;

FIG. 3 is a top plan view of the inflatable assembly 10 in a completely deflated state;

FIG. 4 is a pictorial view of the inflatable assembly 10 in a completely deflated state, and is similar to FIG. 2, except that it identifies certain axes;

FIG. 5 is a top plan view of the inflatable assembly 10 in a completely deflated state, and is similar to FIG. 3, and likewise shows such axes;

FIG. 6 is a top plan view of the inflatable assembly 10 in a completely deflated state similar to that shown in FIGS. 3 and 5, and also illustrates various "pillow portions;"

Figure 7A:
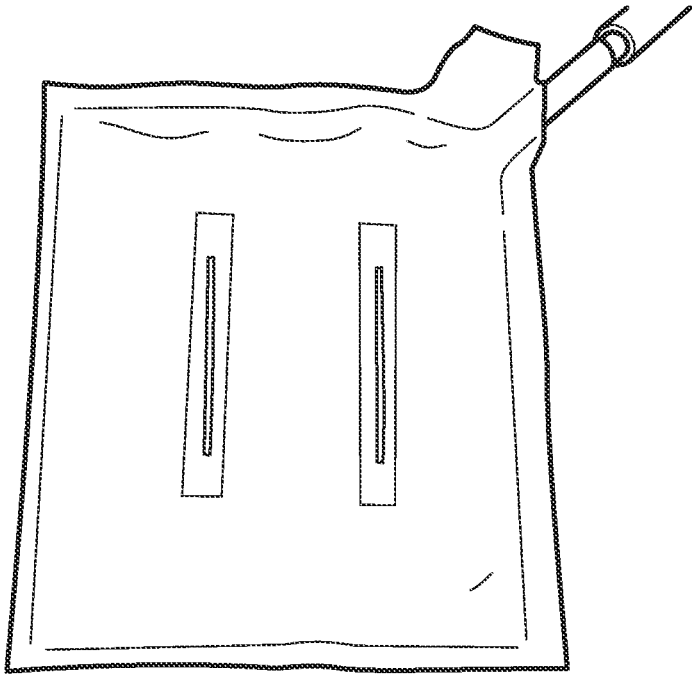
Figure 7B:
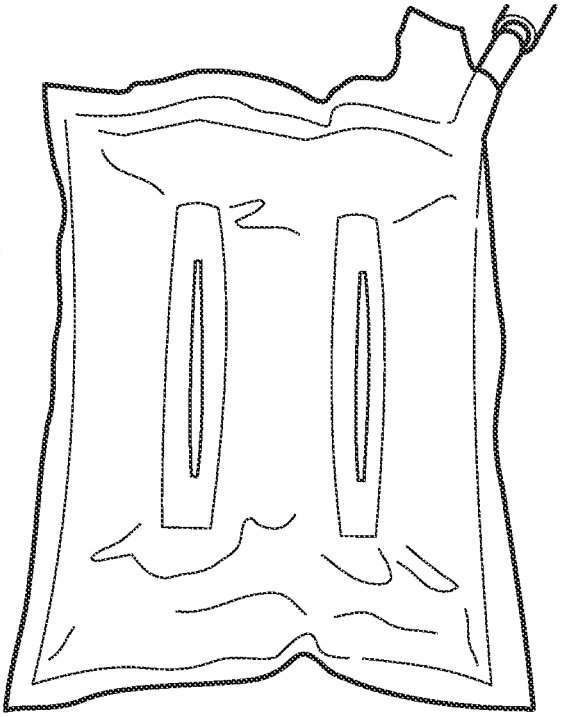
Figure 8A:
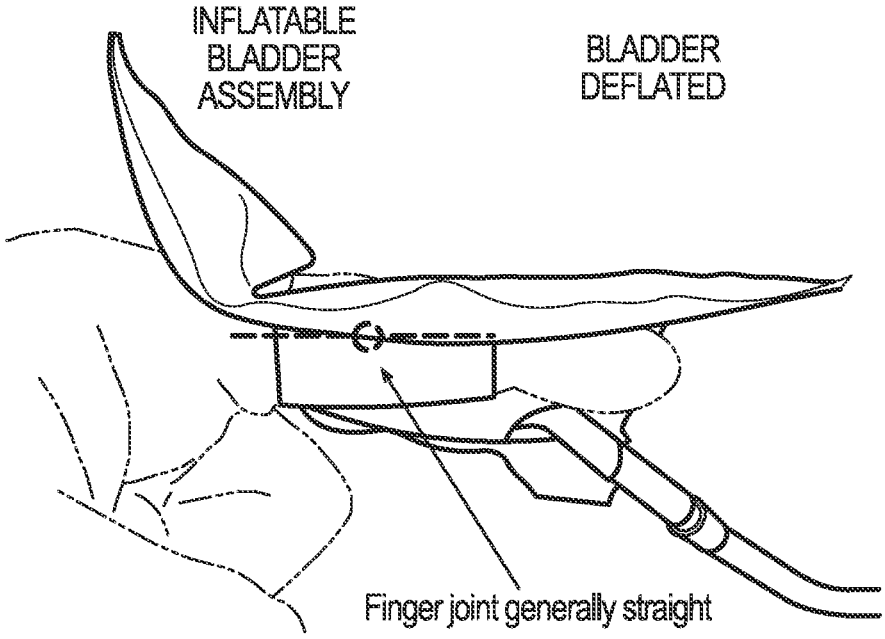
Figure 8B:
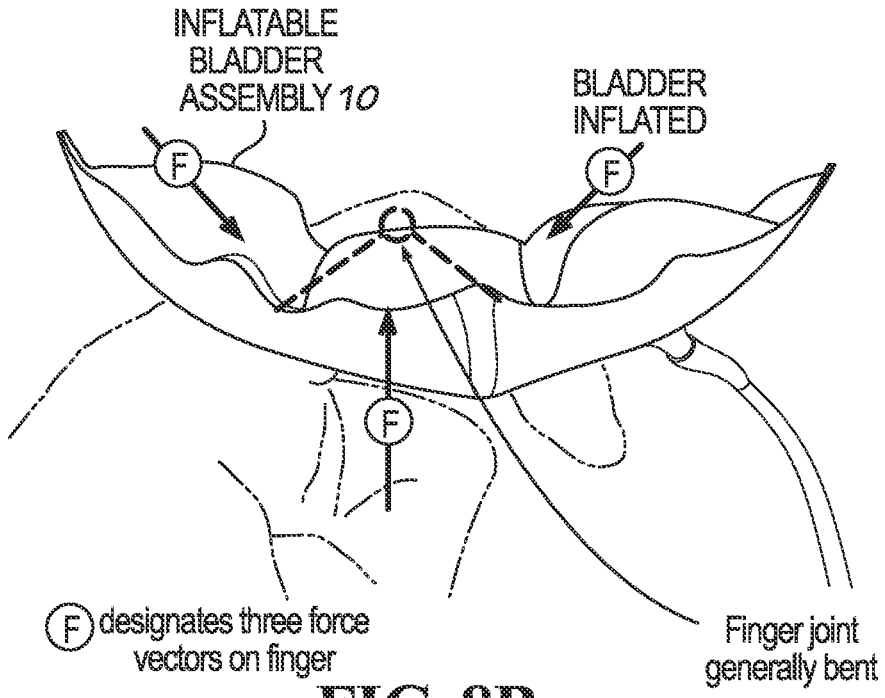
Figure 9A:
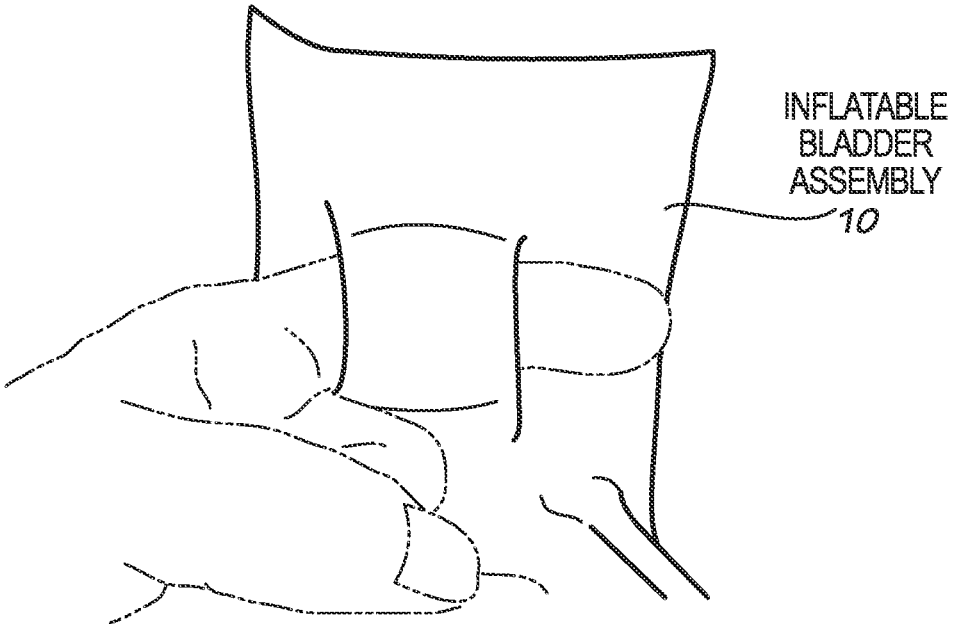
Figure 9B:
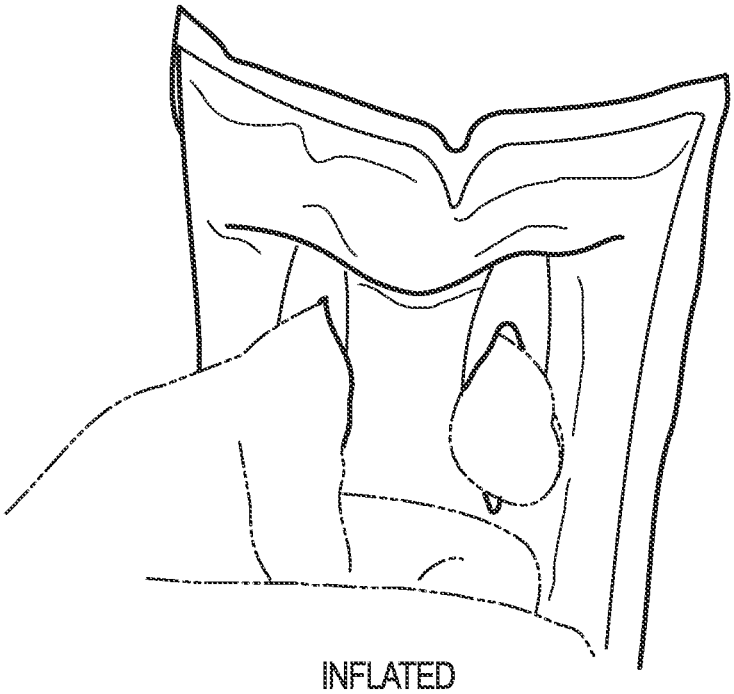
Figure 10A:
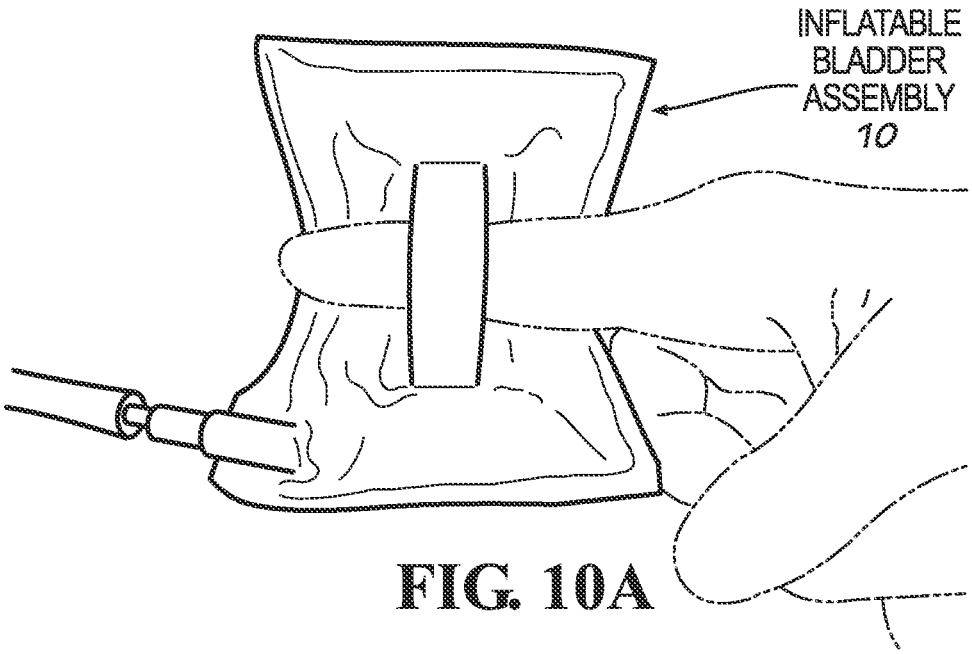
Figure 10B:
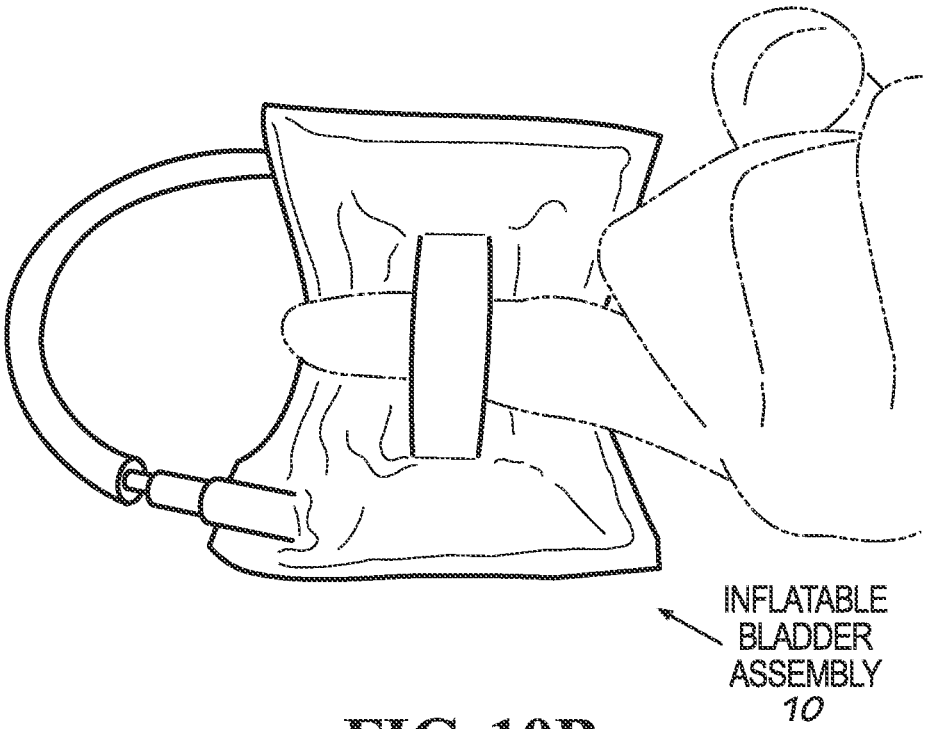
Figure 11:
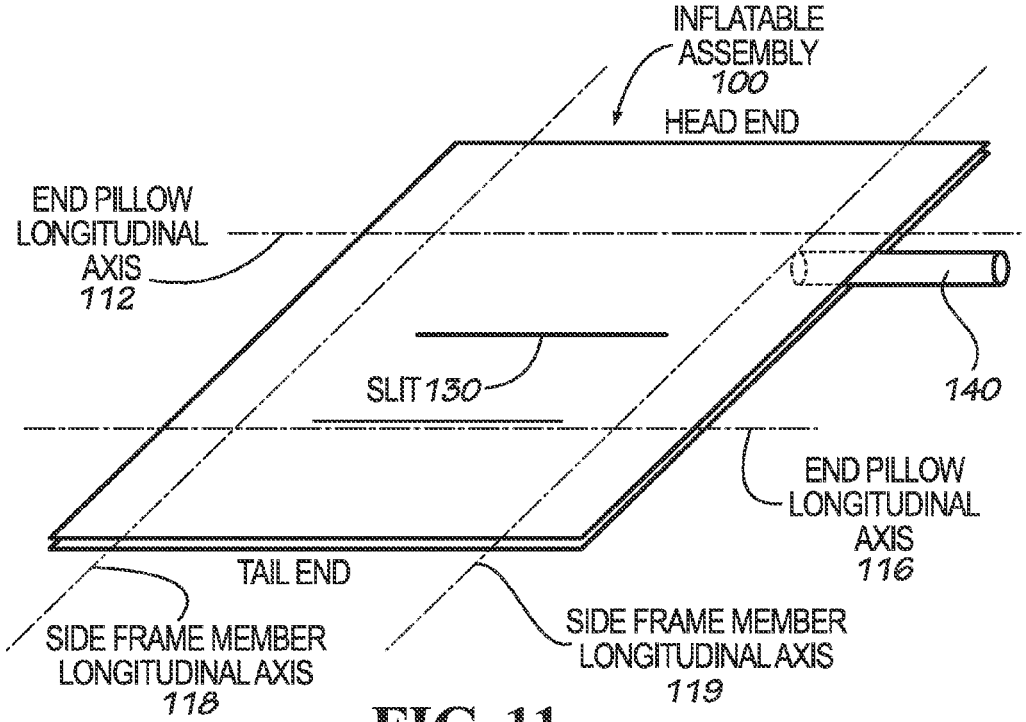
Figure 12:
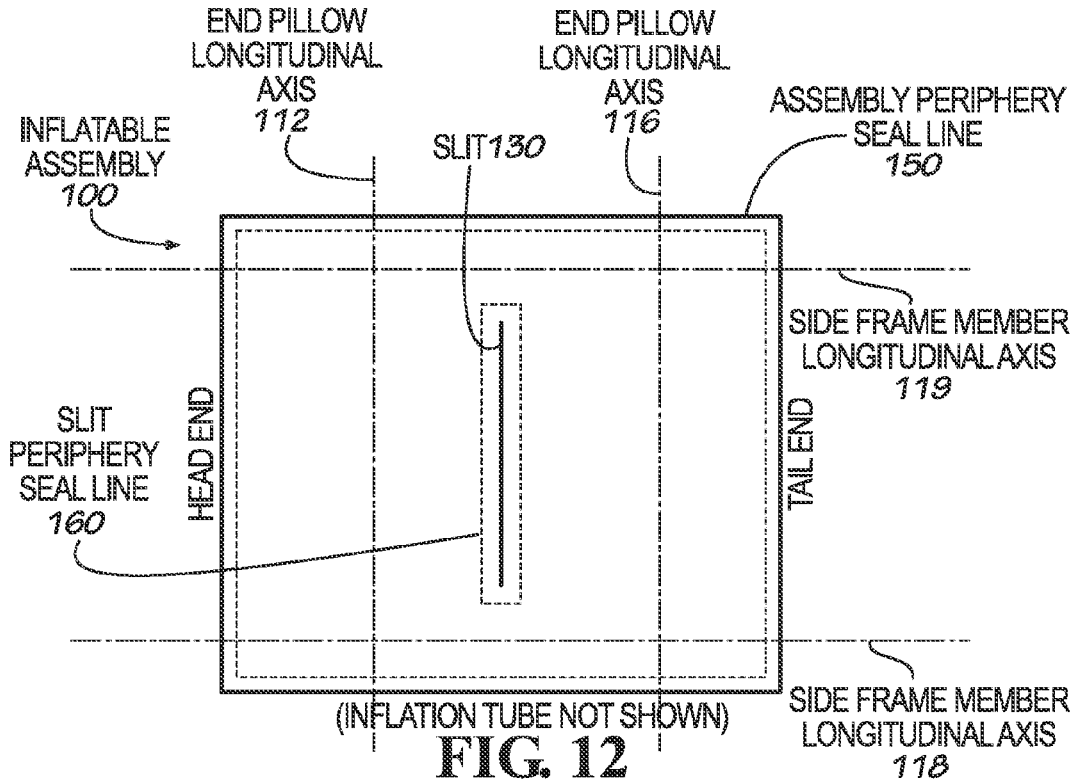
Figure 13:
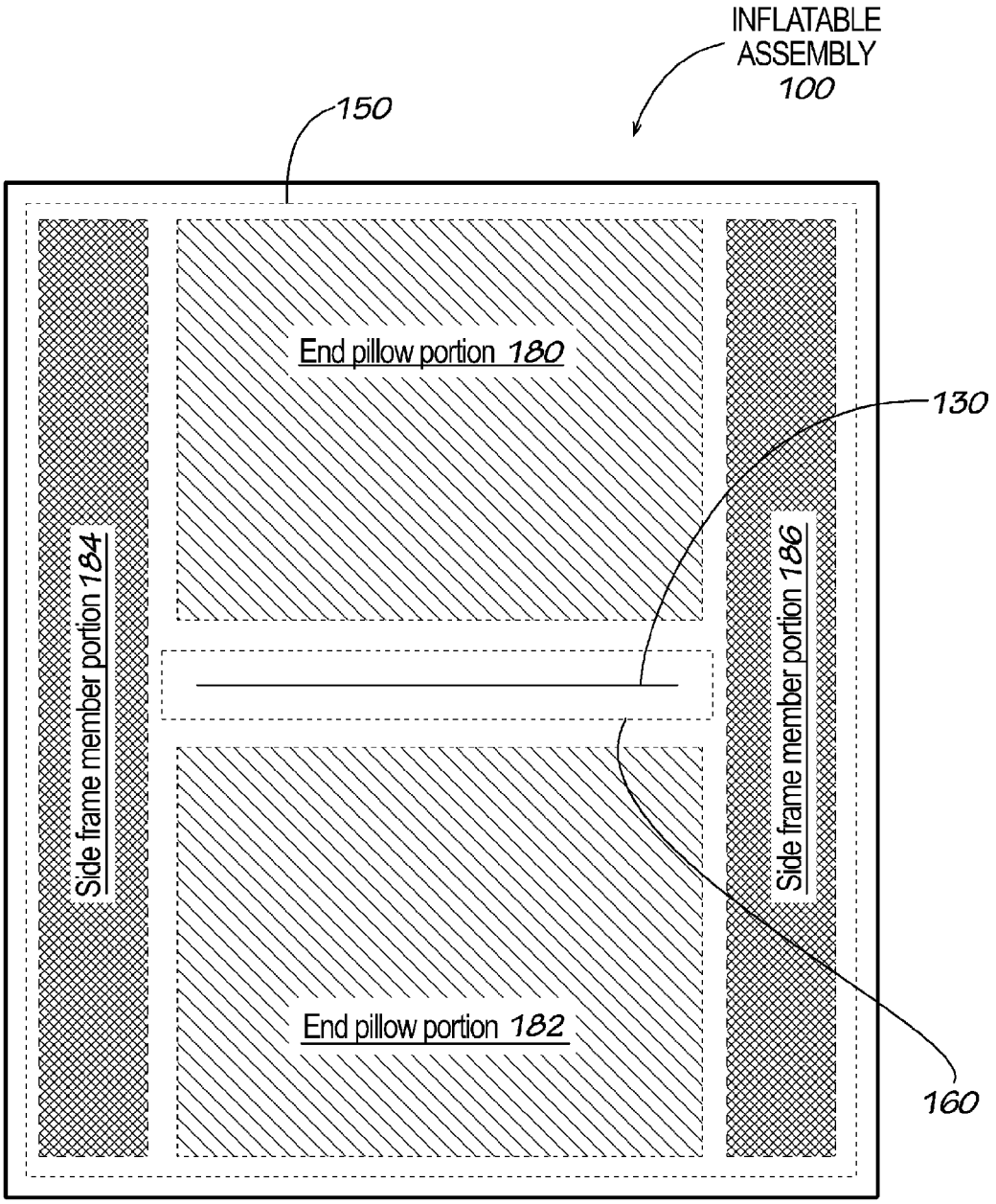
Figure 14A:
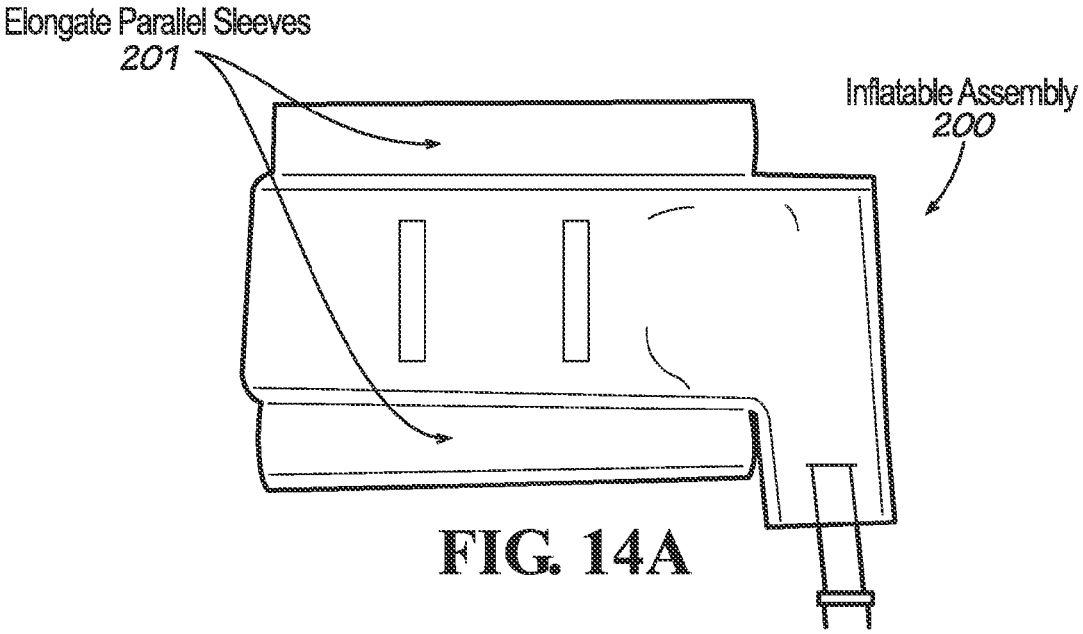
Figure 14B:
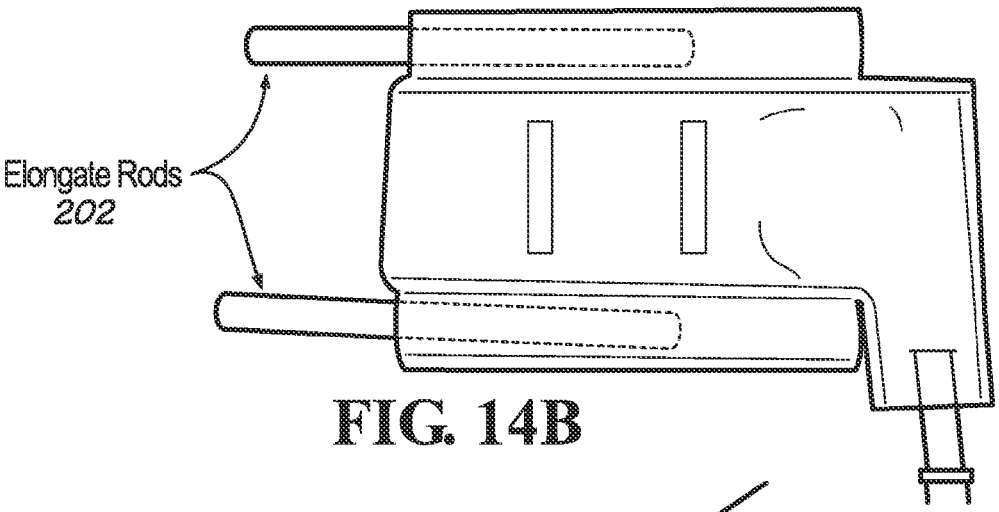
Figure 14C:
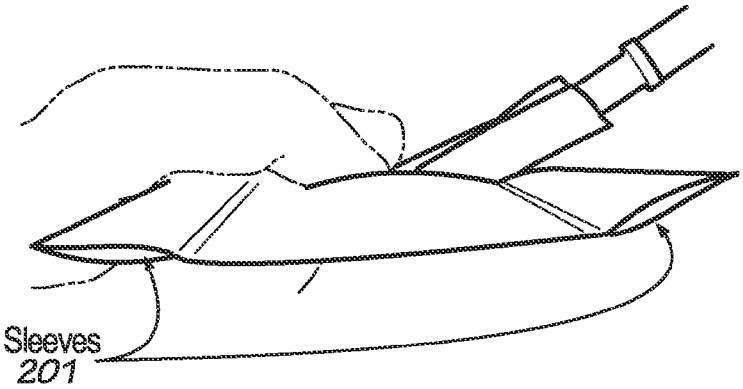
Figure 14D:
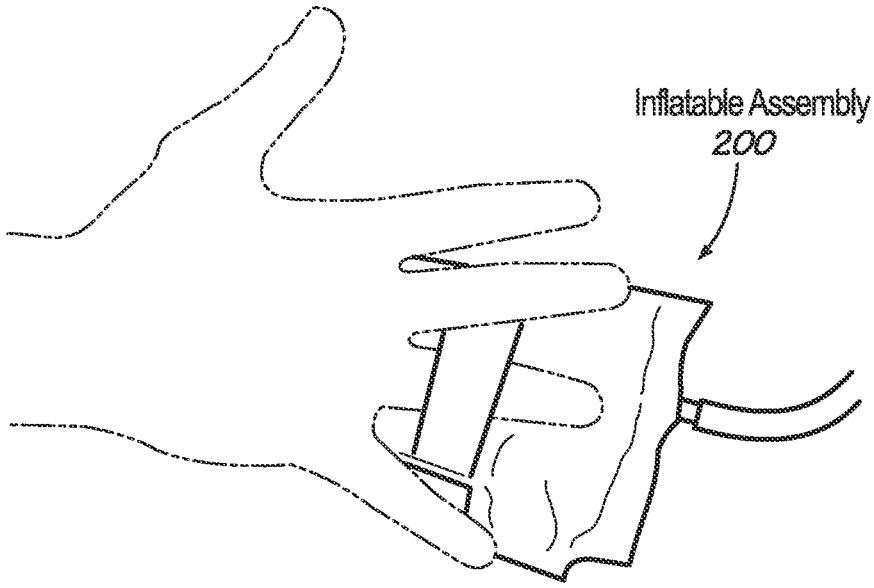
Figure 14E:
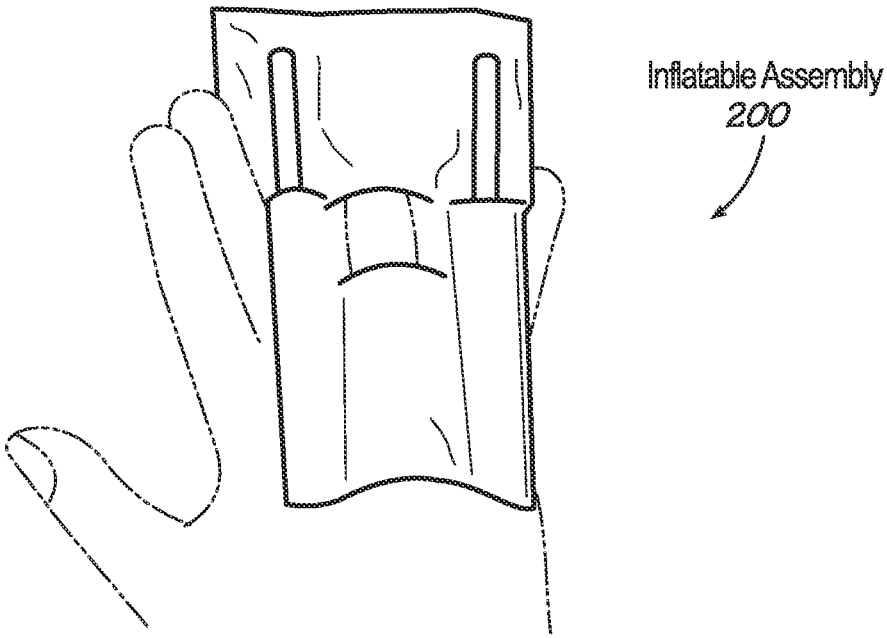
Figure 16:
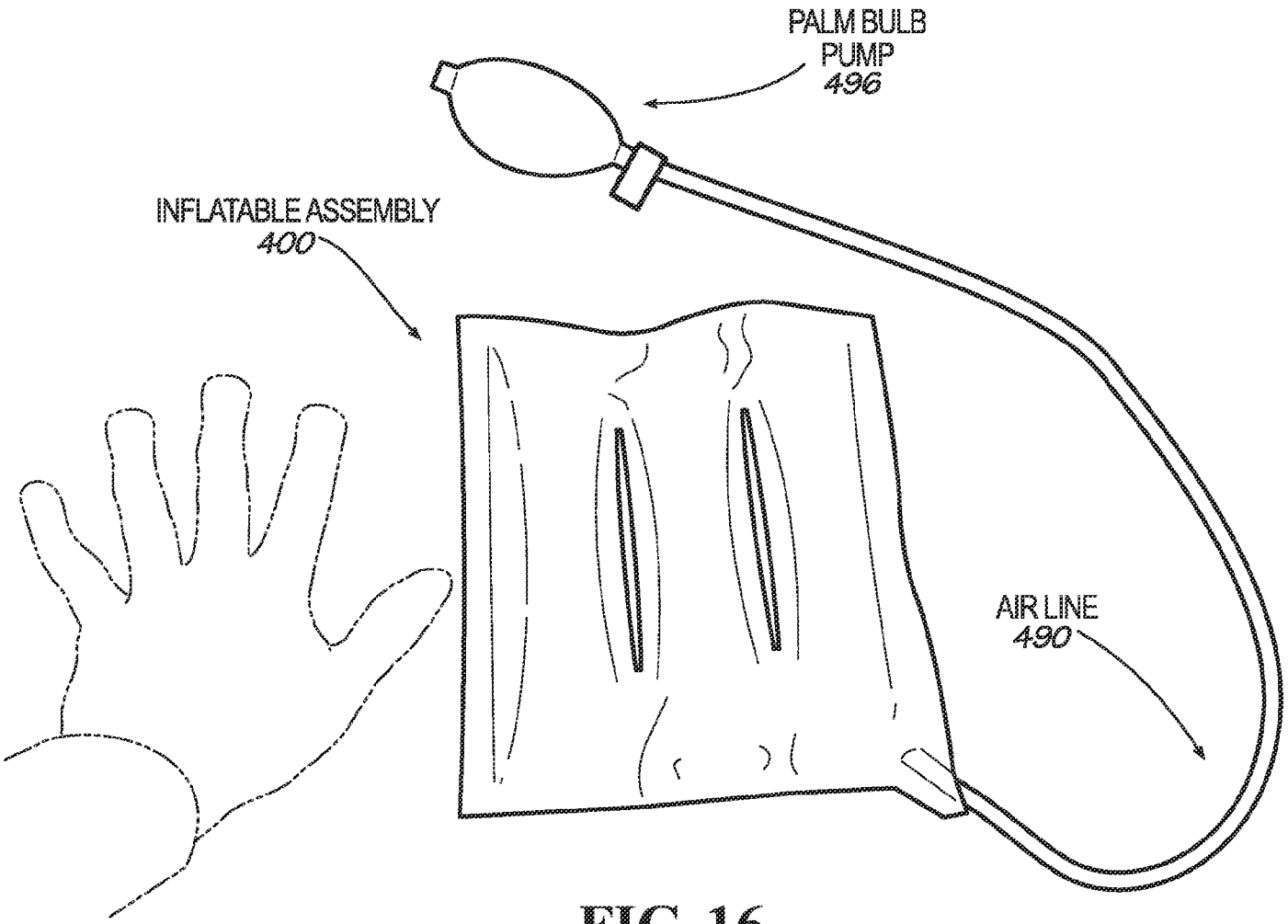
Figure 17A:
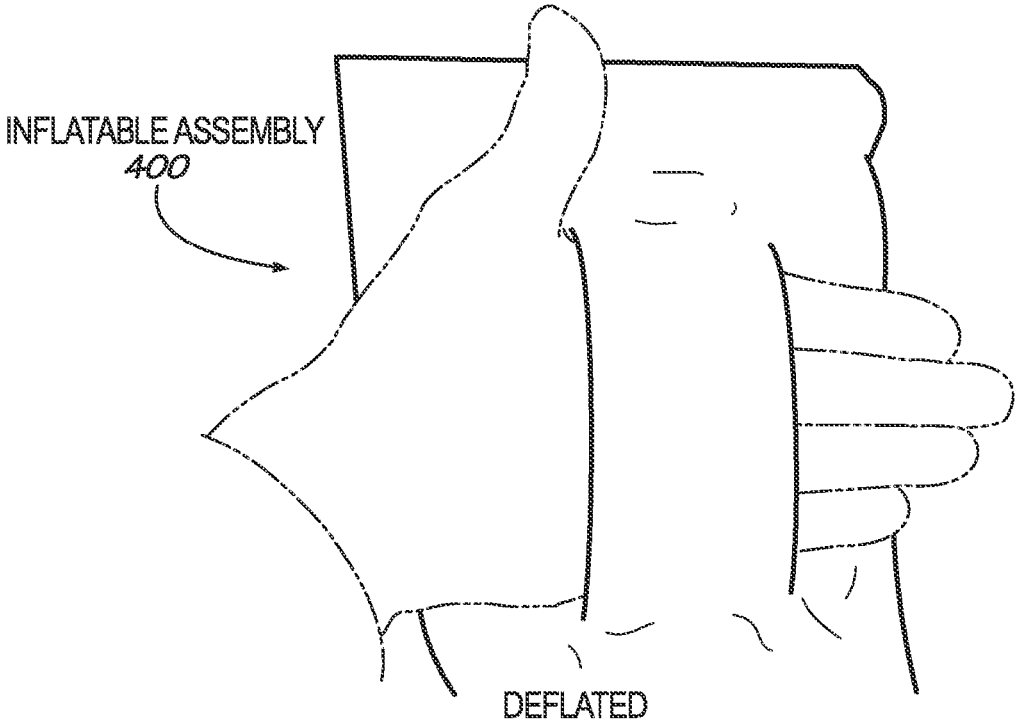
Figure 17B:
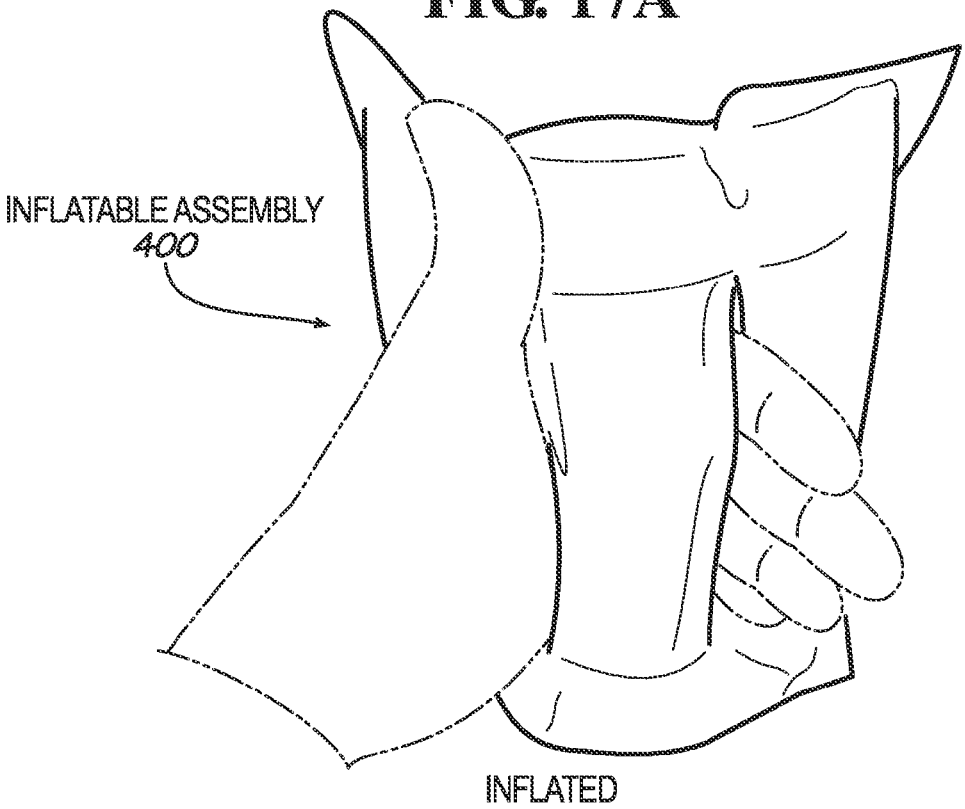
Figure 18A:
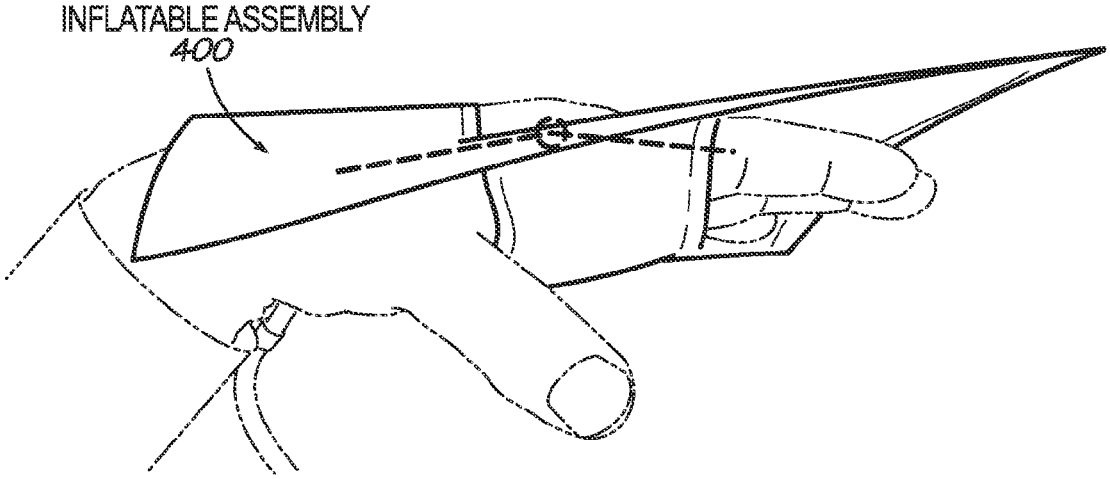
Figure 18B:
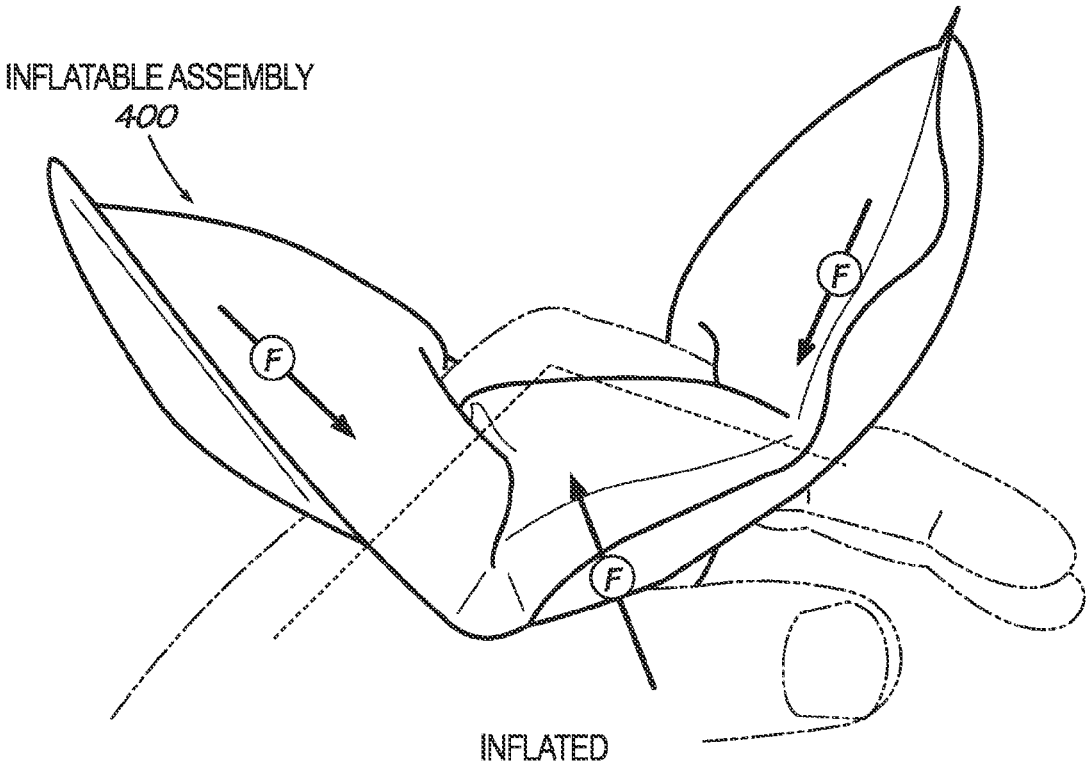
Figure 19A:
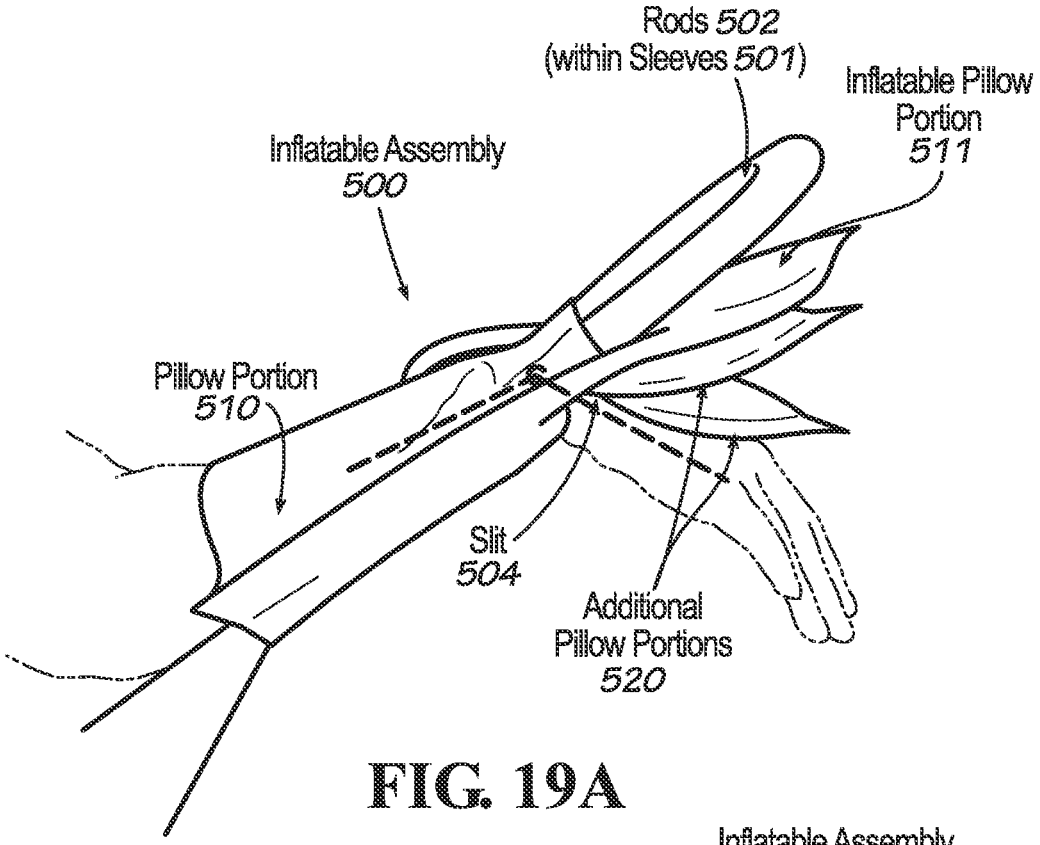
Figure 19B:
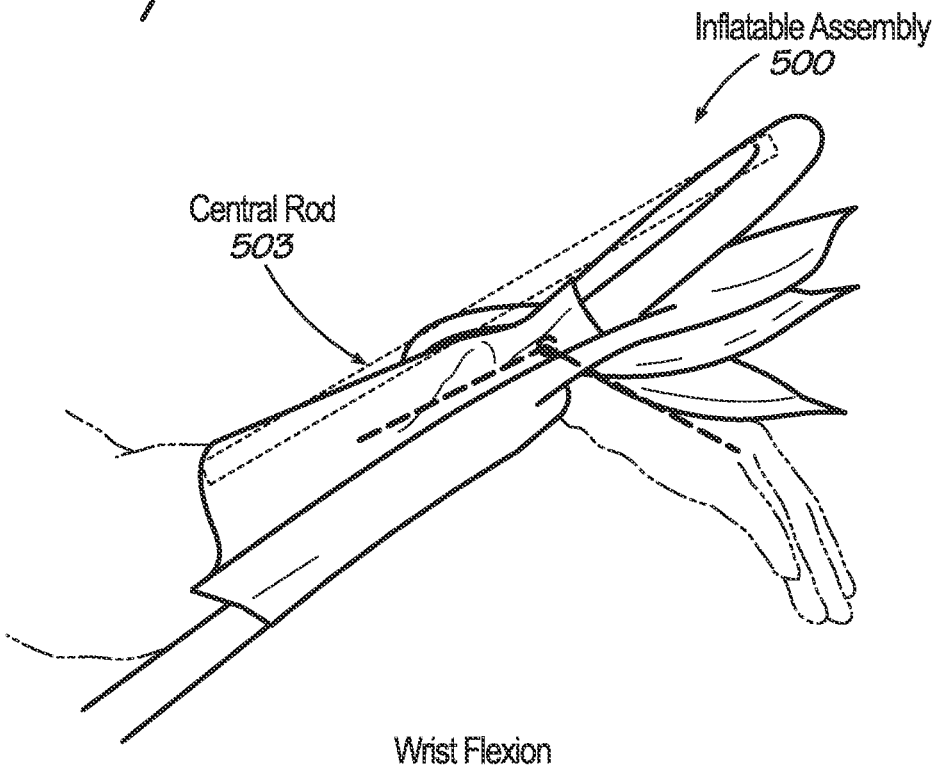
Figure 19C:
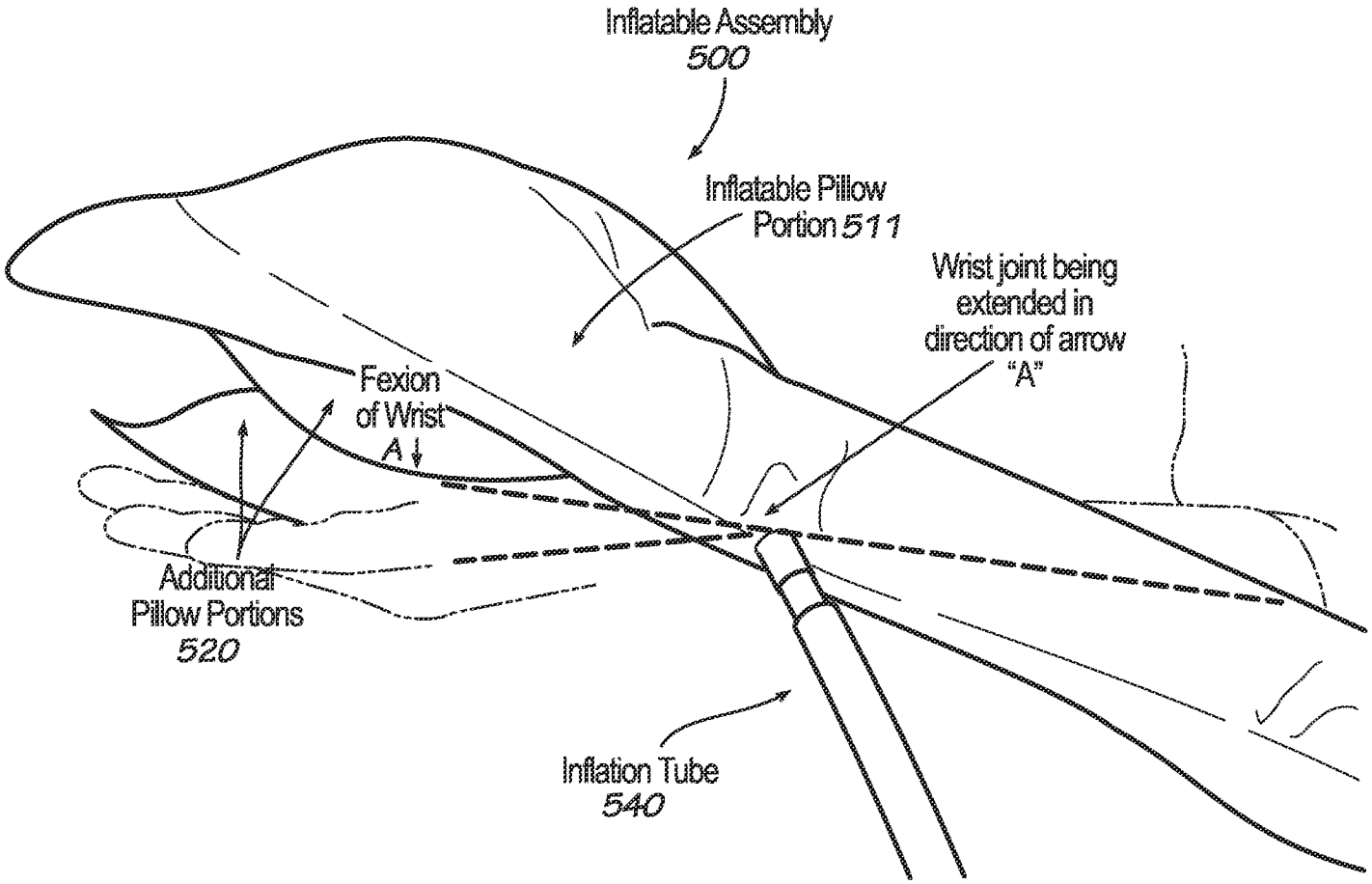
Figure 20:
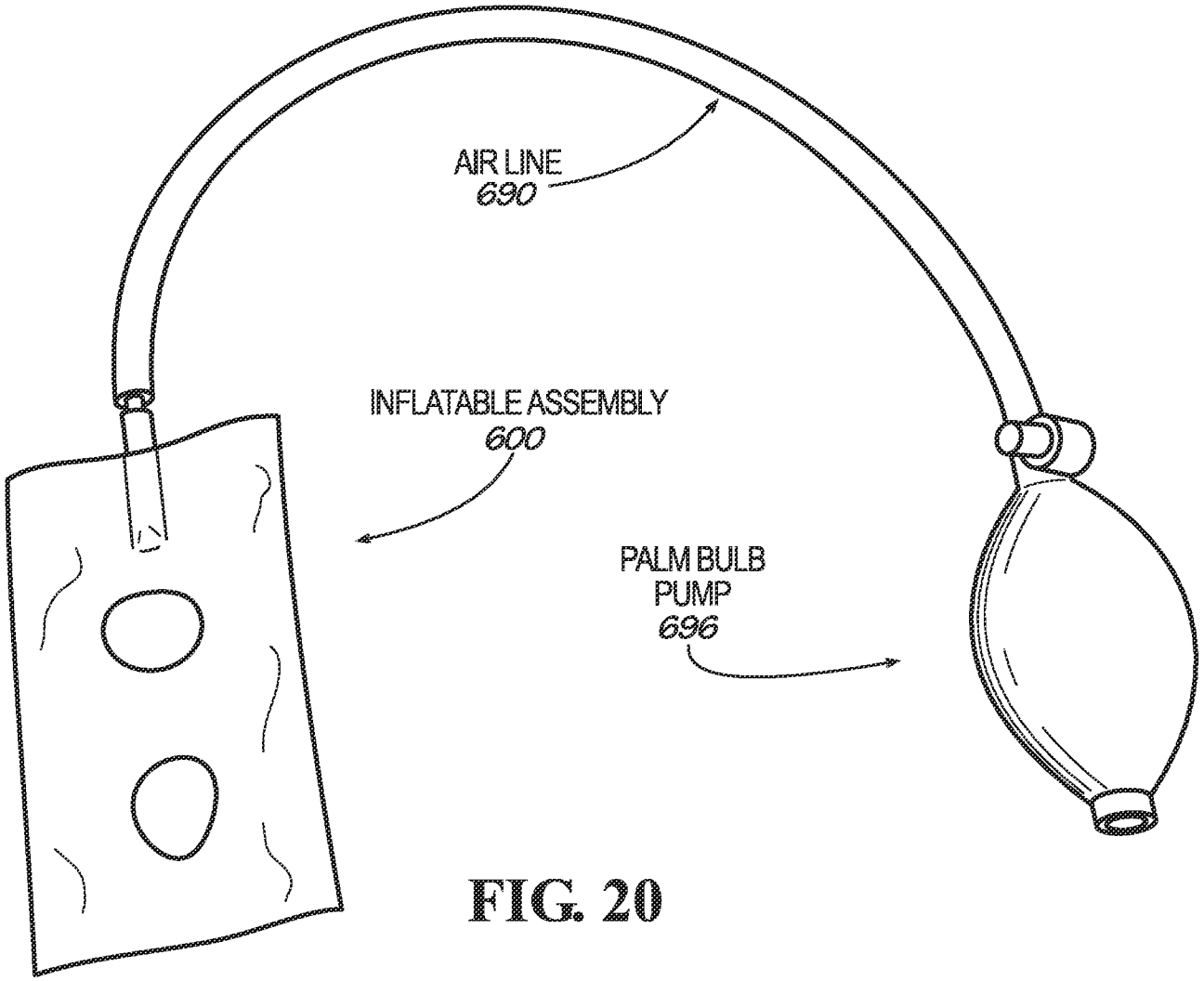
Figure 21A:
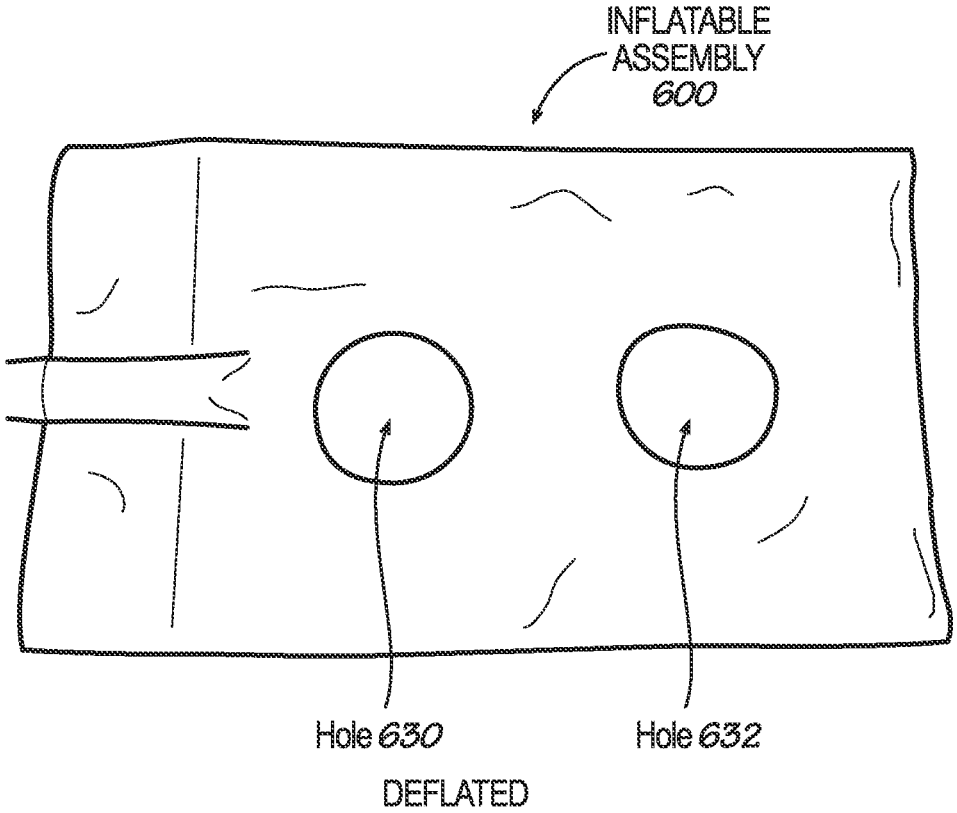
Figure 21B:
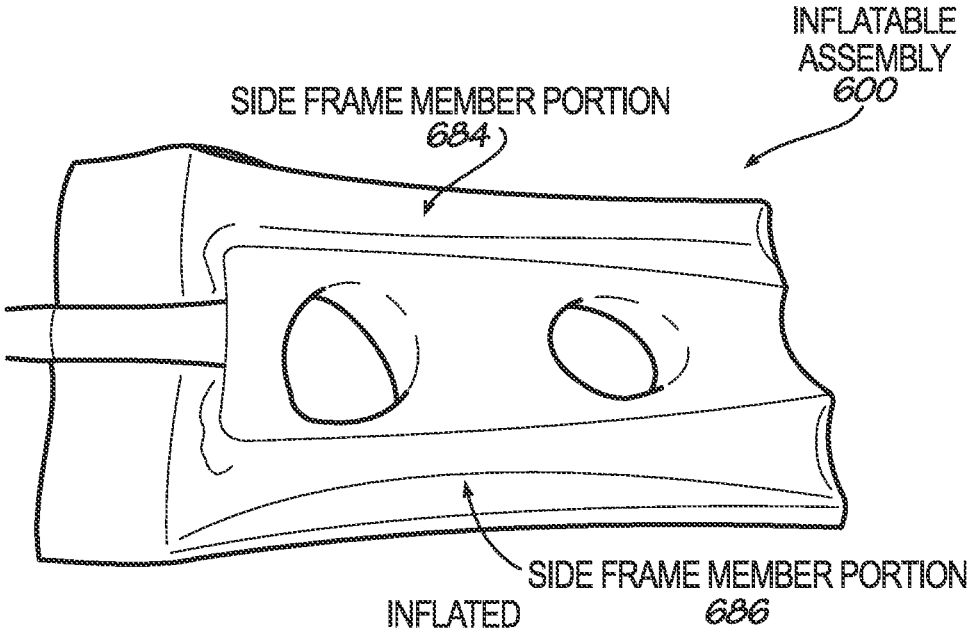
Figure 22:
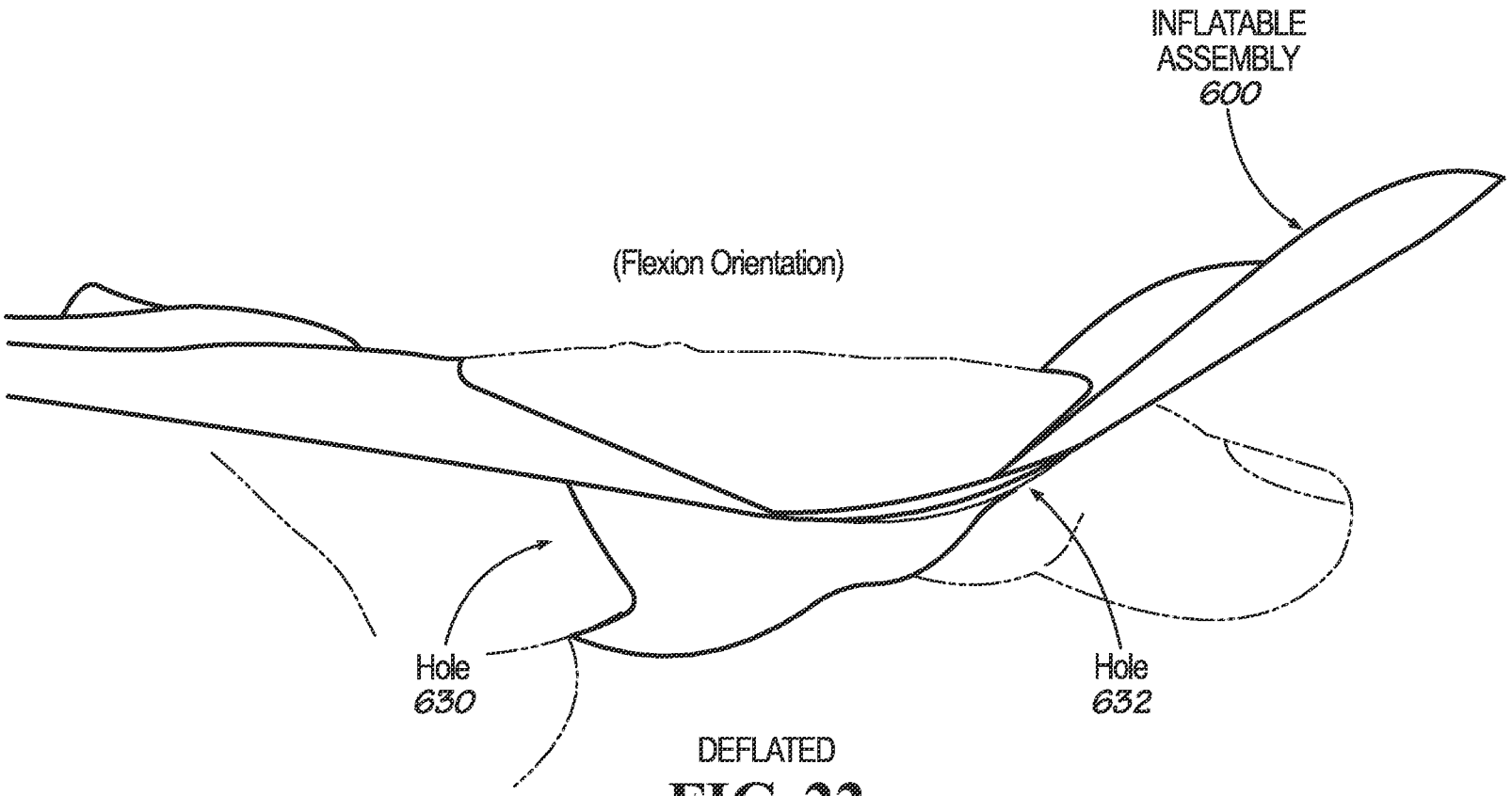
Figure 23A:
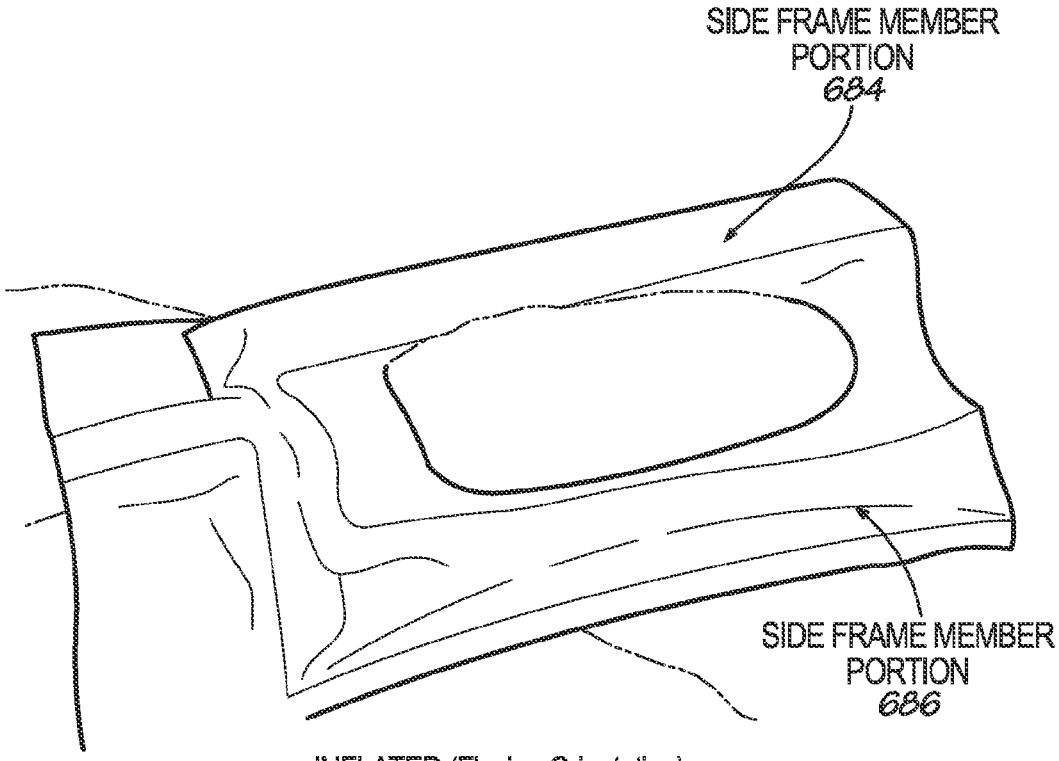
Figure 23B:
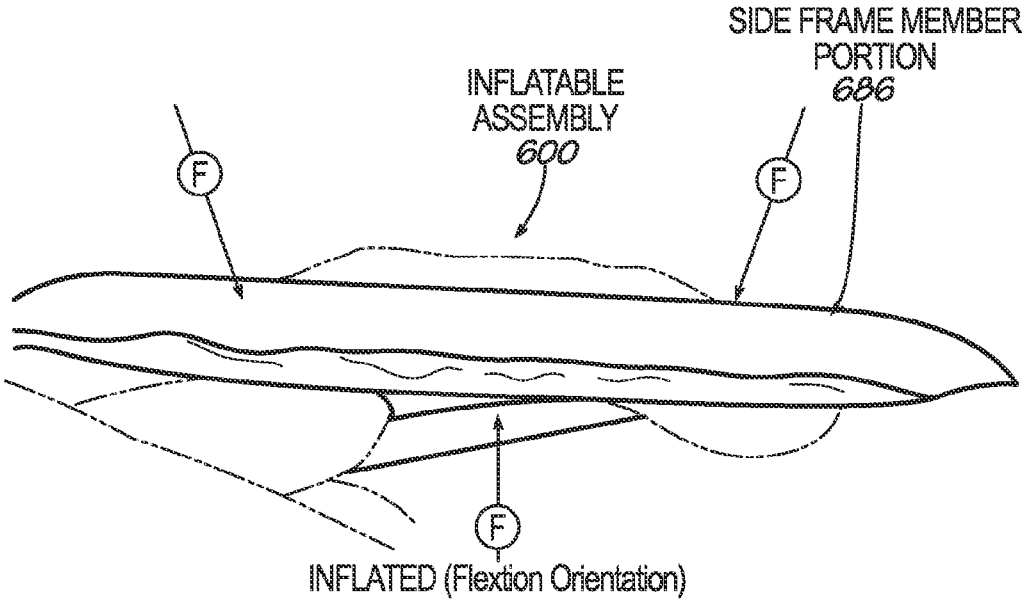
Figure 23C:
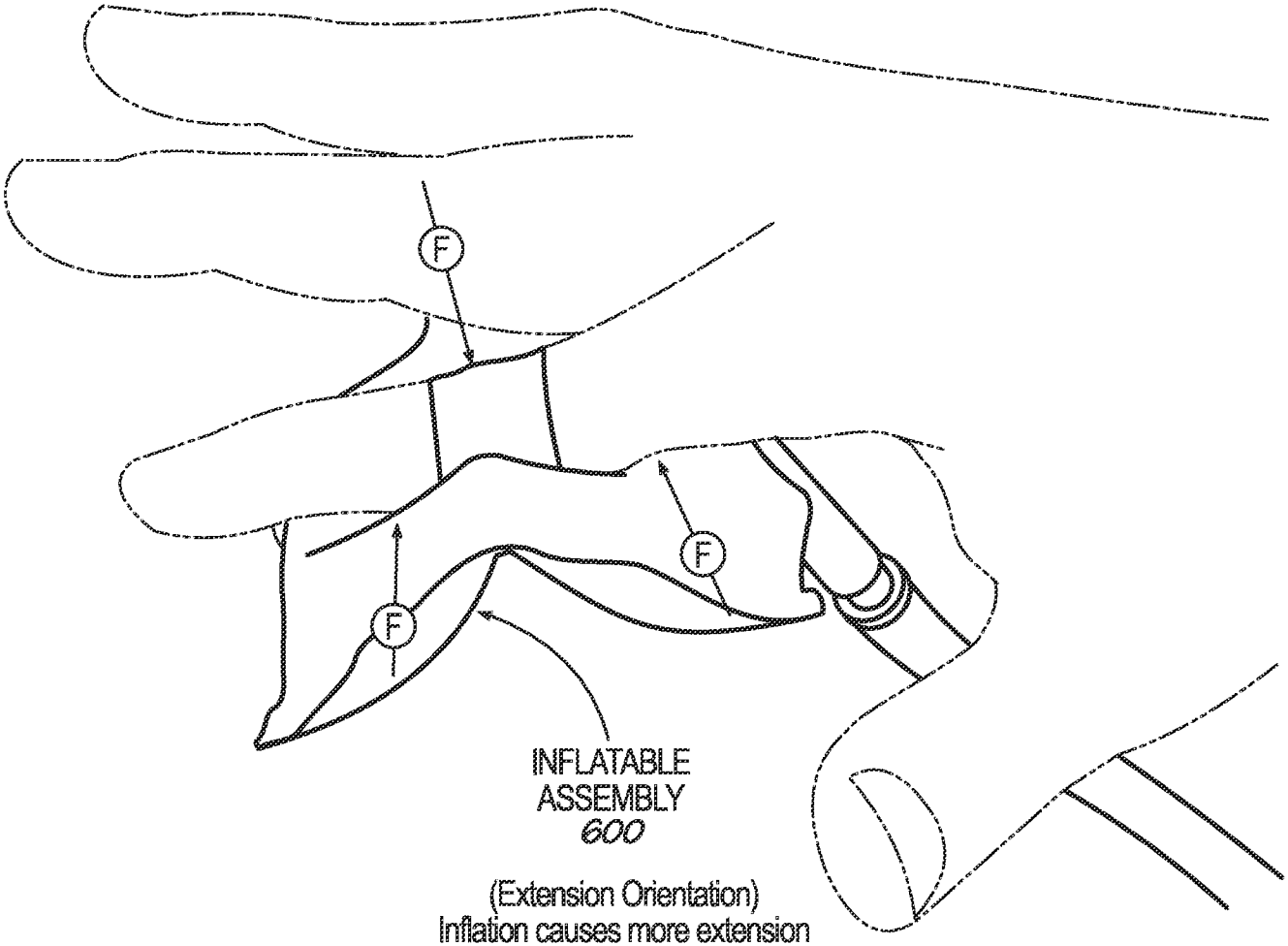
Figure 24:
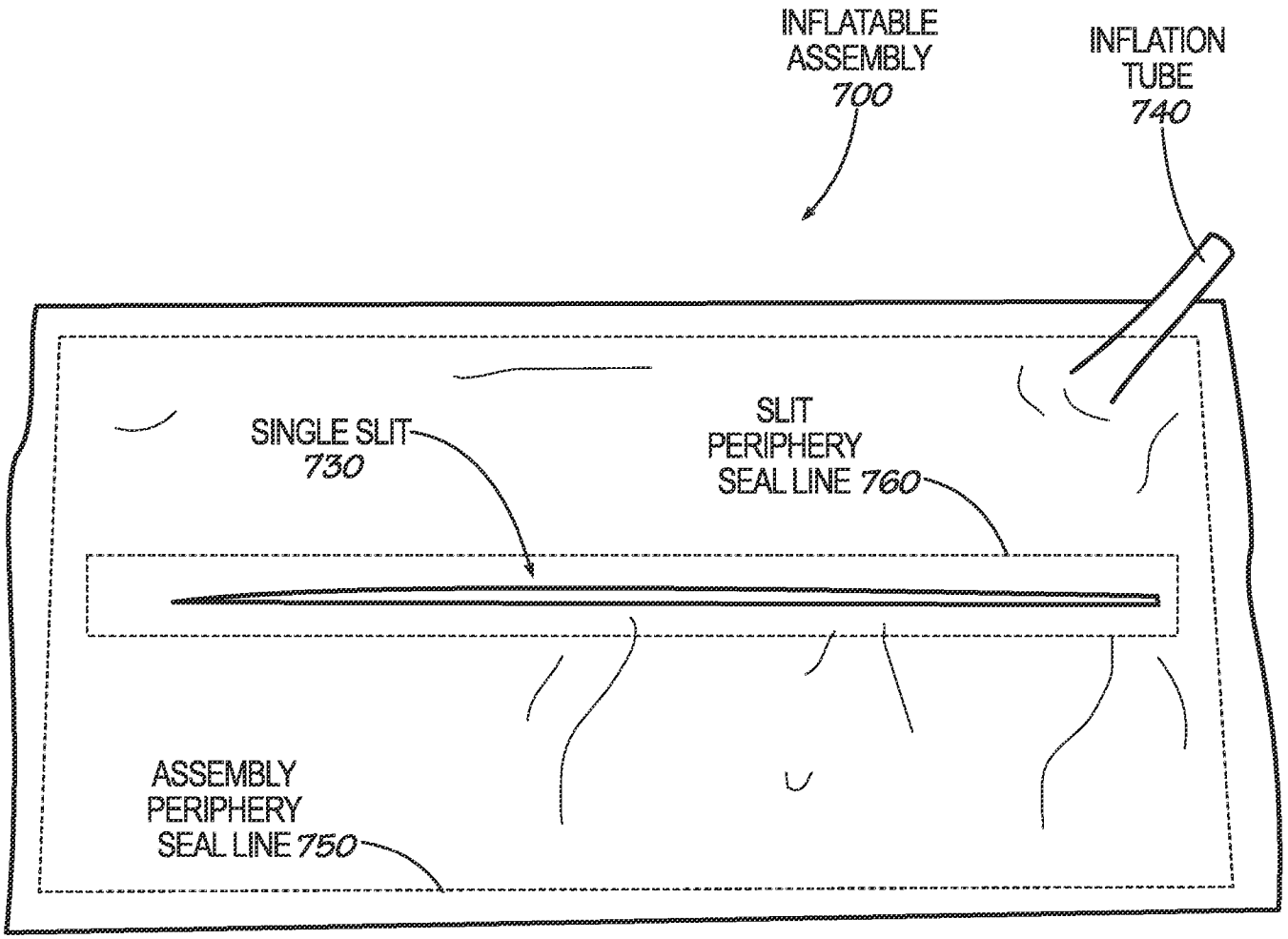
Figure 25:
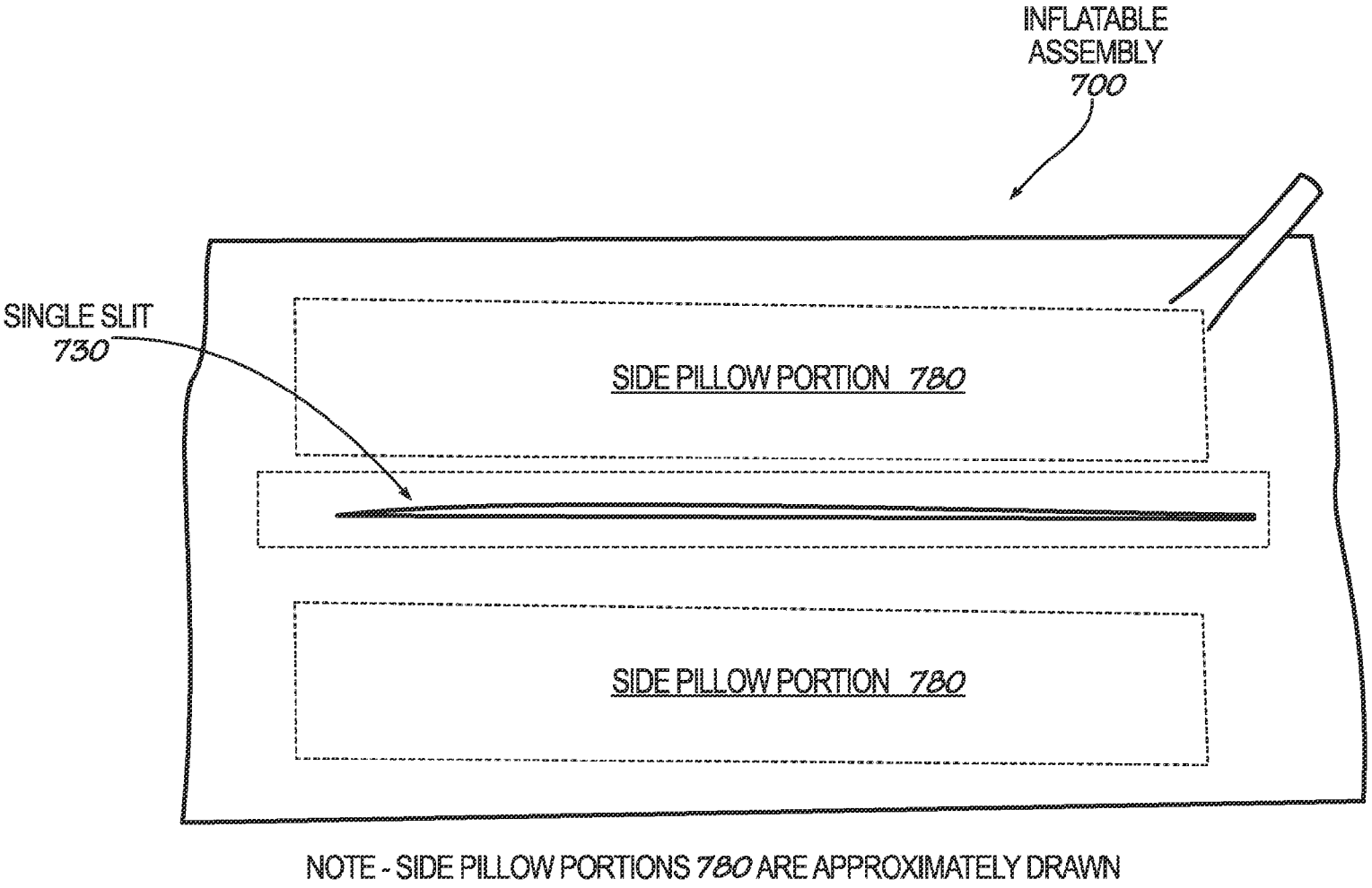
Figure 26:
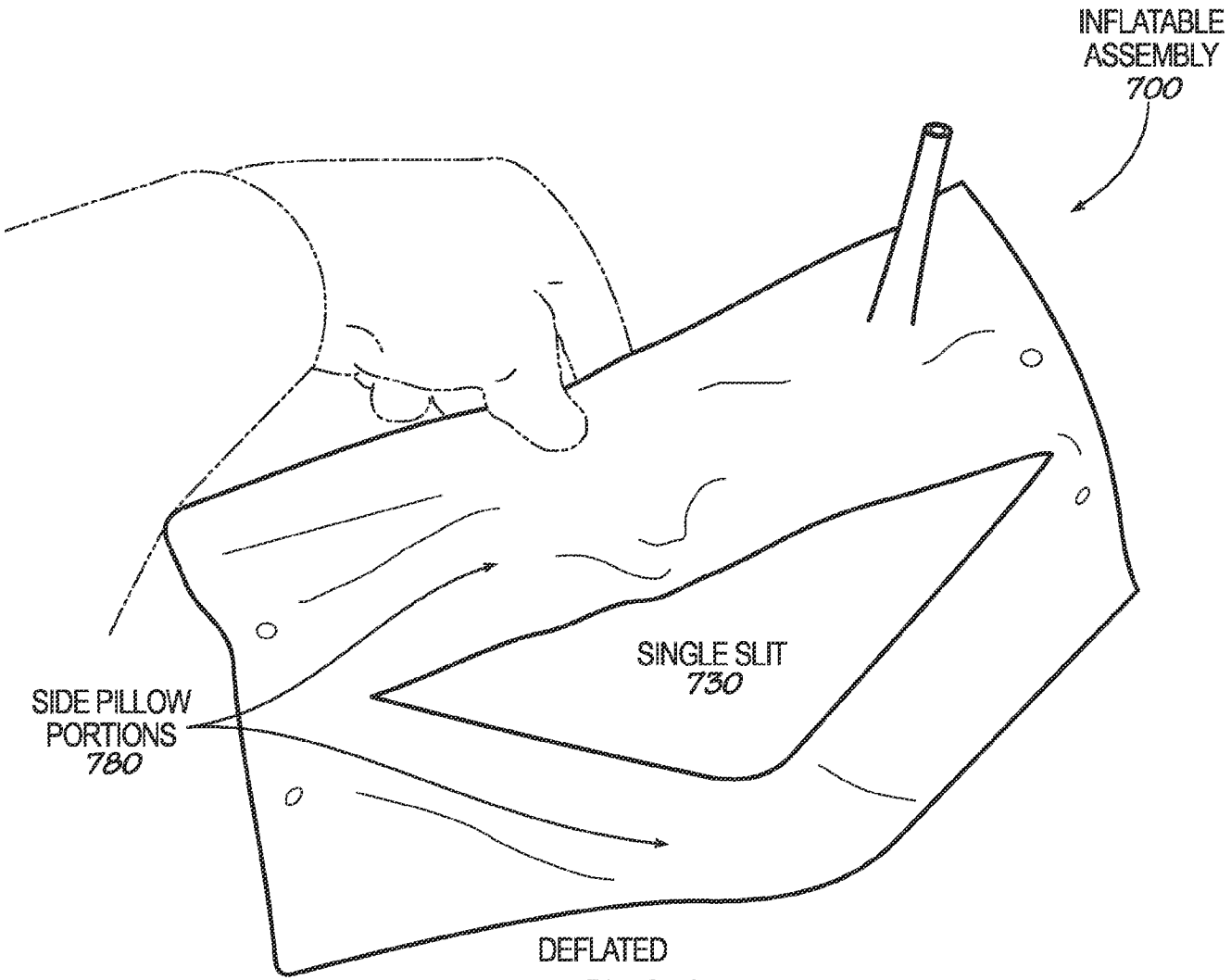
Figure 27:
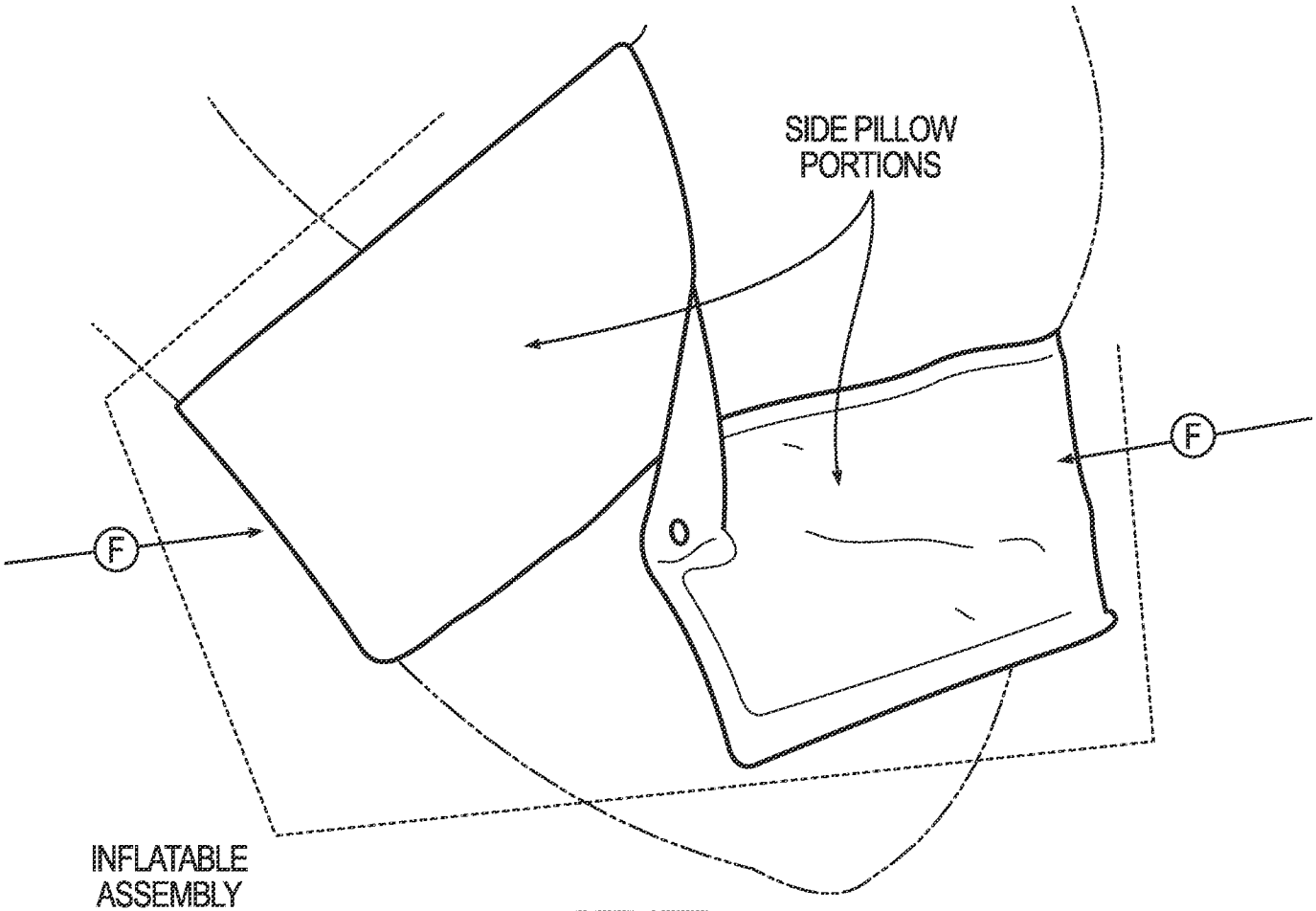
Figure 28A:
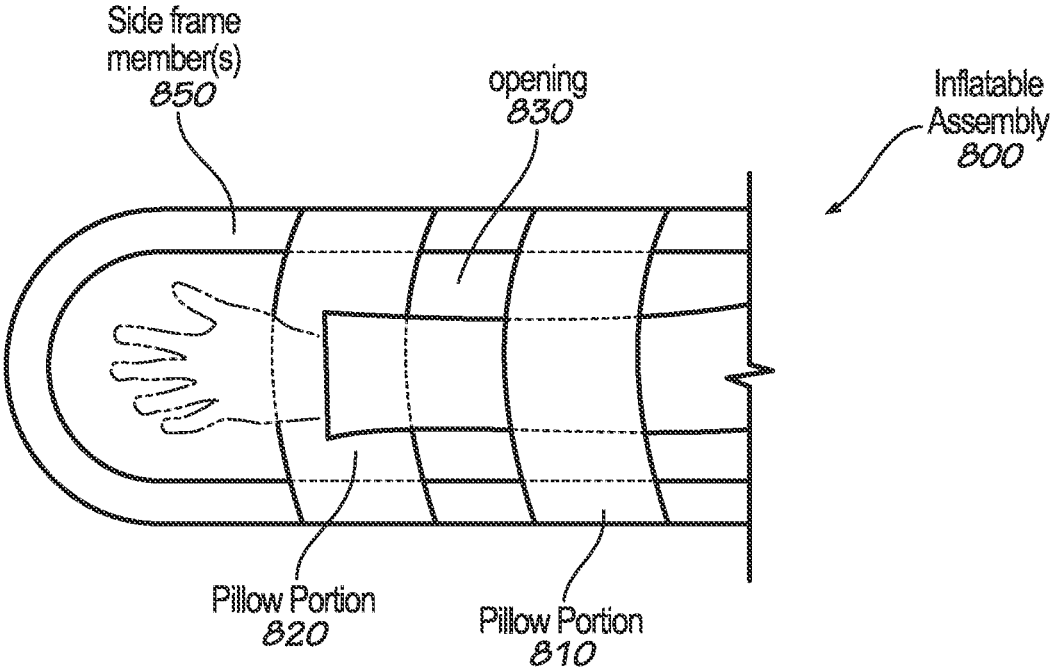
Figure 28B:
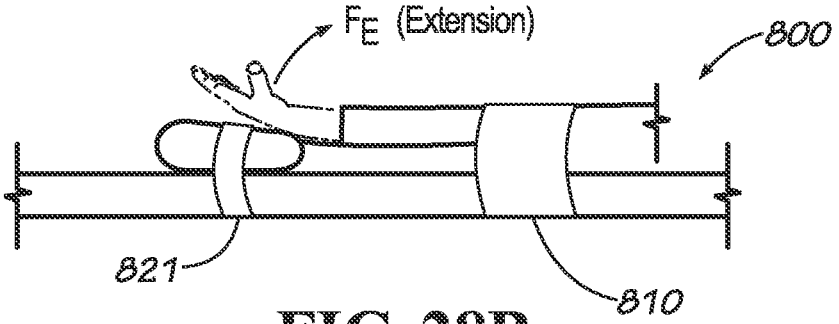
Figure 28C:
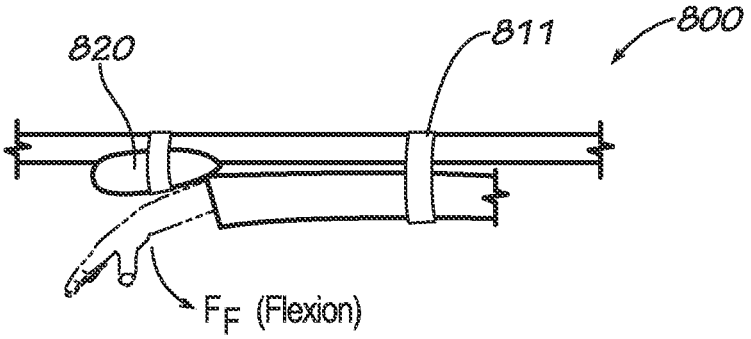
Figure 29A:
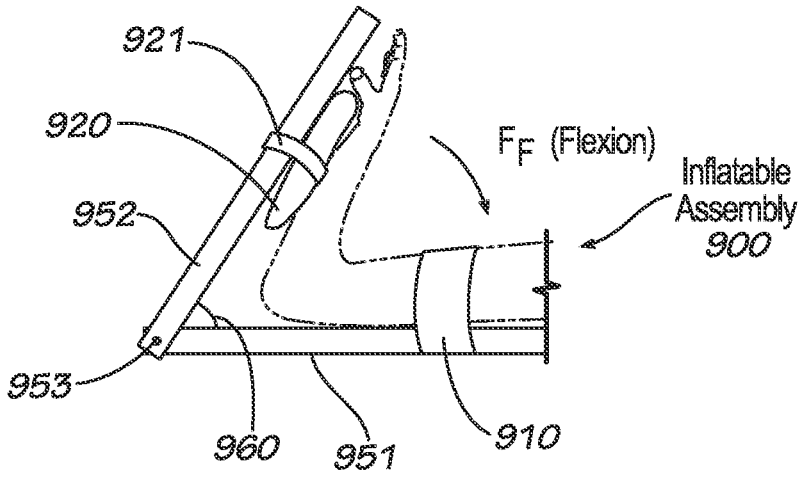
Figure 29B:
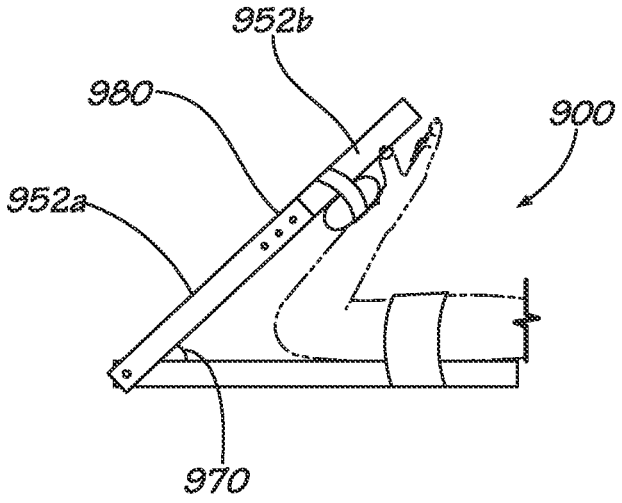
Figure 30:
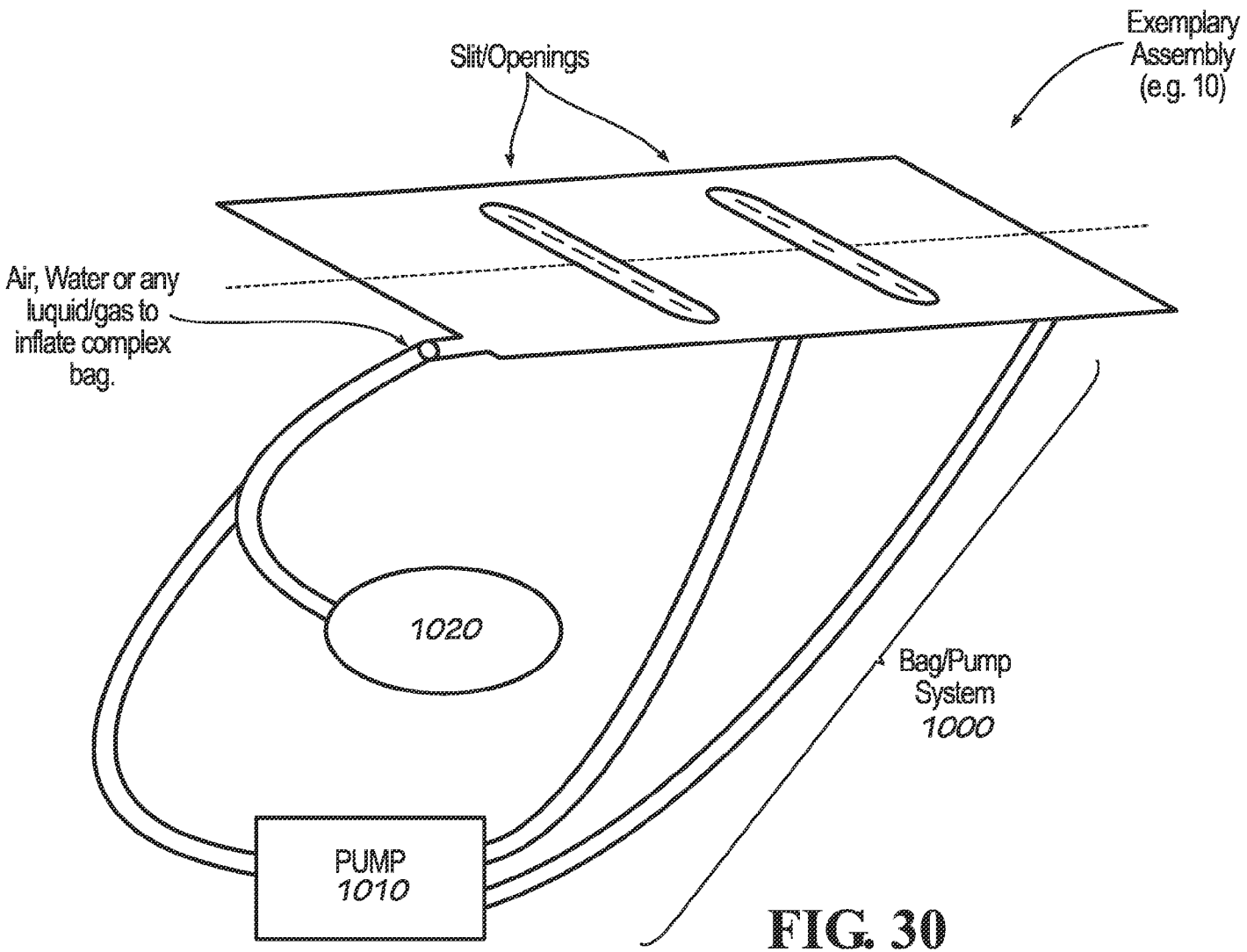
Figure 31A:
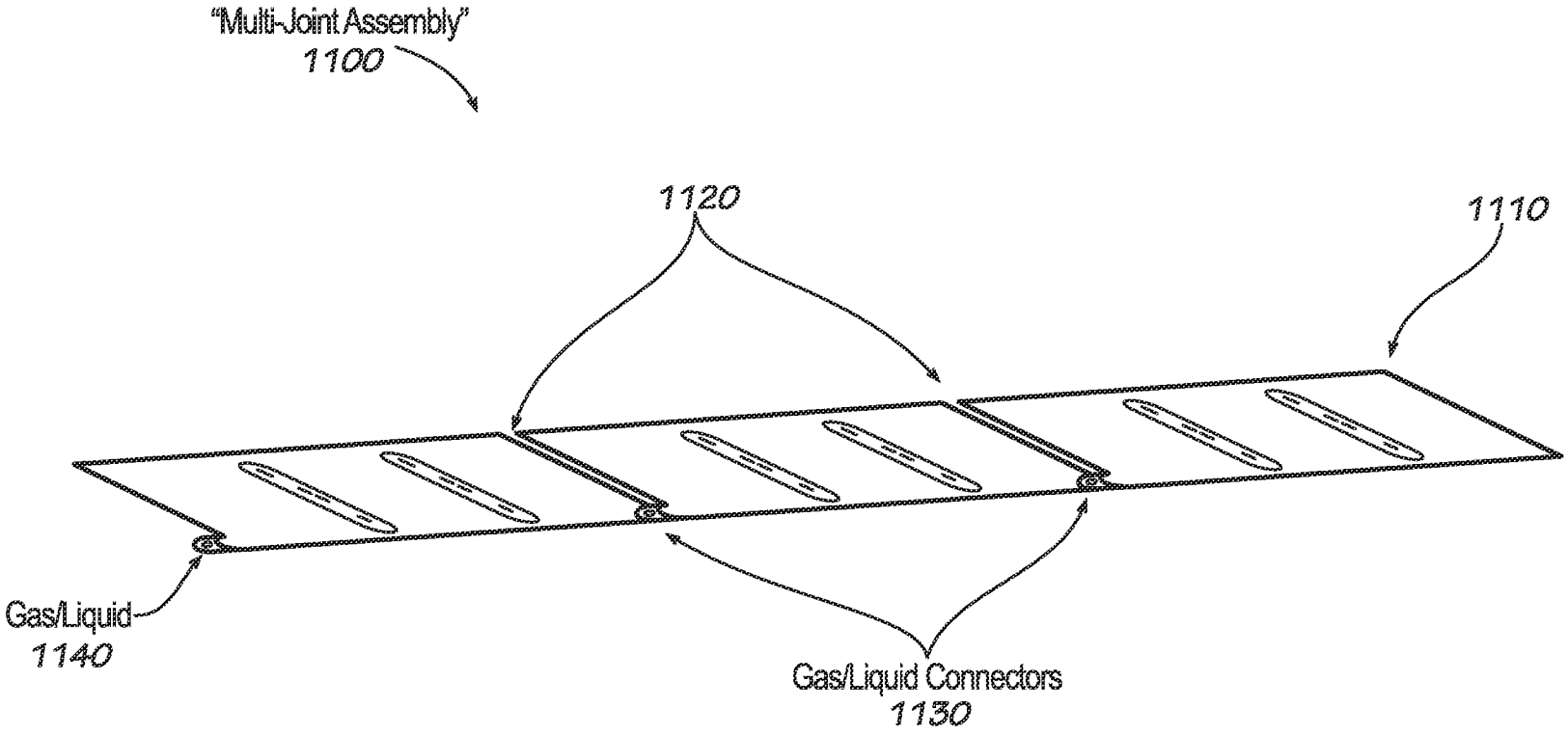
Figure 31B:
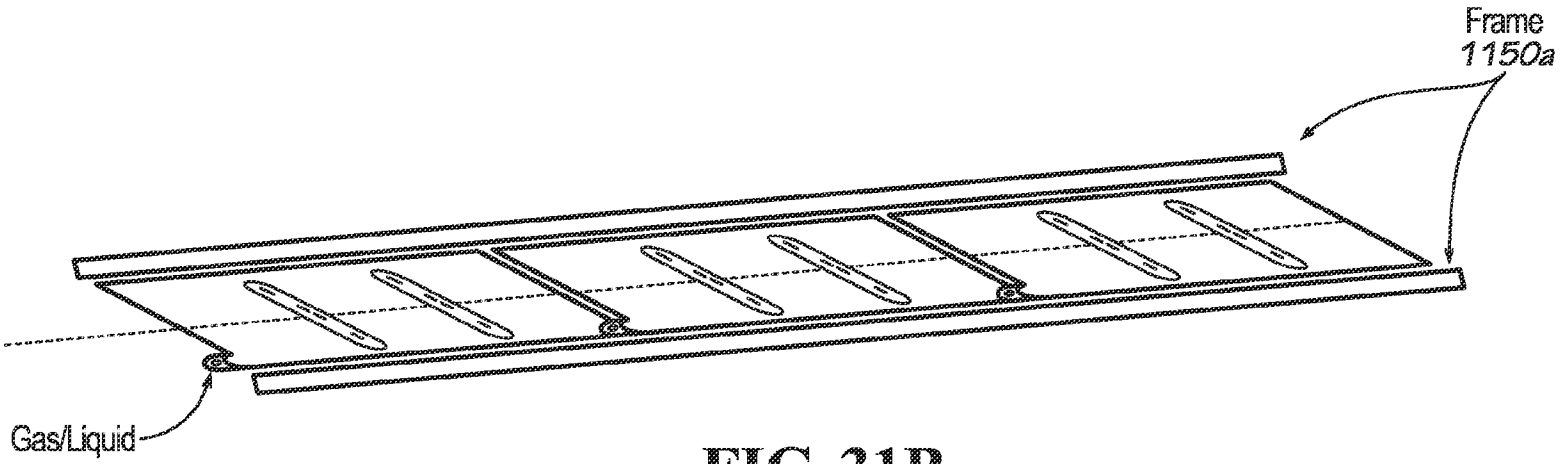
Figure 31C:
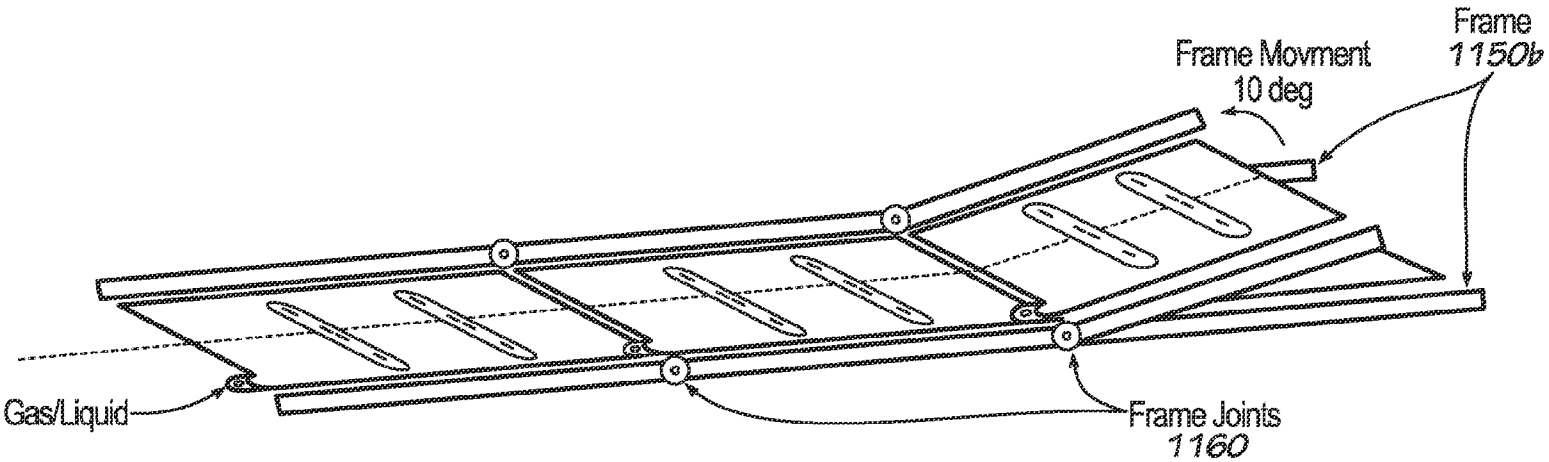
Figure 31D:
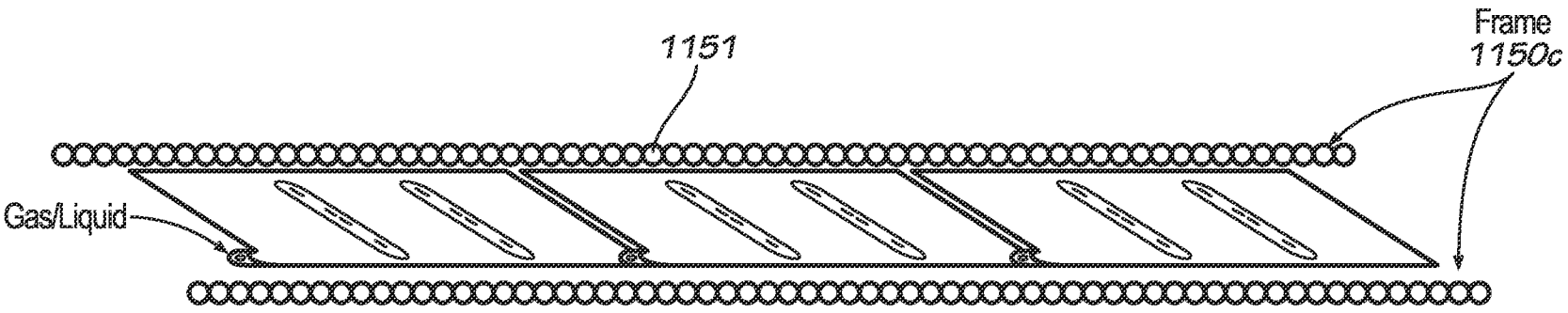
Figure 31E:
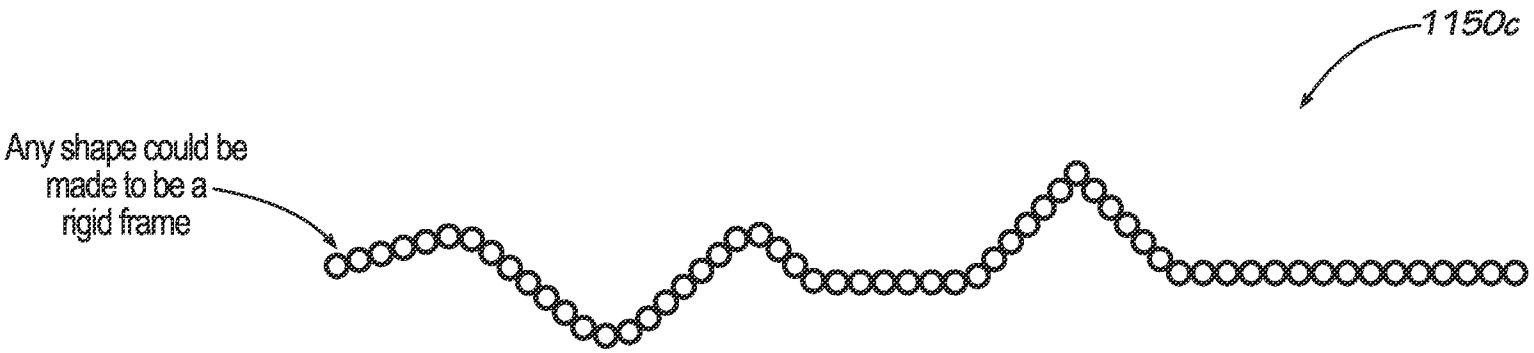
Figure 32A:
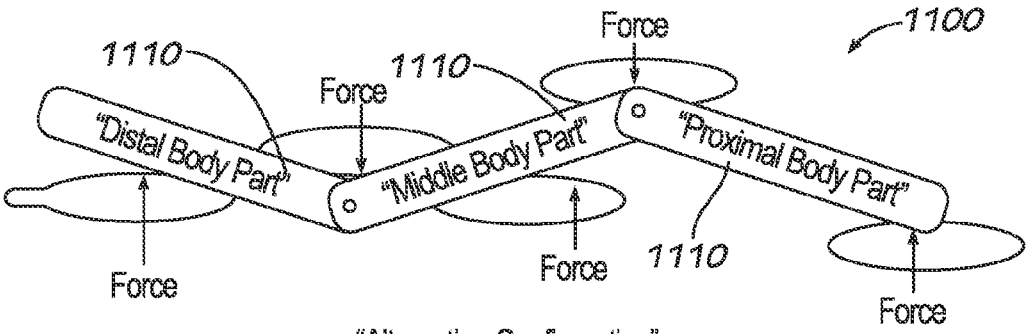
Figure 32B:
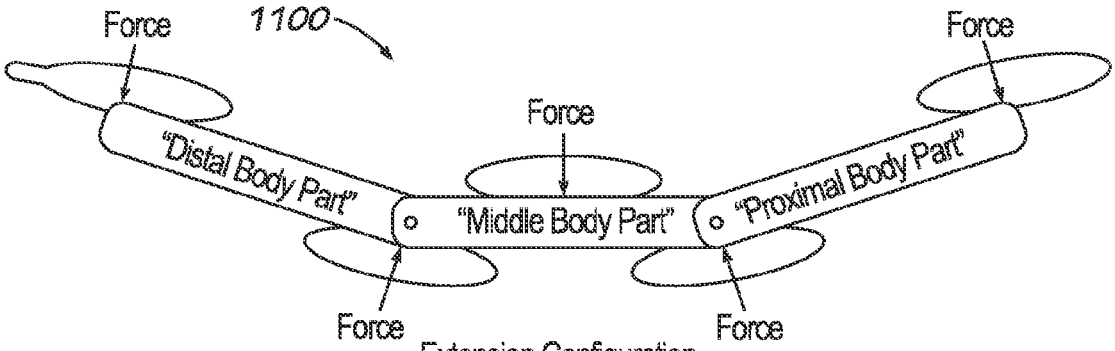
Figure 32C:
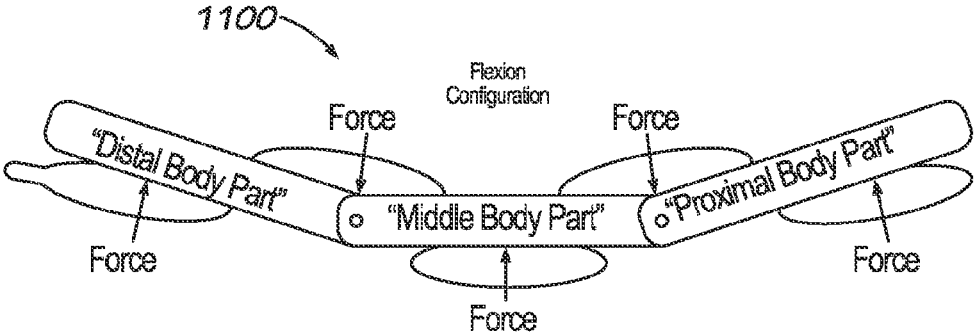
Figure 33:
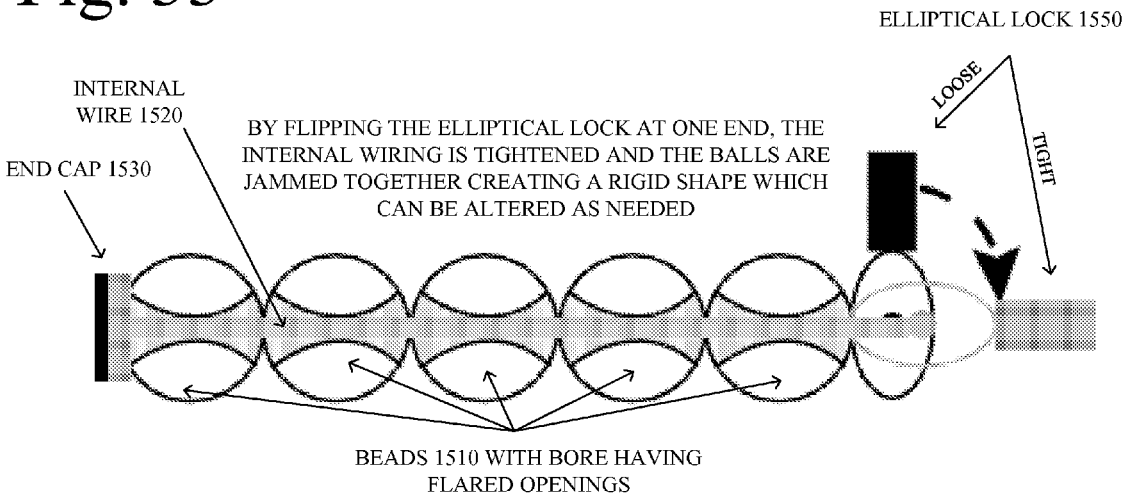
Figure 34:
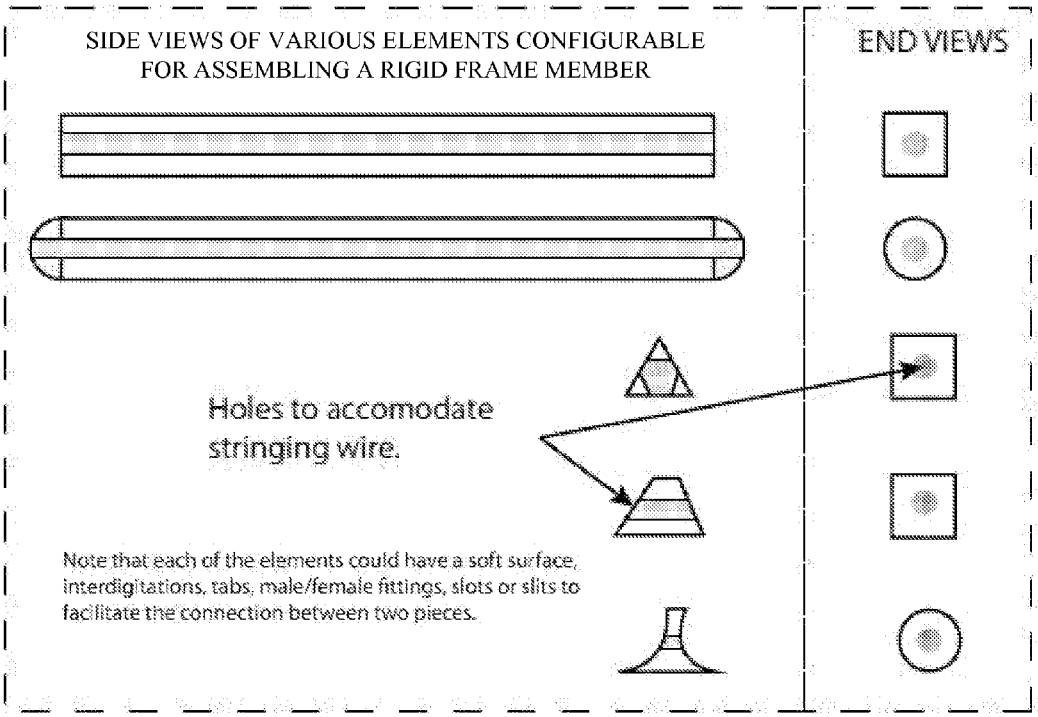

FIGS. 7A and 7B show the inflatable assembly 10 in a relatively less and more deflated condition, respectively;

FIGS. 8A and 8B are related pictorial views showing and exemplary bladder assembly 10;

FIGS. 9A and 9B are also related pictorial views showing an exemplary bladder assembly 10 oriented for providing flexion of a patient's joint, further showing the assembly more inflated in FIG. 9B than in FIG. 9A;

FIGS. 10A and 10B are also related pictorial views showing an exemplary bladder assembly 10 oriented for providing additional movement of a patient's joint;

FIG. 11 is a pictorial view of an exemplary inflatable assembly 100 in a completely deflated state, and is similar to FIG. 4, except that it identifies a single slit 130 configuration;

FIG. 12 is a top plan view of the inflatable assembly 100 in a completely deflated state, and is similar to FIG. 5, except that it identifies a single slit 130 configuration;

FIG. 13 is a top plan view of the inflatable assembly 100 in a completely deflated state similar to that shown in FIG. 12, and also illustrates various "pillow portions";

FIGS. 14A-14C show an exemplary inflatable assembly 200 having a pair of elongate parallel sleeves 201;

FIGS. 14D-E show the exemplary inflatable assembly 200 during use in respective flexion and extension orientations;

FIGS. 15A-15C show an exemplary inflatable assembly 300 having a rod 302 within a sleeve 301;

FIG. 16 shows an exemplary inflatable assembly 400 as it is configured to be inflated via use of an attached intake line 490 and palm pump 496;

FIGS. 17A and 17B are related pictorial views showing use of the exemplary inflatable assembly 400, further showing the assembly more inflated in FIG. 18B than in FIG. 18A;

FIGS. 18A and 18B are related pictorial views showing use of the exemplary inflatable assembly 400, further showing the assembly more inflated in FIG. 19B than in FIG. 19A;

FIGS. 19A-19B show an exemplary inflatable assembly 500 having various combinations of rods 502, 503;

FIG. 19C shows the exemplary inflatable assembly 500 during use for wrist extension, as compared to the wrist flexion configuration of FIGS. 19A-B;

FIG. 20 shows an exemplary inflatable assembly 600 as it is configured to be inflated via use of an attached intake line 690 and palm pump 696, in a manner similar to that described in conjunction with assembly 500;

FIGS. 21A and 21B are related sequential pictorial views showing an exemplary inflatable assembly 600, showing the assembly more inflated in FIG. 21B than in FIG. 21A;

FIG. 22 is a pictorial view showing an exemplary finger positioned within the inflatable assembly 600, having through holes 630, 632, which is accomplished by threading the finger through the two holes 630, 632, as shown;

FIGS. 23A and 23B are different pictorial views of an exemplary finger positioned within the inflatable assembly 600;

FIG. 23C is a pictorial view of an exemplary finger positioned within the inflatable in an alternate orientation compared to that of FIGS. 23A and 23B;

FIG. 24 is a pictorial view of an exemplary inflatable assembly 700;

FIG. 25 is another view similar to FIG. 24, except that two elongate side pillow portions 780 are shown, having substantially parallel longitudinal axes (not shown);

FIG. 26 shows the slit 730 somewhat open, such that an arm or other suitable limb or body part may be placed there-through for use;

FIG. 27 shows an arm introduced elbow-first into the slit 730, wherein upon inflation, the assembly 700 will cause flexion of the arm, essentially due to the filling of the two side pillow members 780 and their resulting stiffening, which tends to close the gap in the single slit 730;

FIGS. 28A-C show an exemplary inflatable assembly 800 having one or more frame members 850;

FIGS. 29A-B show an exemplary inflatable assembly 900 having one or more frame members 951, 952, adjustable for use at one or more relative angles 960, 970;

FIG. 30 shows an exemplary bag and pump system 1000;

FIGS. 31A-E show various configurations of an exemplary multi joint inflatable assembly 1100;

FIGS. 32A-C show various configurations for use of the exemplary multi joint inflatable assembly 1100 of FIGS. 31A-E;

FIG. 33 is an illustrative view of exemplary elliptical lock mechanism including balls or beads 1510 that are linked together by an internal wire 1520 passing through holes in all the beads, the wire having an end cap 1530 on one end and an elliptical lock 1550 (or other suitable lock) on the other end;

FIG. 34 shows various non-globally shaped elements, configurable for assembling a rigid frame member, including side and end views of various rigid frame members according to various embodiments, as configured with internal holes to accommodate at least one stringing wire therein; and FIG. 35 shows an assembled structural element 1600 shows an exemplary assembly illustrated an embodiment formed from a plurality of the various rigid frame members of FIG. 34, namely two elongate members, an angular member intermediate same, and a stringing wire and associated fittings therefor.

DETAILED DESCRIPTION OF VARIOUS EMBODIMENTS

I. General Overview

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Generally described, various embodiments of the present invention provide a relatively simplistic and unstructured (e.g. frameless) device configured to comprise one or more inflatable portions capable of providing controlled repetitive movement (e.g., flexion, extension, abduction, adduction, internal rotation, external rotation, and the like) to a joint of a human or other jointed animal. In this manner, various limbs and/or joints may be manipulated, as desired, by imposing thereupon one or more forces. In one aspect of various embodiments, joint movement is assisted by at least one or more "pillow portions" (e.g., inflatable members) positioned adjacent the joint, which during operation (e.g., inflation and/or deflation) open the joint. Such inflation and/or deflation operation may be performed via any of a variety of commonly known and understood pump and line assemblies for pressurizing air or another suitable fluid (e.g., water, gas, etc.). In another aspect of various embodiments, joint movement is further assisted by the use of one or more "side frame member portions," which when inflated impose forces upon the joint so as to cause relative movement thereupon. In this manner, various limbs and/or joints may be manipulated, as desired, by imposing thereupon one or more forces. In still another aspect of various embodiments, certain combinations of both the pillow portions (e.g., inflatable members) and the side frame member portions encourage joint movement. In this manner, various limbs and/or joints may be manipulated, as desired, by imposing thereupon one or more forces. In yet another aspect of various embodiments, a single-slot configuration is used with two pillow portions (versus three) in order to manipulate a wrist, elbow, or other similar joint Still further, various embodiments of the present invention provide one or more frame portions to the variously configured unstructured (e.g., frameless) embodiments described above. In one aspect of various embodiments, a pair of elongate parallel sleeves may be positioned substantially adjacent the side frame member portions and configured to receive an associated pair of rods. In certain embodiments, the pair of elongate parallel sleeves may be configured to receive an associated single rod, which may be, for example, substantially U-shaped. In another aspect of various embodiments, a transverse sleeve may be positioned substantially perpendicular to the pair of elongate parallel sleeves and configured to receive an associated transverse rod. Various combinations of these rods and sleeves provide a structural framework that not only support one or more limbs adjacent the target joint, but also provide leverage against the one or more pillow portions, so as to impose even greater forces upon the joint than possible without such structural elements. In yet another aspect of various embodiments having any combination of the above-described structural elements, one or more additional pillow portions may be provided, so as to impose still further greater forces upon the joint, where such may be desirable. Of course, it should be understood that any of the various combinations of unstructured (e.g., frameless) embodiments described herein may also be adapted to include any of a variety of combinations of the associated structural elements likewise described herein.

II. Exemplary Embodiments

Inflatable Assembly 10

Turning now to FIG. 1, an exemplary inflatable bladder assembly 10 according to various embodiments is illustrated, as used in conjunction with an intake line 90 and a palm bulb pump 96. In certain embodiments, as will be further described elsewhere herein, a manual pumping action on the pump will cause air (or other appropriate fluid—e.g., water, gas, or the like) to pressurize within the line 90 as well as within one or more interior cavities (e.g., pillow portions and/or inflatable members, as described further below). Such pressurization of the line, in turn, causes the inflatable assembly to inflate from a lesser filled (e.g., "deflated") state to a greater filled (e.g., "inflated") state.

As will be described in further detail below, inflation of the assembly 10 from the deflated to the inflated state, according to various embodiments, causes joint movement. In certain embodiments, such joint movement may comprise flexion and/or extension, while in other embodiments the movement may involve one or more of abduction, adduction, internal rotation, external rotation, and the like. In essence, any of a variety of possible movements of the joint may be influenced by inflation of the assembly 10 according to any of the various embodiments described herein. Of course, a selectively operable release valve, as known in the art and not particularly shown, is associated with various embodiments of the bulb pump 96, thereby permitting release of pressure upon operation of the valve, much like a blood pressure device. In this manner, various embodiments of the assembly 10 are configured to provide controlled, repetitive movement (e.g., flexion, extension, flexion, extension, etc.) of the targeted joint. Still further, it should be understood that various limbs and/or joints may be manipulated, as desired, by imposing thereupon one or more forces.

It should be understood, of course, that the general concept of inflating and/or deflating one or more cavities with air or a comparable fluid, whether manually via a palm bulb pump or otherwise, is generally commonly known and understood in the art and described herein only for purposes of a completeness of disclosure with respect to the assembly 10. Still further, although the description of the intake line 90 and associated palm bulb pump 96 have been described herein with primary reference to inflatable assembly 10, such may be likewise be substituted for use with any of the various embodiments described elsewhere herein, as will be referenced periodically throughout, as appropriate.

Turning now to FIGS. 2 and 3, the inflatable assembly 10 according to various embodiments is illustrated in its deflated state. The inflatable assembly 10 generally comprises an upper ply 20U, a lower ply 20L, an inflation tube 40, and a pair of slits 30, 32. In certain embodiments, as may be understood best from FIG. 3, the upper and lower plies 20U, 20L are similar in configuration and bonded together at an assembly periphery seal line 50 and slit periphery seal lines 60, 62 such that an interior cavity is defined intermediate the respective external surfaces of the upper and lower plies 20U, 20L. It should be understood, of course, that in other embodiments, only a portion of the inflatable assembly 10 may comprise both upper and lower plies 20U, 20L, such that at least a portion of the assembly forms a non-inflatable portion, as will be described in further detail below. That being said, in still other embodiments, substantially the entirety of the inflatable assembly 10 may comprise both upper and lower plies 20U, 20L, but additional seal lines (not shown) may be provided so as to make at least a portion of the assembly 10 non-inflatable.

Returning to FIG. 2, the inflation tube 40 according to various embodiments is positioned at least partially intermediate the upper ply 20U and the lower ply 20L of the inflatable assembly 10. In certain embodiments, the inflation tube 40 is substantially circular in shape and configured to selectively mate with an intake line 90 of the assembly, as previously described herein. Of course, in other embodiments, the inflation tube 40 may be sized, shaped, and configured any of a variety of ways, provided such facilitates selective mating with the intake line 90, such that pressurization of air (or comparable fluid—e.g., water, gas, or the like) within the line translates into pressurization of the at least one interior cavity defined intermediate the respective external surfaces of the upper and lower plies 20U, 20L. It should be understood that in these and still other embodiments, the upper and lower plies 20U, 20L must be substantially sealed adjacent the inflation tube 40 and in at least the illustration of FIG. 3, such may be accomplished via the assembly periphery seal line 50, as previously described herein.

Returning again to FIG. 2, the pair of slits 30, 32 of various embodiments of the inflatable assembly 10 may be substantially elongate in shape and configured in size to receive any of a variety of limbs located adjacent respectively targeted joints. In at least the illustrated embodiment, the target joint is that of a patient's finger, wherein the slits 30, 32 are thus sized and shaped to receive at least a portion of the finger, as will be described in further detail later, with reference to, for example, FIGS. 8A-10B. In other embodiments, the slits 30, 32 may be sized and shaped to receive at least a portion of a user's hand, so as to facilitate movement and/or manipulation of a wrist joint, as will likewise be described in further detail later. In any event, it should be understood that for any of these and still other embodiments the slits 30, 32 are typically configured to define an opening passing through the entirety of the inflatable assembly 10 (e.g., through both the upper ply 20U and the lower ply 20L, where applicable) such that a portion of the patient's limb associated with a targeted joint may pass substantially there-through. Once so positioned, repetitive treatment via selective inflation and deflation of the assembly 10 may commence, also as will be described in further detail below. Of course, as with the inflatable assembly 10 in its entirety, the slits 30, 32 must according to various embodiments contain slit periphery seal lines 60, 62, so as to further define the various "pillow" and "frame" portions, as will be described further below.

Turning now to FIGS. 4-6, the inflatable assembly 10 according to various embodiments is further illustrated, but with a variety of axes 12, 14, 16, 18, 19; "pillow" portions 80, 81, 82; and "frame" portions 84, 86 identified thereon. Such axes are defined in order to assist in the description and understanding of inventive concepts associated with various embodiments herein. However, it should be noted that the illustrated boundaries of portions 80, 81, 82, 84, and 86 are approximate only; in reality these portions combine to comprise substantially the entirety of the assembly 10 (except for the inflation tube, as shown in FIG. 4).

Further, it should be understood that although all portions 80, 81, 82, 84, and 86 are generally similar in construction (e.g., inflatable to semi-rigid "pillows"), the use of the nomenclature "pillow" versus "frame" is more for purposes of description than construction of the respective portions. For example, in certain embodiments, the "pillow" portions are configured to, when selectively inflated, provide a force upon a targeted joint, while the "frame" portions are configured to simply provide a certain degree of stability to the assembly 10, without making physical contact with the affected joint. In this manner, the "frame" portions, although nothing more than inflatable cavities, function as a sort of structural framework for the assembly, without the need for a separate framework, as is understood in its traditional context. Of course, in still other embodiments, it should be understood that one or more of the "pillow" portions may be non-inflatable, as may be desirable for particular applications.

With continued reference to FIGS. 4-6, according to various embodiments, the respective "pillow" portions 80, 81, and 82 each have a corresponding longitudinal axis 12, 14, and 16, respectively. As illustrated in these figures, the axes 12, 14, 16 (and thus the portions 80, 81, and 82) are substantially parallel and spaced a distance apart relative to one another. In certain embodiments, the axis 14 and associated portion 81 is positioned substantially intermediate the elongate slits 30, 32, as previously described herein. In at least the illustrated embodiment, the axis 14 and associated portion 81 is further substantially parallel to an axis (not numbered) of the elongate slits 30, 32. In these and still other embodiments, the axis 12 and associated portion 80 is thus positioned on an opposing side of the elongate slit 30, while the axis 16 and associated portion 82 is likewise positioned on an opposing side of the elongate slit 32, all as relative to the portion 81. In this manner, it should be understood that the portions 80, 81, 82 and slits 30, 32 are positioned relative to one another according to various embodiments so as to establish a set of sequentially parallel axes.

In various embodiments, the portion 80 may be positioned adjacent a distal portion of a patient's limb, while the portion 82 may be positioned adjacent a proximal portion of the limb, in which case such portions may be referred to interchangeably as respective distal and proximal portions, as commonly known and understood in the art. Of course, as will all be described in further detail later, such portions may be alternatively positioned, as may be desirable for imposing any of a variety of movements upon a targeted joint and/or associated limb portions. However, it should be understood that in any of these and still other embodiments, at least one portion may be considered distally positioned, with another portion considered proximally positioned, relative thereto.

Returning to FIGS. 4-6, according to various embodiments, the respective "frame" portions 84, 86 each have a corresponding longitudinal axis 18, 19, respectively. As illustrated in these figures, the axes 18, 19 (and thus the portions 84, 86) are substantially parallel and spaced apart relative to one another. In certain embodiments, the axes 18, 19 are spaced apart a distance substantially that of a length of the "pillow" portions 80, 81, and 82, as previously described herein. In at least the illustrated embodiment, each of the "pillow" portions 80, 81, and 82, along with the respective elongate slits 30, 32 are positioned substantially intermediate the respective "frame" portions 84, 86. Of course, in other embodiments, the length of the "frame" portions may be such that at least a portion of the portions 80 and/or 82 may not be positioned substantially intermediate the "frame" portions, as may be desirable for particular applications. In any event, in any of these and still other embodiments, it should be understood that each of the axes 18, 19 (and thus the "frame" portions 84, 86) are substantially perpendicular relative to each of the axes 12, 14, and 16 (and thus the "pillow" portions 80, 81, and 82.

As mentioned previously herein, according to certain various embodiments, one or more of the "pillow" and/or "frame" portions 80, 81, 82, 84, 86 may be selectively inflatable according to various embodiments, while in other various embodiments, one or more of the "pillow" and/or "frame" portions may be configured to be non-inflatable, as may be desirable for particular applications. Indeed, with continued reference to FIGS. 4-6, it should be understood that in certain embodiments, the assembly 10 may comprise an inflatable "pillow" portion 80 (e.g., along axis 12), with the remaining portions 81, 82, 84, 86 being configured in a non-inflatable fashion. For example, in one embodiment, the portions 81, 82, 84, 86 may further comprise one or more additional seal lines (not shown) analogous to seal lines 50, 60, and 62 as previously described herein. In such a manner, it should be understood that in at least these embodiments inflation of the assembly 10 may be configured to result only in inflation of the distally located "pillow" portion 80, as illustrated particularly in FIG. 6. As a result, during operation, the distally positioned portion 80 may provide a minimal amount of force upon a distal end of the patient's limb, relative to the targeted joint, all as will be described in further detail further below with reference to at least FIGS. 8A-10B.

Returning now to FIGS. 4-6, according to certain embodiments, at least two of the "pillow" portions may be configured to be selectively inflatable, while a remaining one of the "pillow" portions and the "frame" portions may be configured to be non-inflatable. As a non-limiting example, in at least one embodiment, wherein two corresponding forces are desired upon the same side of a patient's limb, the "pillow" portions 80 and 82 may be selectively inflatable, while the "pillow" portion 81 and the "frame" portions 84 and 86 may be non-inflatable. With brief reference to FIG. 8B, such a configuration would result in only the two downwardly directed force vectors "F" being imposed upon the exemplary finger joint.

As yet another non-limiting example, in certain other embodiments, wherein two opposing forces are desired upon the patient's limb, the "pillow" portions 80 and 81 may be selectively inflatable, while the "pillow" portion 82 and the "frame" portions 84 and 86 may be non-inflatable. Such a configuration would result in only the two right-most force vectors "F" of FIG. 8B, as may be desirable for certain applications. Of course, it should be understood that any of a variety of combinations of inflatable versus non-inflatable portions 80, 81, and/or 82 (all with non-inflatable "frame" portions 84 and 86) may be provided according to certain embodiments, depending upon the resulting combination of force vectors "F" one may desire to impose upon the patient's joint and/or associated limb.

Remaining still further with FIGS. 4-6, according to certain embodiments, all three of the "pillow" portions 80, 81, 82 may be selectively inflatable, with only the "frame" portions being configured as non-inflatable. Such a configuration would result in, for example, the illustrated embodiment of at least FIGS. 8A-B, wherein three force vectors "F" are imposed upon an exemplary finger joint, with the force being imposed by the "pillow" portion 81 being substantially oppositely directed relative to the forces being imposed by the "pillow" portions 80, 82, at least when the finger joint is initially in a "generally straight" configuration. In these and still other embodiments, the resultant force vectors "F" impose a much greater degree of force upon the targeted joint than those configurations having either only one or just two selectively inflatable "pillow" portions 80, 81, and 82.

In still further various embodiments not only may any of a variety of various combinations of either one, two, or three of the "pillow" portions 80, 81, 82 be selectively inflatable, but also one or more of the "frame" portions 84, 86 may be likewise selectively inflatable. As a non-limiting example, with continued reference to FIGS. 4-6, in at least one embodiment, both of the "frame" portions 84, 86 may be selectively inflatable so as to provide stabilization and support for the inflatable assembly 10 in its entirety. It should be understood that in these and still other embodiments, the "frame" portions 84, 86 also provide "pillow"-like portions filled with air (or some comparable fluid—e.g., water, gas or the like), but denoting them as "frame" portions denotes their function as support and/or stabilization members, as contrasted with the "pillow" portions 80, 81, and 82, which, when inflated according to various embodiments, impose some degree of force (e.g., one or more force vectors "F" of FIG. 8B) upon the targeted joint.

Turning now to FIGS. 7A-B, a pictorial view of an exemplary inflatable assembly 10 according to various embodiments is provided. As may be seen from these figures, which depict selectively inflatable portions 80, 81, 82, 84, and 86 (e.g., all inflatable), one or more of the various portions may actually substantially touch and/or intersect one another, particularly where segregation of various portions is not necessary due to having minimal or no non-inflatable portions, as previously described herein. Indeed, with reference particularly to FIG. 7B, which illustrates the assembly 10 in its inflated mode (versus the deflated mode of FIG. 7A), it may be seen that at least the "pillow" portions 80, 82 and the "frame" portions 84, 86 may, in certain embodiments, not have a seam line positioned there-between. In such and still other embodiments, when inflated, the portions 80, 82, 84, and 86 may form a substantially "square-shaped" inflated portion substantially surrounding not only the remaining "pillow" portion 81 but also the elongate slits 30, 32. Such a configuration, where employed, provides still further stability and support for the assembly 10, due at least in part to the substantially perpendicular orientation of portions 80 and 82 relative to portions 84 and 86.

Proceeding to FIGS. 8A-B, which have been briefly described previously herein, various possible force vectors "F" are illustrated, as may be applied upon exemplary inflatable assemblies 10. Indeed, according to various embodiments, one or more force vectors "F" may be imposed upon at least one portion of a patient's limb or joint, as may be desirable for particular applications. As a non-limiting example, in at least the illustrated embodiment, as the central pillow portion 81 expands it tends to expand towards a finger joint, pushing on a first side of the finger proximate the joint; this is the upwardly oriented and generally longer force vector "F." As the end pillow portions 80, 82 inflate, they tend to push on the opposite side of the finger than does the central pillow portion 81, resulting in the downwardly directed, shorter, and, oftentimes, angled force vectors "F." It should be understood that when angled, the downwardly directed force vectors "F" are to some degree lesser in magnitude than the upwardly directed force vector "F." Of course, in certain embodiments, the various upwardly and downwardly directed force vectors may all, at least in an initial "straight finger" configuration, be substantially opposing and parallel relative to one another. However, as the forces are applied and a "bent finger" configuration is realized, the downwardly directed force vectors "F" become incrementally angled, relative to the upwardly directed force vector "F."

Still further, remaining with FIGS. 8A-B and as has been described previously herein, certain embodiments may be configured such that only one force vector is applied upon an exemplary finger or joint. In other embodiments, two force vectors may be applied, dependent upon the number of selectively inflatable (versus non-inflatable) pillow portions (e.g., inflatable members) exist, as has been previously described. In these and still other embodiments, it should be understood that any of the various combinations of one, two, or three selectively inflatable (and thus resulting force vectors "F") members may exist, as may be desirable for various applications and each are considered within the scope of the present invention and at least inflatable assembly 10. Such may be commonly referred to distal and proximal forces, corresponding to the distal versus proximal location of the limb upon which the force is applied.

FIGS. 9A-10B provide further illustrations of exemplary inflatable assemblies 10 during use, illustrating both deflated and inflated modes, as appropriate. As may be seen, depending upon the orientation of the joint and limb relative to the elongate slits 30, 32 and the assembly as a whole, differing types of movement may be imposed upon the joint and/or the limb. Typically, joints move in at least two directions, flexion and extension. Typically, flexion is to bend the joint and extension is to straighten the joint; however, in the orthopedic convention some joints only flex. Other joints not only flex and/or extend, they rotate. Rotation may be either external (e.g., away from the body) or internal (e.g., towards the body). Still other joints may be capable not only of flexion, extension, and rotation, but also of abduction and/or adduction. Abduction causes movement away from a midline of the joint, while adduction causes movement towards the midline. It should be understood that any of these and still other possible movements of joints and associated limbs may be achieved via use of the inflatable assembly 10, dependent at least in part upon the orientation of the assembly relative to the targeted joint and/or limbs. In this manner, various limbs and/or joints may be manipulated, as desired, by imposing thereupon one or more forces. Such various limbs and joints may include the non-limiting examples of any combination of a user's finger(s), hand(s), wrist(s), elbow(s), shoulder(s), neck, back, hip(s), knee(s), ankle(s), and/or foot (feet), as may be desirable for particular applications.

Inflatable Assembly 100

Turning now to FIGS. 11-13, an inflatable assembly 100 according to various embodiments is illustrated. It should be understood that the inflatable assembly 100 may be substantially the same in shape, size, and selectively inflatable versus non-inflatable portion combinations as the inflatable assembly 10, with the exception that the assembly 100 includes only a single slit 130 (versus two slits 30, 32). As such, according to various embodiments, the inflatable assembly 100 further comprises at most two "pillow" portions 180, 182 (and associated axes 112, 116), each positioned on substantially opposing sides of the single slit 130. Such a configuration, amongst other benefits, permits passage of a joint only once through the assembly 100, which in some instances may prove advantageous (e.g., the elbow and/or wrist, as described elsewhere herein). Of course, it should be understood that still further embodiments (not shown) may be provided, having any number of openings or slits, as may be desirable for particular applications.

According to various embodiments, as in the context of assembly 10, the various "pillow" and "frame" portions (described later herein) of the inflatable assembly 100 are defined at least in part by periphery seal lines 150, 160, and 162, comparable to those seal lines 50, 60, and 62, as previously described herein. All of that being said, for purposes of a complete and accurate disclosure, what follows herewith is a description of the various features of the inflatable assembly 100, both where substantially the same as those in the inflatable assembly 10 and where substantial differences appear between the same.

Focusing with particularity upon FIGS. 11 and 12, the inflatable assembly 100 according to various embodiments is further illustrated, but with a variety of axes 112, 116, 118, 119; "pillow" portions 180, 182; and "frame" portions 184, 186 identified thereon. As with inflatable assembly 10, such axes are defined in order to assist in the description and understanding of inventive concepts associated with various embodiments herein. However, it should be noted that the illustrated boundaries of portions 180, 182, 184, and 186 are approximate only; in reality these portions combine to comprise substantially the entirety of the assembly 100 (except for the inflation tube 140, as shown in FIG. 11).

With continued reference to FIGS. 11-13, according to various embodiments, the respective "pillow" portions 180, 182 each have a corresponding longitudinal axis 112 and 116, respectively. As illustrated in these figures, the axes 112, 116 (and thus the portions 180, 182) are substantially parallel and spaced a distance apart relative to one another. In certain embodiments, the axes 112, 116 are positioned on substantially opposing sides of the single elongate slit 130, which in at least the illustrated embodiment is centrally disposed upon the inflatable assembly 100. It should be understood, of course, that in other embodiments, the slit 130 may not necessarily be centrally disposed, as may be desirable for particular applications; however, in even those and other embodiments the axes 112, 116 (and thus the portions 180, 182) are nevertheless positioned on substantially opposing sides of the single elongate slit, however located. Indeed, as with the inflatable assembly 10, it should be understood that the portions 180, 182 and slit 130 are positioned relative to one another according to various embodiments so as to establish a set of sequentially parallel axes.

Remaining with FIGS. 11-13, according to various embodiments, the respective "frame" portions 184, 186 each have a corresponding longitudinal axis 118, 119, respectively. Notably, the "frame" portions 184, 186 are substantially the same in shape and configuration as the "frame" portions 84, 86 of assembly 10. In contrast, however, according to various embodiments of the inflatable assembly 100, only each of the "pillow" portions 180 and 182, along with the single elongate slit 130 are positioned substantially intermediate the respective "frame" portions 184, 186. In this manner, it should be understood that in at least certain embodiments, the "frame" portions 184, 186 may be at least somewhat larger in size than the "frame" portions 84, 86 of the assembly 10, particular wherein the relative sizes of the assemblies 10 and 100, in their entirety, are substantially the same.

As mentioned previously herein, according to certain various embodiments, one or more of the "pillow" and/or "frame" portions 180, 182, 184, 186 may be selectively inflatable according to various embodiments, while in other various embodiments, one or more of the "pillow" and/or "frame" portions may be configured to be non-inflatable, as may be desirable for particular applications. Indeed, with continued reference to FIGS. 11-13, it should be understood that in certain embodiments, the assembly 100 may comprise an inflatable "pillow" portion 180 (e.g., along axis 112), with the remaining portions 182, 184, 186 being configured in a non-inflatable fashion. For example, in one embodiment, the portions 182, 184, 186 may further comprise one or more additional seal lines (not shown) analogous to seal lines 150, 160, and 162, as previously described herein. In such a manner, it should be understood that in at least these embodiments inflation of the assembly 100 may be configured to result only in inflation of the distally located "pillow" portion 180, as may be desirable for particular applications. As a result, during operation, only the distally positioned portion 180 may provide a minimal amount of force upon a distal end of the patient's limb, relative to the targeted joint, all as has been described previously herein in the context of assembly 10, which applies by analogy, with reference to at least FIGS. 8A-10B.

Returning now to FIGS. 11-13, according to certain embodiments of the inflatable assembly 100, only one of the "pillow" portions may be configured to be selectively inflatable, while a remaining one of the "pillow" portions and the "frame" portions may be configured to be non-inflatable. As a non-limiting example, in at least one embodiment, wherein only one force vector "F" is desired upon one side of a patient's limb, the "pillow" portion 180 may be selectively inflatable, while the "pillow" portion 182 and the "frame" portions 184 and 186 may be non-inflatable. With brief reference to FIG. 8B by analogy, such a configuration would result in only the rightmost downwardly directed force vector "F" being imposed upon the exemplary finger joint.

As yet another non-limiting example, in certain other embodiments, wherein two opposing forces are desired upon the patient's limb, the "pillow" portions 180 and 182 may be both selectively inflatable, while the "frame" portions 184 and 186 may be non-inflatable. Such a configuration would result in only the two right-most (and oppositely oriented) force vectors "F" of FIG. 8B, as may be desirable for certain applications. Of course, it should be understood that any of a variety of combinations of inflatable versus non-inflatable portions 180, and/or 182 (all with non-inflatable "frame" portions 184 and 186) may be provided according to certain embodiments, depending upon the resulting combination of force vectors "F" one may desire to impose upon the patient's joint and/or associated limb. In any event, in contrast with the configuration provided with inflatable assembly 10, wherein a possible three force vectors "F" (see FIG. 8B) may be imposed upon a targeted joint and associated limb portion, the inflatable assembly 100 may impose a maximum of two such vectors at any particular instance.

In still further various embodiments not only may any of a variety of various combinations of either of the "pillow" portions 180, 182 be selectively inflatable, but also one or more of the "frame" portions 184, 186 may be likewise selectively inflatable. As a non-limiting example, with continued reference to FIGS. 11-13, in at least one embodiment, both of the "frame" portions 184, 186 may be selectively inflatable so as to provide stabilization and support for the inflatable assembly 100 in its entirety. It should be understood that in these and still other embodiments, the "frame" portions 184, 186 also provide "pillow"-like portions filed with air (or some comparable fluid—e.g., water, gas, or the like), but denoting them as "frame" portions denotes their function as support and/or stabilization members, as contrasted with the "pillow" portions 180, 182, which, when inflated according to various embodiments, impose some degree of force (e.g., one or more force vectors "F" of FIG. 8B by analogy) upon the targeted joint.

According to various embodiments, by analogy to FIG. 7B, it should be understood that the inflatable assembly 100, when inflated, may be configured such that the portions 180, 182, 184, and 186 forms a substantially "square-shaped" inflated portion substantially surrounding the elongate slit 130. Such a configuration, where employed, provides still further stability and support for the assembly 100, due at least in part to the substantially perpendicular orientation of portions 180 and 182 relative to portions 184 and 186.

Inflatable Assembly 200

Turning now to FIGS. 14A-C, an exemplary inflatable bladder assembly 200 according to various embodiments is illustrated, as may be used in conjunction with the intake line 90 and the palm bulb pump 96 of assembly 10, as may be seen in at least FIG. 1. It should be understood that the inflatable assembly 200 may be substantially the same in shape, size, and configuration as previously described assemblies 10 and 100. Still further, various embodiments of the assembly 200 may incorporate any of the various combinations of inflatable versus non-inflatable portions of the previously described assemblies 10 and 100, whether involving one or two slits (e.g., 30, 32, 130) and/or one, two, or three "pillow" portions (e.g., 80-82, 180, 182) and/or one or more "frame" portions (e.g., 84, 86, 184, 186). Notably, although the illustrated embodiment of FIGS. 14A-C contains two slits and thus three "pillow" portions, still other embodiments may be configured with a single slit and thus two "pillow" portions, as found in assembly 100. Thus, for purposes of disclosure, it should be considered that any of a variety of embodiments of assembly 200 may be configured substantially the same as any of the variety of embodiments of assemblies 100 and 10, as previously described herein.

Of course, according to various embodiments of inflatable assembly 200, in contrast with those of assemblies 10 and 100, the assembly 200 may further comprise a pair of elongate parallel sleeves 201, which are configured to substantially receive therein and through at least a portion of one or more elongate rods 202. As may be understood, in certain embodiments, the rods 202 provide additional rigidity, and thus stability and/or support, as may be desirable for particular applications. In other embodiments, the rods 202 can provide multiple functions, whether support, force coupling, or constriction of movement to a particular axis of rotation, all as will be described further below.

Turning now with particular focus on FIG. 14A, the pair of elongate parallel sleeves 201 are configured according to various embodiments such that they are relatively permanently attached to the remainder of the assembly 200. Of course, in other embodiments, it will be appreciated that the sleeves 201 may be selectively detachable from the assembly, so as to provide a flexible device that could function interchangeably as, for example, both the assembly 10 and assembly 200, with the sleeves being optionally added when additional structural support or the like is desirable.

That being said, as may be understood from FIGS. 14A & 14C, the pair of elongate sleeves 201, however selectively or otherwise attached to the remainder of the assembly 200, such are typically according to various embodiments positioned substantially parallel to one another and also to portions analogous to the "frame" portions 84, 86 or 184, 186, as previously described herein. In certain embodiments, the sleeves 201 may be positioned external to and substantially adjacent the "frame" portions, particularly when such portions may also be selectively inflatable. In other embodiments, however, the sleeves 201 may be configured so as to substantially coincide with the "frame" portions, wherein for example such portions are intended to be non-inflatable, also as previously described herein. In at least those and possibly other embodiments, where the "frame" portions need not be inflated, such may inherently provide a sleeve (e.g., due to the ply 20U, 20L structure of the assemblies), without need for additional and/or separately formed sleeves, per se. Of course, in any of these and still other embodiments, it should be understood that the sleeves 201 should be configured so as to run substantially parallel not only with the "frame" portions, but also with a longitudinal axis of the limb associated with the targeted joint.

With particular emphasis upon FIG. 14B, one or more elongate rods 202 may be configured according to various embodiments to be positioned internally within respective ones of the sleeves 201 described above. In certain embodiments, the elongate rods 202 may be two separately formed rods, as generally illustrated in FIG. 14B. However, in other embodiments, the elongate rods 202 may be formed from a single piece of material, as illustrated in at least FIG. 19A (as will be described in further detail later) as a substantially "U-shaped" rod member 402. Indeed, it should be understood that the one or more rods 202 may be formed in any of a variety of fashions, as commonly known and available in the industry, provided at least a portion of the rods is configured for receipt within the sleeves 201. In the non-limiting example of a "U-shaped" rod member, such would require that the upward portions of the "U" be spaced apart a distance substantially the same as that of the assembly 200 and/or a distance between the longitudinal axes of the respective sleeves 201. Of course, additional embodiments may incorporate any of a variety of rod member configurations having some sort of cross-bar member, including further the non-limiting examples of an "H-shaped," a "T-shaped," and/or a "Y-shaped" rod member, all as may be desirable for particular applications.

Although various advantages of the elongate rod 202 and sleeve 201 configuration provided in various embodiments of assembly 200 have been previously described herein, it is worth reiterating that in at least certain embodiments, the rods 202 may be configured to provide a multi-purpose function, during operation. As a non-limiting example, not only may the rods 202 provide a degree of rigidity beyond that provided by simply the inflatable portions of assemblies 10 and 100, the rods 202 may also provide a force coupling mechanism, through which one or more of the imposed force vectors "F" (see, by analogy, FIG. 8B) may be amplified relative to the force attainable via inflatable portions alone. Still further, in other embodiments, the rods 202 may constrict inadvertent movement of a joint and/or an associated limb portion about a particular axis for which movement may be undesirable. As yet another non-limiting example, when pure flexion and/or extension of a joint is desired, inadvertent joint rotation, either internally or externally, may be undesirable, as it may adversely impact the purity and thus effectively of isolated flexion and/or extension movement. Other possible combinations and scenarios exist; however, it should be understood that in any of the same and still other embodiments, the rods 202 may be configured to perform a multi-purpose function, rather than merely acting as support members. Still further, it should be understood that any of a variety of existing frames or portions thereof may be adapted for use as the rods 202.

Turning now to FIGS. 14D-E, the assembly 200 is illustrated during use, according to various embodiments. In at least the illustrated embodiment, at least one of a user's fingers may be placed through the slits and positioned substantially adjacent the various "pillow" portions, all as described previously herein. As may be understood from these figures, depending upon the orientation of the finger and the targeted joint relative to the assembly as a whole, differing types of movement may be imposed upon the joint and/or the limb. Such movement may comprise flexion (see FIG. 14D), extension (see FIG. 14E), abduction, adduction, internal rotation, external rotation, and the like; however as may be desirable for a particular treatment plan, therapeutic reasons, or otherwise. In this manner, it should be understood that various limbs and/or joints may be manipulated, as desired, by imposing thereupon one or more forces. Such various limbs and joints may include the non-limiting examples of any combination of a user's finger(s), hand(s), wrist(s), elbow(s), shoulder(s), neck, back, hip(s), knee(s), ankle(s), and/or foot (feet), as may be desirable for particular applications.

Inflatable Assembly 300

Turning now to FIGS. 15A-C, yet another inflatable assembly 300 is illustrated according to various embodiments, wherein the assembly comprises an elongate rigidity rod 302 positioned substantially within an elongate transverse sleeve 301. It should be understood that certain embodiments of the inflatable assembly 300 may be substantially the same in shape, size, and configuration as previously described assemblies 10, 100, and 200. Still further, various embodiments of the assembly 300 may incorporate any of the various combinations of inflatable versus non-inflatable portions of the previously described assemblies 10 and 100, whether involving one or two slits (e.g., 30, 32, 130) and/or one, two, or three "pillow" portions (e.g., 80-82, 180, 182) and/or one or more "frame" portions (e.g., 84, 86, 184, 186). Other embodiments of assembly 300 may further incorporate any of the various combinations of elongate parallel sleeves and rods 201, 202, where the characteristics achievable with such features (as previously described herein) may be desirable in addition to those of the elongate transverse sleeve 301 of FIGS. 15A-C.

With particular emphasis upon FIG. 15A, it may be seen that various embodiments of the inflatable assembly 300 comprise at least two selectively inflatable pillow portions 310, 311, intermediate to which are positioned two substantially parallel slits 304, substantially comparable to the configuration of various embodiments of assembly 10, as previously described herein. In place of, or alternatively in conjunction with, a portion of the assembly 300 analogous to the central pillow portion 81 of assembly 10, lies the sleeve 301, which instead of being selectively inflatable (as may be the portions 310, 311) is an open-ended sleeve, permitting insertion there-through of a rod 302. In this manner, however, it should be understood that a longitudinal axes of the portions 310, 311, the slits 304, the sleeve 301, and the rod 302 are substantially parallel relative to one another according to various embodiments.

With further reference to not only FIG. 15A but also FIGS. 15B-C, according to various embodiments of the inflatable assembly 300, the transverse rod 302 is positioned and configured so as to provide a desired degree of rigidity in between the slits 304, as may be beneficial for certain applications, wherein the rigidity provided by a pillow portion alone there-between may prove undesirable. As with the elongate parallel rods 202, it should be understood that the rod 302, in addition to providing an enhanced degree of rigidity, is also configured to provide a multi-purpose functionality, serving not only support, but also force coupling and constriction of movement purposes, as described previously herein with respect to the elongate rods 202.

Returning for a moment to FIG. 15A, it is worth mentioning further the identified air communication passageways incorporated within various embodiments of the inflatable assembly 300. Generally speaking, the passageways are provided so as to permit simultaneous inflation of the two portions 310, 311 via a single bulb pump and intake line (not shown). Such passageways, interconnecting one or more selectively inflatable portions have been previously described herein in the context of assemblies 10 and 100, and it should be understood that the passageways herein may be configured, shaped, and sized in substantially the same fashion so as to avoid the need to provide multiple bulb pumps and/or intake lines with various embodiments of the assembly 300.

Turning to FIG. 15C, it may be further understood that according to various embodiments of assembly 300, as in the context of various embodiments of assembly 200, the rod 302 may be relatively permanently attached to the assembly 300. In other embodiments, however, the rod 302 may be selectively insertable and/or removable in order to accommodate differing treatment protocols and/or transportation considerations of the assembly 300. It should be understood, of course, that analogous embodiments exist for any of the various embodiments described herein, for which one or more sleeves and/or one or more rods may be provided. It should be further understood that, although not particularly illustrated, at least certain embodiments of assembly 300 may comprise not only the rod 302, but also one or more rods comparable to rods 202 of assembly 200, thereby providing an even greater degree of rigidity, force, and/or constriction of movement than achievable with the various inflatable portions described herein in the context of at least assemblies 10, 100, and 200.

Inflatable Assembly 400

With initial reference to FIG. 16, an exemplary inflatable assembly 400 according to various embodiments may comprise a bulb pump 496 and an intake line 490 each configured substantially the same as previously described herein with respect to inflatable assemblies 10, 100, 200, and 300. Indeed, it should generally be understood that various embodiments of the assembly 400 may be configured in any of the variety of combinations of inflatable portions, non-inflatable "pillow" and/or "frame" portions, slit(s), elongate parallel sleeves, transverse sleeves, and/or associated rod members, however may desirable for particular applications.

Notably, the primary distinction between the assembly 400 and those previously described herein is the size and dimensions thereof, relative to targeted joints and/or associated limb portions. In particular, according to various embodiments of the assembly 400, the slits therein (shown but not numbered) are dimensioned substantially larger than those incorporated within assemblies 10, 100, 200, and/or 300. As a non-limiting example, in at least the illustrated embodiment, the slits may be configured so as to receive all of a patient's fingers, versus just a single finger. In other embodiments, the slits may be configured so as to substantially receive all of a patient's toes, or all of a patient's hand, when for instance targeting a wrist joint. Any of a variety of applications (e.g., targeted joints) may be envisioned; however, it should be understood that the assembly 400 may be configured in any of the variety of manners and combinations thereof previously described herein, but for its relative size being larger than, for example, assembly 10, as should be evident from a comparison of FIGS. 1 and 16.

FIGS. 17A-B provide further illustrations of exemplary inflatable assemblies 400 during use, illustrating both deflated and inflated modes, as appropriate. As may be seen, depending upon the orientation of the joint and limb relative to the elongate slits and the assembly as a whole, differing types of movement may be imposed upon the joint and/or the limb. Typically, joints move in at least two directions, flexion and extension. Typically, flexion is to bend the joint and extension is to straighten the joint; however, in the orthopedic convention some joints only flex. Other joints not only flex and/or extend, they rotate. Rotation may be either external (e.g., away from the body) or internal (e.g., towards the body). Still other joints may be capable not only of flexion, extension, and rotation, but also of abduction and/or adduction. Abduction causes movement away from a midline of the joint, while adduction causes movement towards the midline. It should be understood that any of these and still other possible movements of joints and associated limbs may be achieved via use of the inflatable assembly 400, dependent at least in part upon the orientation of the assembly relative to the targeted joint and/or limbs. Of course, such movement has been previously described herein in the context of the smaller configured (e.g., finger/joint focused) assemblies 10, 100, 200, and 300. In this manner, it should be understood that various limbs and/or joints may be manipulated, as desired, by imposing thereupon one or more forces. Such various limbs and joints may include the non-limiting examples of any combination of a user's finger(s), hand(s), wrist(s), elbow(s), shoulder(s), neck, back, hip(s), knee(s), ankle(s), and/or foot (feet), as may be desirable for particular applications.

Proceeding to FIGS. 18A-B, which are analogous to FIGS. 8A-B described previously herein, various possible force vectors "F" are illustrated, as may be applied upon exemplary inflatable assembly 400, much as seen in the context of assemblies 10, 100, 200, and 300. Indeed, according to various embodiments, one or more force vectors "F" may be imposed upon at least one portion of a patient's limb or joint, as may be desirable for particular applications. As a non-limiting example, in at least the illustrated embodiment, as the central pillow portion (not numbered) expands it tends to expand towards a proximal joint, pushing on a first side of the hand proximate the joint; this is the upwardly oriented and generally longer force vector "F." As the end pillow portions inflate, they tend to push on the opposite side of either hand or the fingers than does the central pillow portion, resulting in the downwardly directed, shorter, and oftentimes angled force vectors "F." It should be understood that when angled, the downwardly directed force vectors "F" are to some degree lesser in magnitude than the upwardly directed force vector "F." Of course, in certain embodiments, the various upwardly and downwardly directed force vectors may all, at least in an initial "straight finger" configuration, be substantially opposing and parallel relative to one another. However, as the forces are applied and a "bent finger" or "bent hand/finger" configuration is realized, the downwardly directed force vectors "F" become incrementally angled, relative to the upwardly directed force vector "F." Of course, it should be understood that in still other embodiments, the hand, fingers, or other limb portions may be alternatively oriented relative to the assembly 500, such that alternative movements (e.g., extension, or abduction, or rotation, or the like) may be imposed, rather than flexion (e.g., as illustrated).

Still further, remaining with FIGS. 18A-B and as has been described previously herein, certain embodiments may be configured such that only one force vector is applied upon an exemplary finger or joint. In other embodiments, two force vectors may be applied, dependent upon the number of selectively inflatable (versus non-inflatable) pillow portions exist, as has been previously described. In these and still other embodiments of the assembly 500 (as with previously described assemblies), it should be understood that any of the various combinations of one, two, or three selectively inflatable (and thus resulting force vectors "F") may exist. As previously described herein, such may be commonly referred to distal and proximal forces, corresponding to the distal versus proximal location of the limb upon which the force is applied.

Inflatable Assembly 500

With reference now to FIGS. 19A-B, an exemplary inflatable assembly 500 according to various embodiments is illustrated. From these figures, it should be understood that the assembly 500 may be configured substantially the same as any of the variety of combinations of embodiments described previously herein with respect to inflatable assemblies 10, 100, 200, 300, and 400. Indeed, it should generally be understood that various embodiments of the assembly 500 may be configured in any of the variety of combinations of inflatable portions, non-inflatable "pillow" and/or "frame" portions, slit(s), elongate parallel sleeves, transverse sleeves, and/or associated rod members, however may desirable for particular applications.

That being said, as may be understood from FIG. 19A, the assembly 500 may be configured, like assembly 400 to receive and/or target a joint larger than that of a finger. Still further, the assembly 500 may comprise one or more selectively inflatable pillow portions 510, 511, although in at least the illustrated embodiment the portion 510 the portion 510 is configured to be non-inflatable. Indeed, in certain embodiments, the portion 510 is configured as a sleeve portion to substantially receive not only a patient's limb (e.g., arm), but also to receive at least a portion of the elongate parallel rods 502. In at least the illustrated embodiment, the rod(s) 502 comprise a substantially "U-shaped" rod, as has been previously described herein. It should be understood that these various features and other illustrated in FIG. 19A may be analogously configured to those previously described herein, with regard to any of the variety of combinations of embodiments of assemblies 10, 100, 200, 300, and 400.

Returning with particular emphasis upon FIG. 19A, the assembly 500 may be further comprise one or more additional pillow portions 520, providing at least one distinction between various embodiments of the assembly 500 and those previously described herein. In certain embodiments, the additional pillow portions 520 may be permanently affixed to the assembly 500, while in other embodiments the portions may be selectively attachable and/or detachable, as may be desirable for particular applications. In any of these and still other embodiments, however, it should be understood that the additional pillow portions 520 are configured to provide an additional degree of force upon a particularly targeted joint and/or associated limb portion. In at least the illustrated embodiment, as a non-limiting example, the additional pillow portions 520 are positioned and configured to provide an additional downwardly directed force vector (not labeled) so as to further flex the patient's wrist joint. Specifically, in at least the illustrated embodiment, the additional pillow portions 520 are positioned so as to impose an enhanced degree of force upon the patient's hand and fingers.

Of course, remaining with FIG. 19A by analogy, it should be understood that additional pillow portions 520 may be placed in any of a variety of locations relative to the patient's targeted joint and/or limb portion, as may be desirable for therapeutic reasons or otherwise. Still further, in any of these and still other embodiments, the additional pillow portions 520 may be incorporated in conjunction with the rods 502, whereby the rods, in their multi-purpose functionality, provide not only support, but a leverage point upon which the pillow portions 520 may resist, thereby imparting an even greater force vector upon the targeted joint and/or limb portion. Notably, although at least the illustrated embodiment shows a single additional pillow portion 520, other embodiments may incorporate two or more additional pillow portions 520, either all sequentially applied at a particular location (e.g., adjacent a distal member) or parallel to one another (e.g., adjacent both proximal and distal members), however may be most beneficial and/or desirable for particular therapeutic treatments and the like.

It should be further noted with reference to FIG. 19A that various embodiments comprising additional pillow portions 520, whether in the context of assembly 500 as previously described herein, or even in any of the embodiments of assemblies 10, 100, 200, 300, and/or 400, may be simultaneously inflated, along with any other inflatable portions of the various assemblies. In certain embodiments, such may be accomplished via passageways between the additional pillow portions 520 and any other inflatable portions, although in other embodiments, such may involve an inflation tube 540 configured with split lines—one running to pillow portions 520 and another running to the remaining portions. Where multiple pillow portions 520 may be incorporated, the inflation tube 540 may be further split, as may be necessary according to various embodiments.

Turning now to FIG. 19B a variation of assembly 500 is illustrated, showing an alternative or additional central rod 503, which may be incorporated to provide further multi-purpose functionality. In certain embodiments of the assembly 500, the central rod 503 may replace the previously described parallel rods 502 (whether U-shaped or otherwise), although in other embodiments the central rod 503 may be in addition to previously provided rods, thereby providing an even greater degree of support, stability, force leverage, and/or constriction of undesirable movement beyond that targeted. Of course, it should be understood that still other embodiments may incorporate any of a variety of rods, positioned in any of a variety of fashions relative to the pillow portions of the assembly 500 (or other assemblies), as may be desirable for particularly focused therapeutic treatments or the like.

FIG. 19C further illustrates a variant embodiment of inflatable assembly 500, in particular without the rods 502, 503, as previously described herein. Of course, it should be understood that the configuration of FIG. 19C may alternatively include such rods, as may be desirable for particular applications. In any of these and still other embodiments, however, it should be understood that the inflatable assembly 500 may be oriented relative to a user's limb and targeted joint, such that the joint is subjected to extension, versus flexion (see, e.g., FIG. 19A). As may be understood from these figures, depending upon the orientation of the hand, arm and the targeted wrist joint relative to the assembly as a whole, differing types of movement may be imposed upon the wrist. Such movement may comprise flexion (see FIG. 19A), extension (see FIG. 19C), abduction, adduction, internal rotation, external rotation, and the like; any of which however as may be desirable for a particular treatment plan, therapeutic reasons, or otherwise. In this manner, it should be understood that various limbs and/or joints may be manipulated, as desired, by imposing thereupon one or more forces. Such various limbs and joints may include the non-limiting examples of any combination of a user's finger(s), hand(s), wrist(s), elbow(s), shoulder(s), neck, back, hip(s), knee(s), ankle(s), and/or foot (feet), as may be desirable for particular applications.

Inflatable Assembly 600

With reference now to FIGS. 20-23C, an exemplary inflatable assembly 600 according to various embodiments is illustrated, comprising at least a fluid intake (e.g., air, water, gas, etc.) line 690 and a palm bulb pump 696 substantially the same as lines and pumps 90, 96, 490, 496, as previously described herein. From these figures, it should be understood that the assembly 600 may be configured substantially the same as any of the variety of combinations of embodiments described previously herein with respect to at least inflatable assemblies 10, 100, 200, and 300. Indeed, it should generally be understood that various embodiments of the assembly 600 may be configured in any of the variety of combinations of inflatable portions, non-inflatable "pillow" and/or "frame" portions, elongate parallel sleeves, transverse sleeves, and/or associated rod members, however may desirable for particular applications.

As a non-limiting example, analogously configured elements may be seen in, for example FIG. 21B, denoting selectively inflatable "frame" member portions 684, 686, which may be comparable in shape, size, orientation, and the like as any of the various frame portions 84, 86, 184, 186, etc., all as have been previously described herein. Although the illustrated embodiment shows selectively inflatable "frame" member portions 684, 686, in other embodiments, one or more of such portions may be non-inflatable, as may be desirable for particular applications. In still other embodiments, one or more elongate parallel sleeves (not shown) and/or one or more transverse sleeves (also not shown), analogous to such previously described herein with respect to at least assemblies 200 and 300 may further be provided as part of assembly 600. Still other embodiments and/or variations thereof may exist.

Turning now to FIG. 21A, the inflatable assembly 600 is illustrated as further comprising one or more holes 630, 632, similar to the variety of slits (e.g., 30, 32 of assembly 10), as previously described herein. In contrast, however, according to various embodiments the holes 630, 632 are substantially circular in shape, whereas the slits are not. Of course, it should be understood that in still other embodiments, the holes 630, 632 (and even the slits) may be alternatively shaped and/or sized, as may be desired for particular applications. In any of these and still other embodiments, however, the holes 630, 632, like the slits (e.g., 30, 32) are configured in size to receive a limb portion associated with a targeted joint, such as the non-limiting example herein of a finger and associated finger joint (see also FIG. 22).

With reference to FIG. 21B, the inflatable assembly 600 is illustrated in an exemplary inflated configuration (versus the exemplary deflated configuration of FIG. 21A). In at least the illustrated embodiment of assembly 600 the side "frame" member portions 684, 686 are configured to be selectively inflatable, while remaining portions analogous to "pillow" portions as previously described herein are non-inflatable. Of course, in other embodiments, such remaining "pillow" portions may additionally and/or alternatively be selectively inflatable, as may be desirable for particular applications. Still further embodiments may incorporate one or more elongate parallel sleeves, one or more transverse sleeves, and any of a variety of rods associated therewith, as also described elsewhere herein.

FIGS. 22-23C provide further illustrations of exemplary inflatable assemblies 600 during use, illustrating both deflated and inflated modes, as appropriate. As may be seen, depending upon the orientation of the joint and limb relative to the holes 630, 632 and the assembly as a whole, differing types of movement may be imposed upon the joint and/or the limb. Typically, joints move in at least two directions, flexion and extension. Typically, flexion is to bend the joint and extension is to straighten the joint; however, in the orthopedic convention some joints only flex or extend (see, for example FIG. 22 versus FIG. 23C). Other joints not only flex and/or extend, they rotate. Rotation may be either external (e.g., away from the body) or internal (e.g., towards the body). Still other joints may be capable not only of flexion, extension, and rotation, but also of abduction and/or adduction. Abduction causes movement away from a midline of the joint, while adduction causes movement towards the midline. It should be understood that any of these and still other possible movements of joints and associated limbs may be achieved via use of the inflatable assembly 10, dependent at least in part upon the orientation of the assembly relative to the targeted joint and/or limbs. In this manner, various limbs and/or joints may be manipulated, as desired, by imposing thereupon one or more forces. Such various limbs and joints may include the non-limiting examples of any combination of a user's finger(s), hand(s), wrist(s), elbow(s), shoulder(s), neck, back, hip(s), knee(s), ankle(s), and/or foot (feet), as may be desirable for particular applications.

With continued reference to FIGS. 23A-C, various possible force vectors "F" are illustrated, as may be applied upon exemplary inflatable assemblies 600. Such vectors are comparable to those imposed upon various embodiments of assemblies 10, 100, 200, 300, 400, and 500, all as previously described herein. Indeed, according to various embodiments, one or more force vectors "F" may be imposed upon at least one portion of a patient's limb or joint, as may be desirable for particular applications. As a non-limiting example, in at least the illustrated embodiment of FIGS. 23A-B, inflation imposes a force upon a first side of the finger proximate the joint; this is the upwardly oriented and generally longer force vector "F." Substantially opposing forces are simultaneously imposed on the opposite side of the finger, resulting in the downwardly directed, shorter, and oftentimes angled force vectors "F." It should be understood that when angled, the downwardly directed force vectors "F" are to some degree lesser in magnitude than the upwardly directed force vector "F." Of course, in certain embodiments, the various upwardly and downwardly directed force vectors may all, at least in an initial "straight finger" orientation of FIG. 22, be substantially opposing and parallel relative to one another. However, as the forces are applied and a "bent finger" configuration is realized, the downwardly directed force vectors "F" become incrementally angled, relative to the upwardly directed force vector "F."

Still further, remaining with FIGS. 23A-C, certain embodiments may be configured such various movements are imposed upon the targeted joint. It may be seen that the orientation of the inflatable assembly 600 relative to the finger in FIGS. 23A-B causes more flexion of the joint upon inflation; this is referenced as being in the "flexion orientation" of the assembly 600. FIG. 23C is a pictorial view of an exemplary finger positioned within the inflatable assembly 600 in an alternate relationship compared to that of FIGS. 23A-B. As noted above, the orientation of the inflatable assembly 600 relative to the finger in FIGS. 23A-B causes more flexion of the joint upon inflation; in FIG. 23C, however, the inflatable assembly 600 is flipped approximately 180 degrees around the finger axis, such that inflation of the joint causes more extension; this is referenced as being in the "extension orientation" of the assembly 600. In still other embodiments, the inflatable assembly 600 may be "flipped" or rotated or oriented any of a variety of other degrees (e.g., 45, 60, 90, etc.) so as to facilitate the imposition of still other types of movement (e.g., abduction, adduction, internal rotation, external rotation, etc.) upon the targeted joint and/or associated limb portion. As may be seen, the finger is straighter in the deflated environment of FIG. 22 than in the inflated environment of FIG. 23B. Such has been described elsewhere herein and may be present not only in various embodiments of assembly 600, but also with any of the embodiments of assemblies 10, 100, 200, 300, 400, and/or 500, as may be desirable for certain applications.

To further emphasize, it should be understood that any of the various embodiments of assembly 600 could apply either a valgus or varus force to a joint by rotating it by 90 or 270 degrees about the longitudinal axis (for example, by rotating it around the finger). Furthermore, this 3-point bending system could be used to apply a force in any direction to any joint by merely changing the angle by which it is placed relative to the long axis of that limb (i.e., one could change the direction of force by rotating the bladder 45 degrees about the longitudinal axis of the finger, 75 degrees about the longitudinal axis, etc.). It is important to note that the system should not be limited to only flexion and extension, as has also been described elsewhere herein.

Returning for a moment to at least FIG. 23A, it should be noted that at least certain embodiments of the assembly 600 may be configured such that two target joints are simultaneously isolated for movement and/or manipulation by imposition of one or more of the various force vectors "F" as described elsewhere herein. Of course, depending upon the relative positioning of the joint(s) and associated limb portions, the assembly 600 may likewise isolate a single joint for manipulation, as with various embodiments of any of the assemblies 10, 100, 200, 300, 400, and/or 500.

Inflatable Assembly 700

Turning now to FIGS. 24-27, an inflatable assembly 700 is further illustrated, which may be selectively inflated and/or deflated in substantially the same manner as other assemblies described elsewhere herein. FIG. 24 in particular is a pictorial view of certain embodiments of assembly 700, which generally comprises a single elongate slit 730, an inflation tube 340, an assembly periphery seal line 750, a slit periphery seal line 760, and at least two side pillow portions 780. As may be understood from this figure, the single slit 730 is surrounded by the slit periphery seal line 760, and the outer periphery of the assembly is likewise sealed at the assembly periphery seal line 750, all in a comparable fashion to that described elsewhere herein with respect to any of the various embodiments of assemblies 10, 100, 200, 300, 400, 500, and 600. In various embodiments of the assembly 700, it should be further understood by analogy that inflation of the assembly via air (or a comparable fluid—e.g., water, gas, or the like) introduced through the tube 740 causes the air (or comparable fluid) to be introduced into a cavity defined by at least two ply layers of the assembly as well as the two seal lines.

With particular reference now to FIG. 27, an arm is illustrated for use with the assembly 700, wherein the arm may be introduced elbow-first into the slit 730 so as to facilitate the non-limiting example of elbow joint manipulation. Upon inflation, in at least the illustrated embodiment, the assembly 700 will cause at least a first opening to contract, thereby resulting in movement (e.g. flexion) of the arm, essentially due to the filling of the two side pillow members 780 and their resulting stiffening, much like the inflation of various "pillow" and "frame" portions of assemblies 10, 100, 200, 300, 400, 500, and 600 resulted in movement of their respective targeted joints. For certain embodiments of the assembly 700, as for any of the various other herein-referenced embodiments, it should be understood, however, that modification to the orientation of the assembly relative to the targeted joint and/or associated limb portion may result in any of a variety of movements (e.g., extension, abduction, adduction, internal rotation, external rotation, etc.), as may be desirable for various therapeutic treatments and/or applications. It should be further understood that although an arm is illustrated (and elsewhere herein a wrist and/or a finger has been illustrated), the assembly 700 and any of the remaining assemblies may be configured for use with alternative portions of the anatomy, for manipulation thereof as may be desirable. In this manner, it should be understood that various limbs and/or joints may be manipulated, as desired, by imposing thereupon one or more forces. Such various limbs and joints may include the non-limiting examples of any combination of a user's finger(s), hand(s), wrist(s), elbow(s), shoulder(s), neck, back, hip(s), knee(s), ankle(s), and/or foot (feet), as may be desirable for particular applications.

Inflatable Assembly 800

Turning now to FIGS. 28A-C, various embodiments of an inflatable assembly 800 are illustrated, which comprise portions 810, 820 that may be selectively inflated and/or deflated in substantially the same manner as other assemblies described elsewhere herein. As may be seen in FIG. 28A in particular, the assembly 800 may comprise at least one frame member 850 configured to operatively connect the portions 810, 820, so as to form an opening 830 there-between. In this manner, the assembly 800 defines a configuration much like that of assembly 10 (see e.g., FIG. 6); however, in contrast to the integrated unitary piece therein, the assembly 800 is formed from individual and separate components, each operatively connected and positioned relative to one another by the at least one frame member 850.

Remaining with FIG. 28A, it may be further understood that, in certain embodiments, the at least one frame member 850 may comprise two elongate and spaced apart rails, much like the side frame members and rods of, for example, inflatable assembly 200 (see, e.g., FIGS. 14A-C). Of course, in contrast with the manner in which the rods of assembly 200 are positioned substantially within integral sleeves 201 of the assembly, the frame member(s) 850 of assembly 800 may be configured external to the remainder of the assembly and in particular to the portions 810, 820, which may be selectively attached thereto.

With reference to FIGS. 28A-B, in various embodiments, the portions 810, 820 may be selectively attached relative to the frame member(s) 850 via any of a variety of securing material and/or attachment mechanism (e.g., Velcro, magnets, clips, or the like), as may be desirable for particular applications. Of course, it should be further understood that, as described elsewhere herein with regard to analogous portions, either of the portions 810, 820 may be selectively inflatable according to certain embodiments, while in other embodiments, at least one of the portions may be substantially non-inflatable. Indeed, in at least the illustrated embodiment of FIG. 28B, the portion 810 may actually comprise a strap member, rather than an inflatable portion. Still further, in certain embodiments, one or more of the portions 810, 820 may be not itself directly attached to the frame member(s) 850, but instead one or more strap members (e.g., 821) may be incorporated within the assembly 800 so as to secure at least one portion relative to the frame members(s). Of course, any of a variety of combinations of attachment and securing mechanisms may be used, whether involving direct or indirect placement of the portions relative to the frame members(s), all as may be desirable for various applications. It should also be further understood that the attachment members may, according to various embodiments, not only attach the portions structurally relative to one another, but also the airflow and inflatable member (e.g., chambers) thereof.

Remaining with FIG. 28B, but coupled with reference to FIG. 28C, it should be understood that various embodiments of inflatable assembly 800 may be oriented relative to a user's limb and targeted joint, such that the joint is subjected to extension (see FIG. 28B), versus flexion (see, e.g., FIG. 28C). As may be understood from these figures, depending upon the orientation of the limb and the targeted joint (e.g., wrist) relative to the assembly as a whole, differing types of movement may be imposed upon the joint. Such movement may comprise flexion (see FIG. 28C), extension (see FIG. 28B), abduction, adduction, internal rotation, external rotation, and the like; any of which however as may be desirable for a particular treatment plan, therapeutic reasons, or otherwise. In this manner, it should be understood that various limbs and/or joints may be manipulated, as desired, by imposing thereupon one or more forces. Such various limbs and joints may include the non-limiting examples of any combination of a user's finger(s), hand(s), wrist(s), elbow(s), shoulder(s), neck, back, hip(s), knee(s), ankle(s), and/or foot (feet), as may be desirable for particular applications.

It should be further understood that still other embodiments of assembly 800 may comprise any of the various combinations of elements and configurations of the variety of assemblies described previously and elsewhere herein (e.g., assemblies 10, 100, 200, 300, 400, 500, 600, and/or 700). For example, the assembly 800 may be configured with additional portions and/or straps, such that two openings are formed, rather than the single opening previously described herein, thereby facilitating movement and/or manipulation of certain joints, as described elsewhere herein.

Inflatable Assembly 900

Turning now to FIGS. 29A-B, various embodiments of an inflatable assembly 900 are illustrated, which comprise portions 910, 920 that may be selectively inflated and/or deflated in substantially the same manner as other assemblies (see, e.g., assembly 800) described elsewhere herein. As may be seen in FIG. 29A in particular, the assembly 800 may comprise at least two members 951, 952 configured to operatively connect the portions 910, 920, so as to form an opening through which a user's limb may pass therebetween. In this manner, the assembly 900 defines a configuration much like that of assembly 800 (see e.g., FIG. 28A); however, in contrast to the substantially planar and rigid frame member 850 illustrated therein, the assembly 900 incorporates frame members 951, 952, which may be selectively rotated relative to one another.

With particular reference to FIG. 29A, the assembly 900 is illustrated in what may be considered a first orientation, whereby the frame members 951, 952 form a first angle 960 there-between, so as to receive a user's arm in its natural alignment, given a particular therapeutic treatment. Over time, it should be understood that various therapeutic treatments and the like may improve and/or alter the natural alignment (e.g., the un-flexed, un-rotated, and/or un-extended configurations) such that a different, second angle 970 (see FIG. 29B) would better correspond thereto than the first angle 960. As may be understood from FIGS. 29A-B, one or both of the frame members 951, 952 may comprise telescoping portions (e.g., portions 952*a*, 952*b*) which may be selectively adjusted, as necessary to provide a frame member of appropriate length for use at a particular angle (e.g., 970 versus 960). For example, in at least the illustrated embodiment of FIG. 29B, a slot and pin configuration 980 is provided, so as to permit selective movement between frame members 952*a*, 952*b*, so as to accommodate the length of a user's arm. Comparable configurations may be provided likewise along frame member 951. Still further, although a slot and pin configuration is illustrated still other adjustment mechanisms may be incorporated, as commonly known and used in the art.

Multi-Joint Inflatable Assembly 1100

Turning now to FIGS. 31A-32C, various embodiments of multi joint inflatable assembly 1100 are illustrated, as may be formed by combining two or more of the various assemblies 10, 100, 200, 300, 400, 500, 600, 700, 800, 900, all as described elsewhere herein. Such assemblies as 1100 may facilitate, for example, therapeutic treatment of two or more targeted joints with a single assembly, during a single treatment session. With reference to FIG. 31A, it may be seen how multiple of the individual assemblies 1120 (as previously described) may be combined in series so as to form various embodiments of the multi joint inflatable assembly 1100.

Remaining with FIG. 31A, it may be seen how the targeted limb and/or joints may then be "woven" through the various slits and/or openings, thereby orienting the same in a desired fashion for the assembly 1100 to impose relative movement(s) thereon. It should be understood, of course, that in certain instances, not all of the slits and/or openings (shown but not numbered) may be used during a particular application, where, for example, the user's limb and/or joint may pass through every other slit and/or opening, or through every third, however as may be the case. Still further, it should be understood that the assembly 1100 may be comprised of any of a variety of combinations of subassemblies, each comprising one of the various assemblies described elsewhere herein. That being said, all of the "sub-assemblies" of each assembly 1100 need not be identical; indeed, as a non-limiting example, one embodiment may comprise three sub-assemblies, as follows: an assembly 10, an assembly 100, followed in series by an assembly 200. Any of a variety of combinations may be envisioned.

With continued reference to FIG. 31A, an intake line 1140 is illustrated, via which a fluid (e.g., gas, liquid, or the like) may be injected, so as to selectively inflated one or more inflatable portions of the assembly 1100, as has been previously described herein. From this figure, however, it may be further understood that the intake lines of each sequentially connected assembly (e.g., each subassembly 10 or the like) may be configured with an output connector 1130, which is configured to selective mating and engagement with adjacently positioned intake lines 1140. In this manner, according to various embodiments, the assembly 1100 in its entirety may be configured to be selectively inflated via a single bulb pump or pump mechanism, as described elsewhere herein, without the need for separate pump and/or pump mechanisms for each respective subassembly. Of course, in still other embodiments, separate pumps and/or pump mechanisms may be provided for each inflatable portion, as may alternatively be desirable for various applications.

Remaining for a moment with FIG. 31A, the individual assemblies that may be combined to form assembly 1100 may be connected such that only one pump mechanism is required to inflate and/or deflate the entire system. Such is, of course, dependent at least in part upon the manner in which the individual assemblies (e.g., subassemblies) are connected relative to one another. In addition and/or in alternative to the output/input connector 1130 described above, various embodiments of assembly 1100 may connect the individual (sub)assemblies by snaps, buttons, Velcro, hooks, or any of a variety of attachment and securing mechanisms, as commonly known and understood in the art. It should also be further understood that the attachment members may, according to various embodiments, not only attach the portions structurally relative to one another, but also the airflow and inflatable member (e.g., chambers) thereof.

Turning now to FIGS. 31B-C, it may be seen that certain embodiments of assembly 1100 may further comprise one or more frame members, substantially analogous to any of the variety of frame members described elsewhere herein. Although not specifically illustrated, it should be understood that not every "sub-assembly" of assembly 1100 need incorporate frame members; however, in at least the illustrated embodiments, such is the case. With particular reference to FIG. 31B, a substantially rigid, elongate, and single piece frame member 1150*a* is illustrated, extending substantially the length of the assembly 1100 in its entirety (e.g., bridging across multiple sub-assemblies aligned in a serial configuration). In certain embodiments, as illustrated in FIG. 31C, a frame member 1150*b* having two or more joints 1160 may be incorporated, wherein the two or more joints 1160 may be configured to selectively provide additional force upon the targeted limbs and/or joints, as desired. In at least the illustrated embodiments, the joints 1160 may be selectively lockable, as in the case of foldable and/or lockable rods, as used in the construction of camping tents, for example. Still other configurations may be envisioned, wherein at least a portion of a frame member 1150*b* may be selectively moved across a desired range of degrees (e.g., 10 degrees, or otherwise).

FIGS. 31D-E illustrated still further variations of various embodiments of assembly 1100, wherein a pliable frame 1150*c* is provided (aka adjustable, customizable frame). In certain embodiments, the frame 1150*c* may be formed from a substantially pliable material, wherein upon shaping into a desirable orientation, the material would retain such form during a particular therapeutic treatment. Such a pliable orientation may, for example, be configured so as to accommodate a user's natural alignment (e.g., an un-flexed, unextended, and/or un-rotated configuration). The frame 1150*c* may be formed as a locking ball frame, wherein it may be pliably shaped into multiple positions and then locked into position by flipping an elliptical locking mechanism associated therewith. Such a frame 1150*c* comprises a plurality of beads or balls 1151 arranged in a chain-like configuration, with each ball containing a fluted hole to allow more movement of a wire (not shown) passing within the ball. The surface of the ball or bead could be smooth or it could have a scored surface so as to facilitate locking of the balls or beads into a rigid position. Still further, the ball or bead could be hard in the center with a soft surface or coating to facilitate the tightening bond associated with flipping the elliptical end locking mechanism.

It should be understood that any of a variety of the assemblies 10, 100 (etc.), as described elsewhere herein may be selectively threaded onto the locking ball frame, and/or any of a variety of frames, so as to form customizable shapes and configurations of the assemblies, as may be desirable and/or beneficial for a particular therapeutic treatment plan. Still further, although a locking ball frame and certain other frame constructions have been described herein, any of a variety of substantially rigid or at least selectively pliable materials and structural configurations may be used, provided such permit selective threading of one or more elements of the various assemblies, thereupon.

With reference now to FIGS. 32A-C, it should be understood that any of a variety of combinations of limb portions and/or joints may be interspersed along any of the variety of frame members described previously herein. As a non-limiting example, FIG. 32A illustrates an alternating configuration, via which the assembly 1100 may be configured to apply flexion across one joint and then extension across another joint. Alternative combinations may include abduction/adduction, internal/external rotation, and the like, however may be desirable for various applications. Still further, certain embodiments could be configured such that various combinations of any of the above and even other movements may be imposed upon sequentially aligned joints, given the flexibility and pliability of certain disclosed frame members. Turning for a moment to FIGS. 32B-C, it should be further understood that various embodiments of assembly 1100 may be configured so as to provide only a single type of movement to a targeted limb and/or joint. Such may be solely extension (see FIG. 32B), solely flexion (see FIG. 32C), or otherwise, again, as may be desirable for particular treatment plans and/or applications.

Beyond the variations of "sub-assemblies" within the various embodiments of assembly 1100, it should be further understood that the number of slits or holes present, the number of slits or holes used, the incorporation of rods along a portion of all of the assembly, the varying sizes of slits or holes, the number of pump mechanisms present, and the continuity or discontinuity of various air bags/bladders may all vary and/or be adjusted, based upon what may (or may not) be desired for particular applications, therapeutic treatment plans, and the like.

FIG. 33 is an illustrative view of an exemplary embodiment comprising a plurality of balls or beads 1510 that are linked together by an internal wire 1520 passing through holes in all the beads, the wire having an end cap 1530 on one end and an elliptical lock 1550 (or other suitable lock) on the other end. By loosening and tightening the wire 1520, the relative positions of the balls 1510 can be adjusted as needed. If the tension of the wire is suitably adjustable between "loose", "snug", and "tight", as in one embodiment, the relative positions of the balls can be adjusted when the tension is in a first "snug" state (e.g., tight enough to barely hold the desired shape), and when the desired shape is provided, the tension can be increased to "tight" so as to be able to support the associated inflatable and other straps as needed.

FIG. 34 shows various exemplary non-globally shaped elements, configurable for assembling a custom shaped rigid frame member, including side and end views of various rigid frame members according to various embodiments described elsewhere herein, as configured with internal holes to accommodate at least one stringing wire therein.

FIG. 35 shows an assembled custom shaped structural element 1600 including two elongate members, an angular member intermediate same, and a stringing wire and associated fittings therefor, as also configured for use with various embodiments described elsewhere herein.

One method for assembling embodiments such as those shown in FIGS. 31D-E and/or FIGS. 33-35 is as follows. Elements or beads are threaded onto the "stringing wire". One end of the stringing wire has a large washer or other suitable member to retain its adjacent element. The free end of the wire is then pulled with a force such that the elements are locked together on the wire, causing the resulting construct to become a suitably rigid frame. The free end of the wire is then locked relative to its adjacent element with a suitable locking screw, cam member, or elliptical element as shown in FIG. 33.

Note that the elements or beads could have a soft surface, inter-digitations, tabs, male/female fittings, slots or slits to facilitate the connection between two adjacent pieces.

Miscellaneous Considerations

It should be understood that a first pliable planar member overlaid atop at least a portion of a second pliable planar member could be provided by the use of two separate layers of pliable material overlaid and suitably sealed (e.g. by ultrasonic, thermal, or other means) and cut, but it should also be understood that two such overlaid members could be provided by the use of a balloon member (the two plies would be provided by any two opposing sides). Such a balloon member could be manipulated to provide a configuration as shown in FIG. 4 for example by flattening a pre-formed balloon, providing seal lines as needed, and providing slits as needed. In one configuration tubular material could be used by flattening the tube, cutting the tube into section before or after flattening, and then providing seal lines as needed, and providing slits as needed. This provides a first pliable planar member overlaid atop at least a portion of a second pliable planar member, even though the two pliable members are part of the same original structure.

As they have been described elsewhere herein, various embodiments of assemblies 10, 100, 200, 300, 400, 500, 600, 700, 800, 900, 1100 may comprise one or two slits, openings, or holes in a series. However, in still further embodiments, any combination of number, size, and/or orientation of openings may be utilized. Non-limiting examples of shapes include circular, oval, elliptical, square, rectangular, polygonal, anatomical, or the like. Non-limiting examples of number include one, two, three, four, five, six, seven, etc., however many as may be desirable for particular applications. Non-limiting examples of sizes also exist, as the openings may be sized to receive fingers (e.g., approximately 1" in diameter), wrists (e.g., approximately 2-4" in diameter), ankles, knees, elbows, shoulders, and the like; as such, any of a variety of sizes and associated diameters of the openings may be envisioned.

With momentary reference to FIG. 30, it should be understood that although various embodiments of any of the assemblies 10, 100, 200, 300, 400, 500, 600, 700, 800, 900, 1100 have been previously described herein with reference to a hand bulb pump and an intake line, any may alternatively or additionally incorporate a pump system 1000. In certain embodiments, the pump system may, in addition or instead of a hand bulb pump (e.g., 1020), include at least one pump mechanism 1010 configured to automatically or selectively inflated the one or more inflatable portions of the various assemblies, upon demand. Still further, although not specifically illustrated, it should be understand that in other embodiments, where repetitious inflation and deflation of the various portions may be desirable, the pump system 1000 may further include a processor and/or specifically programmed computer system configured to automatically cycle through inflations and/or deflations, per any of a variety of predetermined or desired therapeutic treatment plans.

More generally, and again according to various embodiments of any of the assemblies 10, 100, 200, 300, 400, 500, 600, 700, 800, 900, 1100, as previously described herein, the materials shown to provide the selectively inflatable portions (e.g., bladders) can be of any of a variety of types. As non-limiting examples, the bladder material may be selected from any one of heat-, chemical- or ultrasonically-weldable PVC. Still further, such materials can be cut as needed, stacked, and welded along the described seal lines as known in the art to provide the configurations above. In a particular embodiment, nylon reinforced TPU is RF welded to form contours and fluid bladders. However, it must be understood that alternate materials and manufacturing processes could be used without departing from the spirit and scope of the present invention, and the description above is exemplary and not limiting.

Still further, according to various embodiments of any of the assemblies 10, 100, 200, 300, 400, 500, 600, 700, 800, 900, 1100, as previously described herein, the frame members may be formed from any of a variety of materials, including the non-limiting examples of metal, paperboard, wood, fiberglass, bamboo, or the like; however as may be desirable for particular applications. The frame members may be substantially elongate, square-shaped (e.g., for cross-rigidity), H-shaped, or otherwise. Alternatively, at least a portion of the frame members may rely solely on the stiffness of the bag/bladder/inflatable portion systems to provide cross and/or elongate rigidity, without the use of separately formed "frame members," as traditionally understood in the art.

III. Conclusion

The foregoing description of the various embodiments of the present invention has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The drawings and preferred embodiments do not and are not intended to limit the ordinary meaning of the claims in their fair and broad interpretation in any way.

That which is claimed:

1. An assembly for manipulating a user's limb with an inflatable member, said limb having a distal segment, a proximal segment, and a joint located substantially between said distal and said proximal segments, said assembly comprising:

a first pliable planar member; and a second pliable planar member overlaid atop at least a portion of said first pliable planar member, such that a two ply configuration is provided, said two ply configuration itself comprising:

a distal portion;

a proximal portion;

a central portion located substantially intermediate said distal portion and said proximal portion;

a first opening defined by the first pliable planar member and the second pliable planar member, said first opening being located substantially intermediate said distal portion and said central portion, said first opening configured to accept a portion of a distal portion of said user's limb; and a second opening defined by the first pliable planar member and the second pliable planar member, said second opening being located substantially intermediate said proximal portion and said central portion, said second opening configured to accept a portion of a proximal portion of said user's limb;

wherein said first and second pliable planar members combine to define an inflatable member, said inflatable member being at least a portion of at least one of said distal, proximal, and central portions, said inflatable member being configured to be selectively inflatable so as to provide at least one inflation force upon said user's limb, such that said joint in said user's limb is manipulated.

2. The assembly of claim 1, wherein said second pliable planar member overlays substantially an entirety of said first pliable planar member and said first and second planar members are part of a unitary construction.

3. The assembly of claim 1, wherein:

said at least one inflation force comprises a first inflation force at the distal portion acting in a first direction and upon said distal segment of said user's limb.

4. The assembly of claim 1, wherein:

said at least one inflation force comprises:

a first inflation force at the distal portion acting in a first direction and upon said distal segment of said user's limb; and a second inflation force at the proximal portion acting substantially in said first direction and upon said proximal segment of said user's limb.

5. The assembly of claim 1, wherein:

said at least one inflation force comprises:

a first inflation force at the distal portion acting in a first direction and upon said distal segment of said user's limb;

a second inflation force at the proximal portion acting substantially in said first direction and upon said proximal segment of said user's limb; and a third inflation force at the central portion acting in a second direction and upon said joint of said user's limb, said second direction further being substantially opposite that of said first direction.

6. The assembly of claim 1, wherein:

said inflatable member comprises a first inflatable member, a second inflatable member, and a third inflatable member;

said first inflatable member being at least a portion of said distal portion;

said second inflatable member being at least a portion of said central portion;

said third inflatable member being at least a portion of said proximal portion; and said first, second, and third inflatable members are each configured to be individually selectively inflatable so as to provide at least three separate inflation forces upon said user's limb, such that said user's limb is manipulated.

7. The assembly of claim 6, further comprising one or more attachment mechanisms formed between said first inflatable member and said second inflatable member and between said second inflatable member and said third inflatable member, wherein said one or more attachment mechanisms are configured to selectively attach said first and said second inflatable members relative to one another and said second and said third inflatable members relative to one another, said selective attachment resulting in an airflow and a structural interconnection between said first, second, and third inflatable members.

8. The assembly of claim 1, further comprising:

a first elongate portion having a first longitudinal axis; and a second elongate portion having a second longitudinal axis, said second longitudinal axis being substantially parallel to said first longitudinal axis, wherein at least one of said distal, central, and proximal portions and said first and said second openings are located substantially intermediate said first and said second elongate portions.

9. The assembly of claim 8, wherein said at least one inflatable member is further defined by said first and said second elongate portions.

10. The assembly of claim 1, further comprising:

a first elongate sleeve having a first longitudinal axis substantially parallel to the user's limb; and a second elongate sleeve having a second longitudinal axis, said second longitudinal axis being substantially parallel to said first longitudinal axis, wherein at least one of said distal, central, and proximal portions and said first and said second openings are located substantially intermediate said first and said second elongate sleeves.

11. The assembly of claim 10, further comprising two substantially elongate rod members, each one of said two substantially elongate rod members being configured for insertion within one of said first and second elongate sleeves.

12. The assembly of claim 11, wherein each of said two substantially elongate rod members is substantially rigid.

13. The assembly of claim 11, wherein at least a portion of at least one of said proximal, central, and distal portions is located intermediate said two substantially elongate rod members and at least one of said user's limb and joint.

14. The assembly of claim 1, wherein:

each of said distal, central, and proximal portions are substantially elongate and have respective longitudinal axes, each of said respective longitudinal axes being substantially parallel relative to one another; and said assembly further comprises a first elongate sleeve, said first elongate sleeve having a first longitudinal sleeve axis, said first longitudinal sleeve axis being substantially parallel to each of said respective longitudinal axes of said distal, central, and proximal portions.

15. The assembly of claim 14, wherein said assembly further comprises a transverse rod, said transverse rod configured for insertion within said elongate sleeve.

16. The assembly of claim 14, wherein said assembly further comprises:

a second elongate sleeve having a second longitudinal sleeve axis, said second longitudinal sleeve axis being substantially perpendicular to said first longitudinal sleeve axis of said first elongate sleeve; and a third elongate sleeve having a third longitudinal sleeve axis, said third longitudinal sleeve axis being substantially parallel to said second longitudinal sleeve axis, wherein each of said distal, central, and proximal portions and said first and said second openings are located substantially intermediate said second and said third elongate sleeves.

17. The assembly of claim 1, further comprising at least one inflatable member formed separate from said two ply configuration, said at least one separately formed inflatable member being selectively attachable adjacent at least one of said distal, central and proximal portions.

18. The assembly of claim 1, wherein:

each of said distal, central, and proximal portions have respective longitudinal axes, each of said respective longitudinal axes being substantially parallel relative to one another; and said first and said second openings define substantially elongate slits, said slits each having respective longitudinal axes, said respective longitudinal axes of each of said elongate slits further being substantially parallel to each of said respective longitudinal axes of each of said distal, central, and proximal portions.

19. The assembly of claim 18, wherein said elongate slits are configured to receive at least a portion of a user's finger.

20. The assembly of claim 18, wherein said elongate slits are configured to receive at least a portion of a user's hand.

21. The assembly of claim 1, wherein said first and said second openings are substantially circular in shape and sized to receive at least a portion of a user's finger.

22. The assembly of claim 1, wherein said user's limb and joint are selected from a group consisting of a finger, a hand, a wrist, an elbow, a shoulder, a neck, a back, a hip, a knee, an ankle, a foot, one or more toes, an arm, a leg, and any combination thereof.

23. A method for manipulating a user's limb with an inflatable member, said limb having a distal segment, a proximal segment, and a joint located substantially between said distal and said proximal segments, said method comprising the steps of:

providing an assembly comprising:

(1) a first pliable planar member; and (2) a second pliable planar member overlaid atop at least a portion of said first pliable planar member, such that a two ply configuration is provided, said two ply configuration comprising:

(i) a distal portion;

(ii) a proximal portion;

(iii) a central portion located substantially intermediate said distal portion and said proximal portion;

(iv) a first opening defined by the first pliable planar member and the second pliable planar member, said first opening being located substantially intermediate said distal portion and said central portion, said first opening configured to accept a portion of a distal portion of said user's limb; and (v) a second opening defined by the first pliable planar member and the second pliable planar member, said second opening being located substantially intermediate said proximal portion and said central portion, said second opening configured to accept a portion of a proximal portion of said user's limb, wherein said first and second pliable planar members combine to define an inflatable member, said inflatable member being at least a portion of at least one of said distal, proximal, and central portions;

inserting at least said distal segment of said user's limb through said first opening, such that said distal segment is positioned substantially adjacent said central portion of said assembly;

inserting at least said distal segment of said user's limb through said second opening, such that said distal segment is positioned substantially adjacent said distal portion of said assembly, said user's joint is positioned substantially adjacent said central portion of said assembly, and said proximal segment of said user's limb is positioned substantially adjacent said proximal portion of said assembly; and actuating a pump mechanism to selectively inflate said at least one inflatable member, wherein said selective inflation provides at least one inflation force upon said user's limb, such that at least a portion of said user's limb is manipulated.

24. The method of claim 23, wherein said selective inflation creates the at least one inflation force substantially adjacent said distal segment of said user's limb, such that movement is imposed upon said user's joint.

25. The method of claim 24, wherein said movement is selected from a group consisting of: flexion, extension, abduction, adduction, internal rotation, and external rotation.

26. The method of claim 24, wherein said user's limb is a finger and said joint is at least one of an interphalangeal joint and a metacarpal phalangeal joint.

27. The method of claim 24, wherein said user's limb is an arm and said joint is a wrist.

28. The method of claim 24, wherein said user's limb and joint are selected from a group consisting of a finger, a hand, a wrist, an elbow, a shoulder, a neck, a back, a hip, a knee, an ankle, a foot, one or more toes, an arm, a leg, and any combination thereof.

29. The method of claim 23, wherein:

the at least one inflation force comprises:

a first inflation force at said distal portion and substantially adjacent said distal segment of said user's limb, said first inflation force acting in a first direction relative to said assembly; and a second inflation force at said proximal portion and substantially adjacent said proximal segment of said user's limb, said second inflation force acting in a second direction, said second direction being substantially the same as said first direction; and said first and said second inflation forces combine to impose movement upon said user's limb.

30. The method of claim 29, wherein said movement is selected from a group consisting of: flexion, extension, abduction, adduction, internal rotation, and external rotation.

31. The method of claim 29, wherein said user's limb is a finger and said joint is at least one of an interphalangeal joint and a metacarpal phalangeal joint.

32. The method of claim 29, wherein said user's limb is an arm and said joint is a wrist.

33. The method of claim 29, wherein said user's limb and joint are selected from a group consisting of a finger, a hand, a wrist, an elbow, a shoulder, a neck, a back, a hip, a knee, an ankle, a foot, one or more toes, an arm, a leg, and any combination thereof.

34. The method of claim 23, wherein:

the at least one inflation force comprises:

a first inflation force at said distal portion and substantially adjacent said distal segment of said user's limb, said first inflation force acting in a first direction relative to said assembly;

a second inflation force at said proximal portion and substantially adjacent said proximal segment of said user's limb, said second inflation force acting in a second direction, said second direction being substantially the same as said first direction; and a third inflation force at said central portion and substantially adjacent said user's joint, said third inflation force acting in a third direction relative to said assembly, said third direction being substantially opposite that of said first and said second directions; and said first, second, and third forces combine to impose "three-force vector".

35. The method of claim 34, wherein said movement is selected from a group consisting of: flexion, extension, abduction, adduction, internal rotation, and external rotation.

36. The method of claim 34, wherein said user's limb is a finger and said joint is at least one of an interphalangeal joint and a metacarpal phalangeal joint.

37. The method of claim 34, wherein said user's limb and joint are selected from a group consisting of a finger, a hand, a wrist, an elbow, a shoulder, a neck, a back, a hip, a knee, an ankle, a foot, one or more toes, an arm, a leg, and any combination thereof.

38. The method of claim 23, wherein the provided assembly further comprises:

a first elongate sleeve having a first longitudinal axis substantially parallel to the user's limb;

a second elongate sleeve having a second longitudinal axis, said second longitudinal axis being substantially parallel to said first longitudinal axis, wherein at least one of said distal, central, and proximal portions and said first and said second openings are located substantially intermediate said first and said second elongate sleeves; and two substantially elongate rod members, each one of said two substantially elongate rod members being configured for insertion within one of said first and second elongate sleeves.

39. The method of claim 23, wherein:

said inflatable member comprises a first inflatable member, a second inflatable member, and a third inflatable member;

said first inflatable member being at least a portion of said distal portion;

said second inflatable member being at least a portion of said central portion;

said third inflatable member being at least a portion of said proximal portion; and said first, second, and third inflatable members are each configured to be individually selectively inflatable so as to provide at least three separate inflation forces upon said user's limb, such that said user's limb is manipulated.

40. An assembly for manipulating a user's limb with an inflatable member, said limb having a distal segment, a proximal segment, and a joint located substantially between said distal and said proximal segments, said assembly comprising:

a first pliable planar member; and a second pliable planar member overlaid atop at least a portion of said first pliable planar member, such that a two ply configuration is provided, said two ply configuration itself comprising:

a distal portion;

a proximal portion;

a central portion located substantially intermediate said distal portion and said proximal portion;

a first opening located substantially intermediate said distal portion and said central portion, said first opening configured to accept a portion of a distal portion of said user's limb;

a second opening located substantially intermediate said proximal portion and said central portion, said second opening configured to accept a portion of a proximal portion of said user's limb; and wherein said first and second pliable planar members combine to define an inflatable member, said inflatable member being at least a portion of at least one of said distal, proximal, and central portions, said inflatable member being configured to be selectively inflatable so as to provide at least a first inflation force upon said user's limb in a first direction by the distal portion and the proximal portion, and at least a second inflation force upon said user's limb in a second direction by the central portion, said second direction being substantially opposite said first direction, such that said joint in said user's limb is manipulated.

41. The assembly of claim 40, further comprising:

a first elongate sleeve having a first longitudinal axis substantially parallel to the user's limb;

a second elongate sleeve having a second longitudinal axis, said second longitudinal axis being substantially parallel to said first longitudinal axis, wherein at least one of said distal, central, and proximal portions and said first and said second openings are located substantially intermediate said first and said second elongate sleeves; and two substantially elongate rod members, each one of said two substantially elongate rod members being configured for insertion within one of said first and second elongate sleeves.

42. The assembly of claim 40, wherein:

said inflatable member comprises a first inflatable member, a second inflatable member, and a third inflatable member;

said first inflatable member being at least a portion of said distal portion;

said second inflatable member being at least a portion of said central portion;

said third inflatable member being at least a portion of said proximal portion; and said first, second, and third inflatable members are each configured to be individually selectively inflatable so as to provide at least three separate inflation forces upon said user's limb, such that said user's limb is manipulated.

43. An inflatable member assembly comprising:

a proximal portion;

a central portion;

a distal portion;

a first opening defined by the inflatable member assembly, said first opening located between said proximal portion and said central portion, wherein said first opening is configured to receive a limb of a user;

a second opening defined by the inflatable member assembly, said second opening located between said central portion and said distal portion, wherein said second opening is configured to receive the limb of the user; and wherein said inflatable member assembly is configured to be selectively inflated so as to provide a first inflation force in a first direction upon the limb of the user at the distal portion of the inflatable member assembly, a second inflation force in substantially the first direction upon the limb of the user at the proximal portion of the inflatable member, and a third inflation force in substantially the opposite direction as the first direction, said third inflation force being upon the limb of the user at the central portion of the inflatable member.

44. The assembly of claim 43, further comprising:

a first elongate sleeve having a first longitudinal axis substantially parallel to the limb of the user;

a second elongate sleeve having a second longitudinal axis, said second longitudinal axis being substantially parallel to said first longitudinal axis, wherein at least one of said distal, central, and proximal portions and said first and said second openings are located substantially intermediate said first and said second elongate sleeves; and two substantially elongate rod members, each one of said two substantially elongate rod members being configured for insertion within one of said first and second elongate sleeves.

45. The assembly of claim 43, wherein:

said inflatable member comprises a first inflatable member, a second inflatable member, and a third inflatable member;

said first inflatable member being at least a portion of said distal portion;

said second inflatable member being at least a portion of said central portion;

said third inflatable member being at least a portion of said proximal portion; and said first, second, and third inflatable members are each configured to be individually selectively inflatable so as to provide at least three separate inflation forces upon said user's limb, such that said user's limb is manipulated.

* * * * *